US006540316B1

(12) United States Patent
Imanaka et al.

(10) Patent No.: US 6,540,316 B1
(45) Date of Patent: Apr. 1, 2003

(54) LIQUID DISCHARGE HEAD AND LIQUID DISCHARGE APPARATUS

(75) Inventors: Yoshiyuki Imanaka, Kawasaki (JP); Hiroyuki Ishinaga, Tokyo (JP); Akihiro Yamanaka, Kawasaki (JP); Masahiko Kubota, Tokyo (JP); Ryoji Inoue, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 45 days.

(21) Appl. No.: 09/587,192

(22) Filed: Jun. 2, 2000

(30) Foreign Application Priority Data

| | | |
|---|---|---|
| Jun. 4, 1999 | (JP) | 11-157736 |
| Jun. 4, 1999 | (JP) | 11-157738 |
| Jun. 4, 1999 | (JP) | 11-158360 |
| Jun. 4, 1999 | (JP) | 11-158363 |
| Jun. 4, 1999 | (JP) | 11-158365 |
| Jun. 4, 1999 | (JP) | 11-158645 |

(51) Int. Cl.[7] ..... B41J 29/38
(52) U.S. Cl. ..... 347/14; 347/19; 347/65
(58) Field of Search ..... 347/14, 54, 19, 347/50, 58, 17, 65

(56) References Cited

U.S. PATENT DOCUMENTS

| | | | | |
|---|---|---|---|---|
| 3,565,060 A | * | 2/1971 | Sipple | 600/508 |
| 4,947,194 A | | 8/1990 | Kyoshima | 346/140 |
| 5,036,337 A | * | 7/1991 | Rezanka | 347/14 |
| 5,278,585 A | * | 1/1994 | Karz et al. | 347/65 |
| 5,585,827 A | | 12/1996 | Murakami | 347/64 |
| 5,608,434 A | * | 3/1997 | Wilson et al. | 347/50 |
| 5,629,578 A | * | 5/1997 | Winzer et al. | 310/334 |
| 5,634,730 A | | 6/1997 | Bobry | 400/88 |
| 5,646,654 A | | 7/1997 | Widder | 347/14 |
| 5,680,702 A | | 10/1997 | Kataoka | 29/890 |
| 5,721,574 A | | 2/1998 | Knubby | 347/7 |
| 5,760,804 A | | 6/1998 | Heinzl et al. | 347/56 |

(List continued on next page.)

FOREIGN PATENT DOCUMENTS

| | | |
|---|---|---|
| DE | 40 23 390 A1 | 1/1992 |
| EP | 0 321 075 A2 | 6/1989 |
| EP | 0 477 425 A1 | 4/1992 |
| EP | 0 488 724 A2 | 6/1992 |
| EP | 0 661 162 A2 | 7/1995 |
| EP | 0 709 199 A2 | 5/1996 |
| EP | 0 819 531 A2 | 1/1998 |
| EP | 0 884 195 A1 | 12/1998 |
| EP | 0 920 999 A2 | 6/1999 |
| GB | 2 170 934 A | 8/1986 |
| JP | 6-297726 | 10/1994 |
| JP | 7-52387 | 2/1995 |

OTHER PUBLICATIONS

Patent Abstracts of Japan, vol. 1997, No. 11, Nov. 28, 1997 (JP 09 187937 A, Jul. 22, 1997).

Patent Abstracts of Japan, vol. 1998, No. 04, Mar. 31, 1998 (JP 09 314541 A, Dec. 9, 1997).

Patent Abstracts of Japan, vol. 010, No. 227 (M–505), Aug. 7, 1986 (JP 61 061859 A, Mar. 29, 1986).

*Primary Examiner*—John Barlow
*Assistant Examiner*—Julian D. Huffman
(74) *Attorney, Agent, or Firm*—Fitzpatrick, Cella, Harper & Scinto

(57) ABSTRACT

A liquid discharge head comprises first and second substrates which are to be mutually adjoined to form plural liquid paths respectively communicating with plural discharge apertures. The first substrate is provided with energy conversion elements, for converting electrical energy into energy for discharging liquid in the liquid paths, respectively corresponding to the liquid paths. The second substrate is provided with detection elements, for detecting a state of the liquid in said liquid paths, respectively corresponding to the liquid paths, and amplification means for respectively amplifying outputs of said detection elements.

23 Claims, 33 Drawing Sheets

U.S. PATENT DOCUMENTS

| | | | | | |
|---|---|---|---|---|---|
| 5,781,205 | A | * | 7/1998 | Silverbrook | 347/17 |
| 5,831,643 | A | * | 11/1998 | Chung | 347/17 |
| 5,841,448 | A | | 11/1998 | Moriyama et al. | 347/19 |
| 5,929,875 | A | * | 7/1999 | Su et al. | 347/19 |
| 6,054,689 | A | | 4/2000 | Imanaka et al. | 219/501 |
| 6,116,714 | A | | 9/2000 | Imanaka et al. | 347/19 |
| 6,224,195 | B1 | | 5/2001 | Maru et al. | 347/60 |
| 6,234,599 | B1 | | 5/2001 | Ishinaga et al. | 347/14 |

* cited by examiner

LIQUID DISCHARGE HEAD AND LIQUID DISCHARGE APPARATUS

BACKGROUND OF THE INVENTION

1. Field of the Invention

The present invention relates to a liquid discharge head for discharging liquid utilizing thermal energy and a liquid discharge apparatus utilizing such liquid discharge head.

2. Related Background Art

Such a liquid discharge head is provided with various mechanisms for achieving stable discharge of liquid (for example ink). As an example, the Japanese Patent Application Laid-Open No. 7-52387 discloses an ink jet recording head equipped with an ink temperature controlling function. The configuration of such ink jet recording head is schematically shown in FIG. 9, and FIG. 10 shows the configuration of a temperature control portion formed on a head board of such ink jet recording head.

Referring to FIG. 9, the ink jet recording head is constructed by forming plural heaters Hn on a head board 500, also forming partition walls 501 for forming ink paths corresponding to the heaters Hn, and adjoining a top plate 502 to the partition walls 501 to form discharge opening 503, ink paths 505 and a common liquid chamber 504. The head board 500 is provided thereon, as shown in FIG. 10, a temperature sensor 510 for detecting the head temperature, sub heaters 511*a*, 511*b* for regulating the head temperature, and a temperature control circuit for driving the sub heaters 511*a*, 511*b* based the output of the temperature sensor 510, composed of an analog converter 512, an amplifier 513, a comparator 514 and a sub heater driver 515.

In the above-described ink jet recording head, the sub heaters 511*a*, 511*b* are controlled according to the output of the temperature sensor 510, whereby the head temperature is maintained within a desired temperature range.

For achieving more stable liquid discharge, in addition to the above-described control of the head temperature, there is conceived a method of detecting the state change of the nozzle in detailed manner (by detecting the change in resistance or temperature through the liquid in each nozzle), and controlling the drive of the liquid discharging heater (heat generating member) according to the result of such detection. However, since the sensor for detecting such state change of the nozzle has a relatively high output impedance, the output of such sensor tends to bear noises caused for example by the head driving current. Therefore, if such sensor is provided on the element substrate bearing the heaters, driving circuit, logic devices etc., the detecting precision of the sensor may be deteriorated by the noises caused for example by the heater driving current. In particular, the current (heater driving current) in the head board is increasing because of the recent increase in the number of nozzles in the liquid discharge head and in the driving speed thereof, so that the above-mentioned noise has become an important issue in finely monitoring the state change of the nozzles.

Also there is recently developed a head in which the element substrate and the top plate are formed with a same silicon material in order to avoid displacement therebetween resulting from the thermal expansion induced by the driving of the heat generating members, and such configuration has enabled to suitably distribute the sensor and various circuit elements on such element substrate and top plate according to the functions of such elements, but the head in consideration of the above-mentioned noise issue has never been developed and has been longed for.

Further, the output signal from the sensor can be relieved from the influence of the noises by amplification with an amplifier, but such noises tend to be picked up if the distance between the sensor and the amplifier increases. It is therefore important to take the noise issue into consideration also in determining the positional relationship of the sensor and the amplifier.

SUMMARY OF THE INVENTION

In consideration of the foregoing, the object of the present invention is to provide a liquid discharge head capable of more stable liquid discharge and a liquid discharge apparatus provided with such liquid discharge head.

The above-mentioned object can be attained, according to the present invention, by a liquid discharge head comprising first and second substrates which are mutually adjoined to constitute plural discharge apertures and plural liquid paths respectively communicating therewith, wherein the first substrate bears energy conversion elements, for converting electrical energy into energy for discharging the liquid in the liquid paths, respectively in the liquid paths while the second substrate bears detection elements, for detecting a liquid state in the liquid paths, respectively in the liquid paths and amplifier means for amplifying the respective outputs of the detection elements.

Also according to the present invention, there is provided a liquid discharge apparatus featured by comprising the above-mentioned liquid discharge head and driving the energy generating elements of the first substrate constituting the liquid discharge head under adjustment based on the result of detection by the detection elements of the second substrate constituting the liquid discharge head, thereby discharging liquid onto a recording medium to form a record thereon.

According to the present invention, as explained in the foregoing since the detection elements and the amplifier means are provided on the second substrate which is different from the first substrate bearing the energy conversion elements, the outputs of the detection elements are less contaminated by the noise (of the heater driving current) generated in driving the energy conversion elements and the distance between the detection element and the amplifier means can be made shorter, so that the precision of detection is not deteriorated.

Also according to the present invention, the detection elements and the amplifier means are formed on the second substrate which is more spacious in comparison with the first substrate bearing the energy conversion elements, so that the aforementioned issue of limitation in space is not encountered.

Furthermore, in a liquid discharge head provided with switching means for switching the locations of detection, the detection elements are serially driven so that the space for positioning such detection elements on the second substrate can be limited.

According to the present invention, there is also provided a liquid discharge head comprising first and second substrates which are to be mutually adjoined to form plural discharge apertures and plural liquid paths respectively communicating with the discharge apertures, wherein the first substrate is provided with energy conversion elements, for converting electrical energy into energy for discharging the liquid in the liquid paths, respectively corresponding to the liquid paths, and the second substrate is provided with detection elements for detecting the state of the liquid in the liquid paths respectively corresponding to the liquid paths and amplification means for amplifying the respective outputs of the detection elements.

According to the present invention, there is also provided a method for producing a liquid discharge head including plural discharge apertures for discharging liquid; first and second substrates which are to be mutually adjoined to form plural liquid paths respectively communicating with the discharge apertures; plural energy conversion elements respectively provided in the liquid paths, for converting electrical energy into energy for discharging the liquid in the liquid paths; and plural elements or electrical circuits of different functions for controlling the drive condition of the energy conversion elements, the elements or electrical circuits being dividedly provided on the first and second substrates according to the functions, the method comprising:

a step of forming plural protruding electrical connecting portions, on either of the first and second substrates, for mutually and electrically connecting the elements or electrical circuits of the first and second substrates;

a step of forming plural recessed electrical connecting portions, on the other of the first and second substrates, for respectively engaging with the protruding electrical connecting portions and being electrically connected therewith; and a step of engaging the plural protruding electrical connecting portions with the respectively corresponding plural recessed electrical connecting portions at the adjoining of the first and second substrate.

According to the present invention, there is also provided a method for producing a liquid discharge head including plural discharge apertures for discharging liquid; first and second substrates which are to be mutually adjoined to form plural liquid paths respectively communicating with the discharge apertures; plural energy conversion elements respectively provided in the liquid paths, for converting electrical energy into energy for discharging the liquid in the liquid paths; and plural elements or electrical circuits of different functions for controlling the drive condition of the energy conversion elements, the elements or electrical circuits being dividedly provided on the first and second substrates according to the functions, the method comprising:

a step of preparing a first silicon wafer including plural first substrates, each provided with a first electrical connecting portion for mutually and electrically connecting the elements or electrical circuits of the first and second substrates;

a step of preparing a second silicon wafer including plural second substrates, each provided with a second electrical connecting portion for mutually and electrically connecting the elements or electrical circuits of the first and second substrates;

an impingement step of impinging the first silicon wafer on the second silicon wafer in such a manner that the first electrical connecting portion is opposed to the second electrical connecting portion corresponding to the first electrical connecting portion;

an adjoining step of adjoining the first electrical connecting portion with the second electrical connecting portion corresponding to the first electrical connecting portion by eutectic bonding; and a cutting step of integrally cutting the adjoined first and second silicon wafers after the adjoining step.

In the present specification, the word "upstream" or "downstream" defines a position with respect to the direction of liquid flow from a liquid supply source to a discharge aperture through a bubble generating area (or a movable member) or with respect to the direction in such configuration.

BRIEF DESCRIPTION OF THE DRAWINGS

FIGS. 1A and 1B are views showing the configuration of a liquid discharge head constituting an embodiment of the present invention, wherein FIG. 1A is a plan view of an element substrate while FIG. 1B is a plan view of a top plate;

FIGS. 3A and 3B are views showing a liquid discharge head provided with a liquid viscosity sensor, in an embodiment of the present invention, wherein FIG. 3A is a cross-sectional view along the liquid path of the liquid discharge head while FIG. 3B is a schematic circuit diagram of a viscosity measuring circuit;

FIGS. 6A and 6B are views showing a variation of the present invention, wherein FIG. 6A is a plan view of an element substrate while FIG. 6B is a plan view of a top plate;

FIGS. 7A and 7B are views showing a variation of the present invention, wherein FIG. 7A is a plan view of an element substrate while FIG. 7B is a plan view of a top plate;

FIGS. 8A and 8B are views showing a variation of the present invention, wherein FIG. 8A is a plan view of an element substrate while FIG. 8B is a plan view of a top plate;

FIGS. 29A and 29B are views showing circuit configuration of the liquid discharge head shown in FIG. 1, wherein FIG. 29A is a plan view of an element substrate while FIG. 29B is a plan view of a top plate;

DETAILED DESCRIPTION OF THE PREFERRED EMBODIMENTS

[First Embodiment]

In the following there will be explained a first embodiment of the present invention, with reference to the accompanying drawings.

Figure 2:
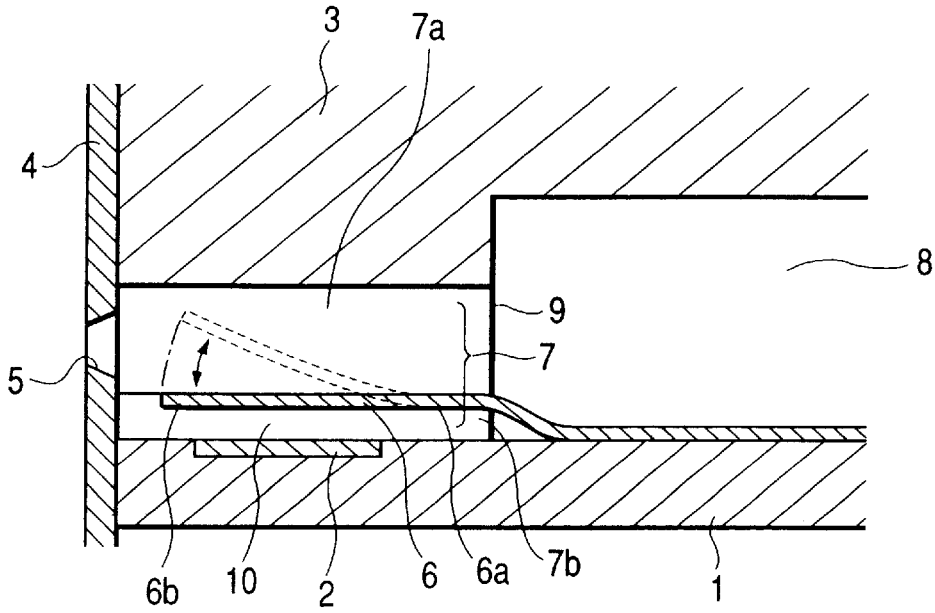
FIG. 2 is a cross-sectional view along the liquid path, showing the configuration of a liquid discharge head embodying the present invention.

At first there will be briefly explained the configuration of the liquid discharge head applicable to the present invention. The liquid discharge head applicable to the present invention has such a structure in which an element substrate and a top plate are mutually adjoined to form plural discharge apertures (ports) and plural liquid paths respectively communicating therewith. FIG. 2 shows an example of the liquid discharge head applicable to the present invention.

The liquid discharge head shown in FIG. 2 is provided with an element substrate 1 on which plural heat generating members 2 (only one being shown in FIG. 2) are formed in parallel manner for providing thermal energy for generating a bubble in liquid, a top plate 3 adjoined onto the element substrate 1, an orifice plate 4 adjoined to the front end face of the element substrate 1 and the top plate 3, and a movable member 6 provided in a liquid path 7 formed by the element substrate 1 and the top plate 3.

The element substrate 1 is obtained by forming, on a silicon substrate or the like, a silicon oxide film or a silicon nitride film for electrical insulation and heat accumulation, and patterning thereon an electrical resistance layer constituting a heat generating member 2 and wirings therefor. A voltage is applied from these wirings to the electrical resistance layer to induce a current therein, whereby the heat generating member 2 generates heat.

The top plate 3 is provided for constituting plural liquid paths 7 respectively corresponding to the heat generating members 2 and a common liquid chamber 8 for supplying the liquid paths 7 with liquid, and is integrally provided with liquid path walls 9 extending in the spaces between the heat generating members 2. The top plate 3 is composed of a silicon-containing material, and is obtained by forming the pattern of the liquid paths 7 and the common liquid chamber 8 by etching, or depositing the material for the liquid path walls 9, such as silicon nitride or silicon oxide by a known film forming method such as CVD on the silicon substrate and etching off the portion of the liquid paths 7. In addition, the top plate 3 may be further provided, in the course of preparation thereof, with circuit elements of a temperature control portion to be explained later and featuring the present invention.

The orifice plate 4 is provided with plural discharge apertures 5, respectively corresponding to the liquid paths 7 and communicating with the common liquid chamber 8 respectively through the liquid paths 7. Also the orifice plate 4 is composed of a silicon-containing material, and is obtained for example by grinding the silicon substrate bearing the discharge apertures 5, into a thickness of 10 to 150 $\mu$m. The orifice plate 4 is not an indispensable component in the present invention, and may be replaced by a top plate with discharge apertures which can be obtained by leaving a wall corresponding to the thickness of the orifice plate 4 at the front end face of the top plate 3 at the formation of the liquid paths 7 thereon, and forming the discharge apertures 5 in thus left wall portion.

The movable member 6 is a thin film, formed as a beam supported at an end so as to face the heat generating member 2 so as to separate the liquid path 7 into a first liquid path 7*a* communicating with the discharge aperture 5 and a second liquid path 7*b* containing the heat generating member 2, and is formed with a silicon-containing material such as silicon nitride or silicon oxide.

The movable member 6 is provided in a position opposed to the heat generating member 2 with a predetermined distance therefrom so as to cover the same, with a fulcrum 6*a* at the upstream side of a main flow of the liquid from the common liquid chamber 8 through the movable member 6 to the discharge aperture 5 caused by the liquid discharge operation, and a free end 6*b* at the downstream side with respect to the fulcrum 6*a*. The space between the heat generating member 2 and the movable member 6 constitutes a bubble generation area 10.

When the heat generating member 2 generates heat in the above-described configuration, the generated heat acts on the liquid in the bubble generation area 10 between the movable member 6 and the heat generating member 2, whereby a bubble is generated and grows on the heat generating member 2 by a film boiling phenomenon. The pressure resulting from the bubble growth preferentially acts on the movable member 6, which is thus displaced and opens toward the discharge aperture 5 about the fulcrum 6*a*, as indicated by a broken line in FIG. 2. By the displacement of the movable member 6 or by the displacement thereof, the propagation of the pressure resulting from the bubble generation or the bubble growth itself is guided toward the discharge aperture 5, whereby the liquid is discharged therefrom.

Thus the presence, in the bubble generation area 10, of the movable member 6 having the fulcrum 6*a* at the upstream side of the liquid flow in the liquid path 7 (namely at the side of the common liquid chamber 8) and having the free end 6*b* at the downstream side (namely at the side of the discharge aperture 5), guides the propagation of the bubble pressure toward the downstream side, whereby the bubble pressure effectively and directly contributes to the liquid discharge. Also the direction of growth of the bubble itself is similarly guided, like the pressure propagation, toward the downstream side whereby the bubble growth larger in the downstream side than in the upstream side. Such control of the growing direction itself of the bubble and of the propagating direction of the bubble pressure by means of the movable member allows to improve the basic discharge characteristics such as the discharge efficiency, discharge force or discharge speed.

On the other hand, once the bubble enters a bubble quenching stage, the bubble vanishes rapidly by the multiplying effect with the elastic force of the movable member 6, whereby the movable member 6 eventually returns to the initial position, indicated by a solid line in FIG. 2. In this state, in order to replenish the volume reduction of the bubble in the bubble generation area 10 and the volume of the discharge liquid, the liquid flows in from the upstream side or from the side of the common liquid chamber 8 to achieve liquid refilling in the liquid path 7, and such liquid refilling can be achieved efficiently and stably by the contribution of the returning action of the movable member 6.

Figure 1A:
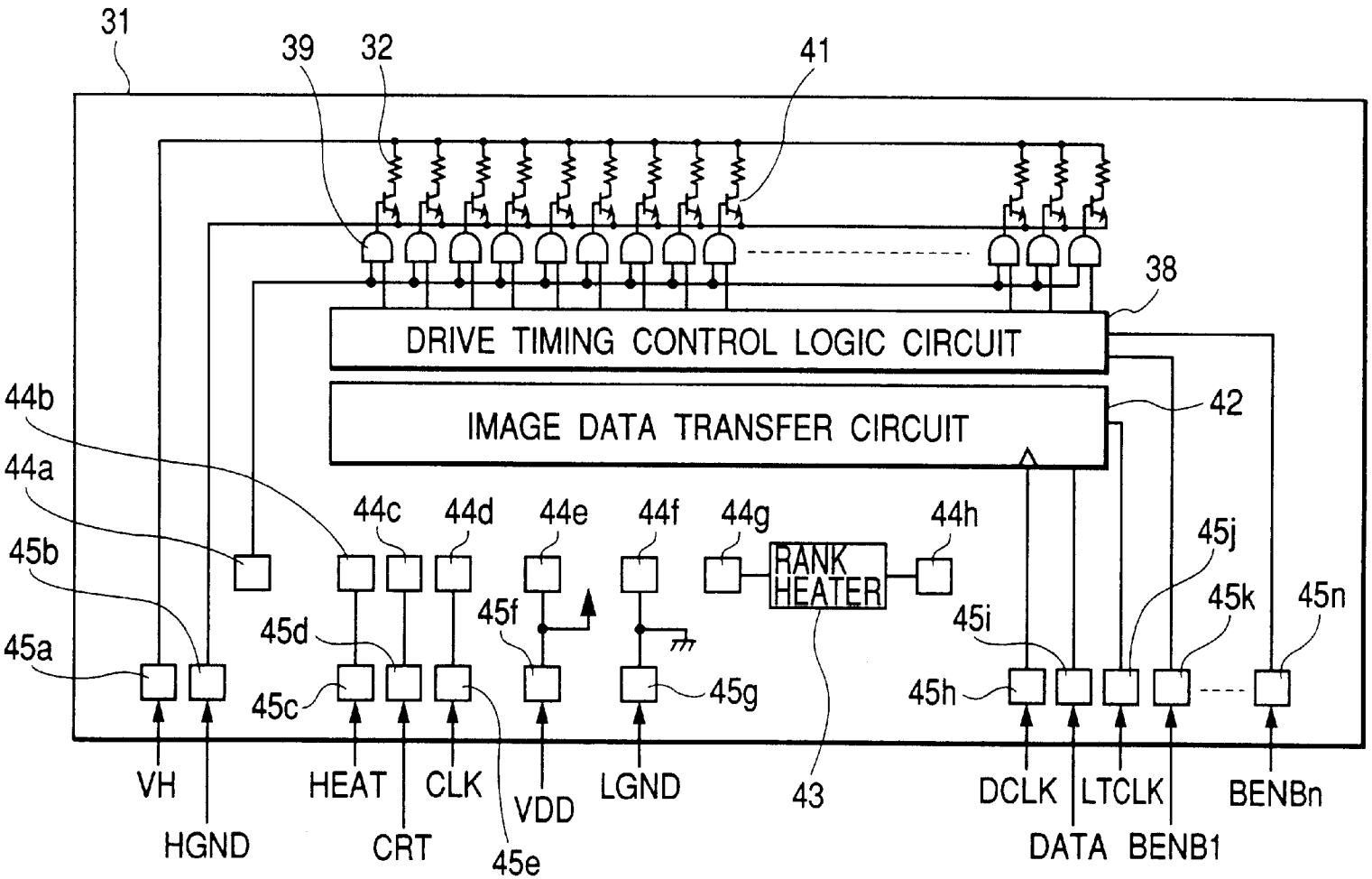
Figure 1B:
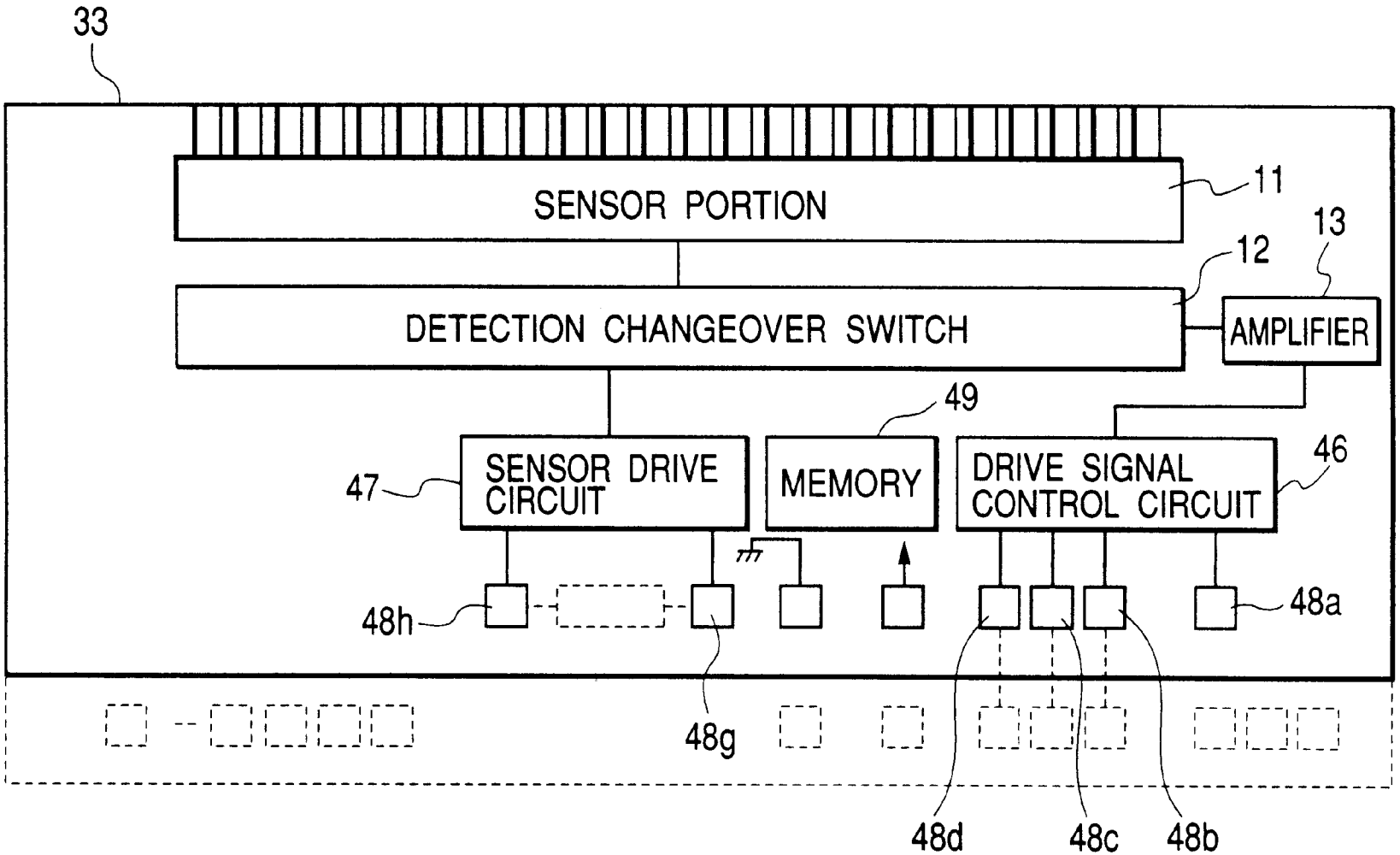

In the following there will be explained in detail the arrangement of circuit elements, featuring the liquid discharge head of the present invention. FIGS. 1A and 1B show the arrangement of the circuit elements to be formed on the element substrate and the top plate of the liquid discharge head in an embodiment of the present invention.

As shown in FIG. 1A, an element substrate 31 (corresponding to the element substrate 1 in FIG. 2) is provided with heat generating members 32 (corresponding to the heat generating members 2 in FIG. 2) arranged in a linear array, power transistors 41 functioning as drivers, AND gates 39 for controlling the function of the power transistors 41, a drive timing controlling logic circuit 38 for controlling the drive timing of the power transistors 41, an image data transfer circuit 42 constituted by a shift register and a latch circuit, and a rank heater 43 for directly detecting the resistance or temperature of the heat generating members 32.

The driving timing controlling logic circuit 38 is provided for driving the heat generating members 32 in divided manner on time-shared basis instead of simultaneous driving, in order to reduce the power supply capacity of the apparatus, and enable signals for activating the logic circuit 38 are entered from enable signal input terminals 45*k* to 45*n* constituting an external contact pad.

In addition to the enable signal input terminals 45*k* to 45*n*, the external contact pad provided on the element substrate 31 includes an input terminal 45*a* for the power supply for driving the heat generating members 32, a ground terminal 45*b* for the power transistors 41, signal input terminals 45*c* to 45*e* for controlling the energy for driving the heat generating members 32, a driving power supply terminal 45*f* for the logic circuit, a ground terminal 45*g*, an input terminal 45*i* for the serial data entered into the shift register of the image data transfer circuit 42, an input terminal 45*h* for a serial clock signal synchronized with the serial data, and an input terminal 45*j* for a latch clock signal to be entered into the latch circuit.

On the other hand, as shown in FIG. 1B, a top plate 33 (corresponding to the top plate 3 in FIG. 2) is provided with a sensor portion 11 including sensors provided respectively for the liquid paths for detecting the change in resistance or temperature through the liquid, a selector switch 12 for selecting the sensors of the sensor portion 11 in succession, an amplifier 13 for amplifying the output of the sensor selected by the selector switch 12, a sensor drive circuit 47 for driving the sensor selected by the selector switch 12 and the rank heater 43, a drive signal control circuit 46 for monitoring the outputs of the amplifier 13 and the rank heater 43 and accordingly controlling the energy applied to the heat generating members 32, and a memory 49 for storing codes ranked according to the resistance data (or temperature data) or resistance (or temperature) detected by the sensors of the sensor portion 11 and the liquid discharge characteristics measured in advance for the respective heat generating member 32 (liquid discharge amount by the application of a predetermined pulse under a predetermined temperature) as head information and supplying such head information to the drive signal control circuit 46.

As contact pads for connection, the element substrate 31 and the top plate 33 are provided with terminals 44*g*, 44*h*, 48*g*, 48*h* for connecting the rank heater 43 and the sensor drive circuit 47, terminals 44*b* to 44*d*, 48*b* to 48*d* for connecting the input terminals 45*c* to 45*e* for external signals for controlling the energy for driving the heat generating members 32 with the drive signal control circuit 46, a terminal 48*a* for entering the output thereof into an input port of each of the AND gates 39.

In the liquid discharge head of present embodiment of the above-described configuration, the rank heater 43 directly detects the state change of the heat generating member 32 (or the vicinity thereof) of the element substrate 31 and each sensor of the sensor portion 11 detects the fine state change of the liquid in each liquid path, and the heat generating members 32 are controlled according to the result of such detection. In the following there will be given a detailed description on each drive control.

<Drive Control Utilizing Sensor Portion 11>

The sensor portion 11 detects the state change in each liquid path (nozzle), namely the change in resistance or temperature through the liquid. In the following there will be explained the function in case the sensor portion 11 is composed of resistance sensors.

At first the selector switch 12 selects one of the sensors of the sensor portion 11, and the selected sensor is activated by the sensor drive circuit 47. The result of detection (resistance data) from the activated sensor is entered through the amplifier 13 into the memory 43 and stored therein. The drive signal control circuit 46 determines the data for upshift and downshift of the drive pulse for the heat generating member 32 according to the resistance data stored in the memory 49 and the liquid discharge characteristics, and sends such data to the AND gate 39 through the terminals 48*a*, 44*a*. Then the selector switch 12 selects another of the sensors of the sensor portion 11, then the result of detection is similarly stored in the memory 49 and the upshift and downshift data for the drive pulse for the heat generating member 32 are supplied to the AND gate 39. In this manner the sensors of the sensor portion 11 are selected in succession by the selector switch 12, and the upshift and downshift data based on the result of detection by the sensor are supplied to the AND gate 39. On the other hand, the serially entered image data are stored in the shift register of the image data transfer circuit 42, then latched in the latch circuit by the latch signal and supplied to the AND gates 39 by the drive timing control circuit 38. Thus the pulse width of the heating pulse is determined according to the upshift and downshift data, and the heat generating member 32 is energized with such pulse width. As a result, the liquid discharge amount becomes constant at each discharge aperture.

In case the sensor of the sensor portion 11 are composed of temperature sensors for detecting the temperature change through the liquid, such temperature sensors of the sensor portion 11 are selected in succession and the result of detection is stored in the memory 49. In such case, the drive signal control circuit 46 applies, prior to the application of the heat pulse for liquid discharge, a pulse (pre-heat pulse) of such small energy not inducing the liquid discharge, according to the result of detection stored in the memory 49 and the liquid discharge characteristics, with a change in the pulse width of such pre-heat pulse or in the output timing thereof, in order to maintain the temperature of the liquid in the liquid path within a desired temperature range. In this manner there can be obtained a constant liquid discharge amount at each discharge aperture.

The above-described drive control utilizing the temperature sensors, the data for determining the pre-heat pulse width can be stored only once for example at the start of operation of the liquid discharge apparatus. In such case, after the power supply of the liquid discharge apparatus is turned on, the drive signal control circuit 46 determines the pre-heating pulse width for each heat generating member 32, according to the liquid discharge characteristics measured in advance and the temperature data detected by the sensor portion 11. The memory 49 stores the selection data for selecting the pre-heat pulse width corresponding to each heat generating member 32, and, at the actual pre-heating operation, the pre-heat signal is selected according to the selection data stored in the memory 49, whereby the heat generating member 32 is pre-heated.

In the above-described configuration, the sensors of the sensor portion 11 and the amplifier are formed on the top plate, so that the output signals of the sensors of the sensor portion 11 and the signal between the sensor and the amplifier are not affected by the noise induced by the heater drive current generated on the element substrate 31.

Also the sensor drive circuit 47, the drive signal control circuit 46 and the selector switch 12 are formed on the top plate, and are therefore not influenced by the noise of the heat drive current.

Furthermore, as the sensors of the sensor portion 11 are serially activated by the selector switch 12, the space required therefor can be limited on the top plate 33, whereby the head itself can be made compacter.

Figure 3A:
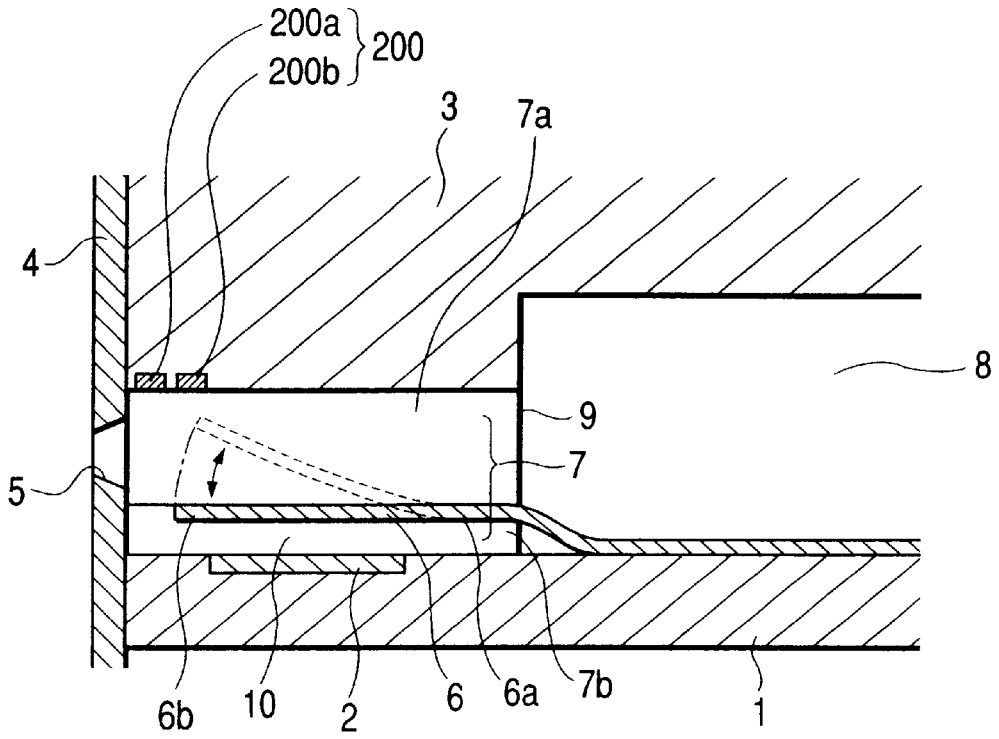
Figure 3B:
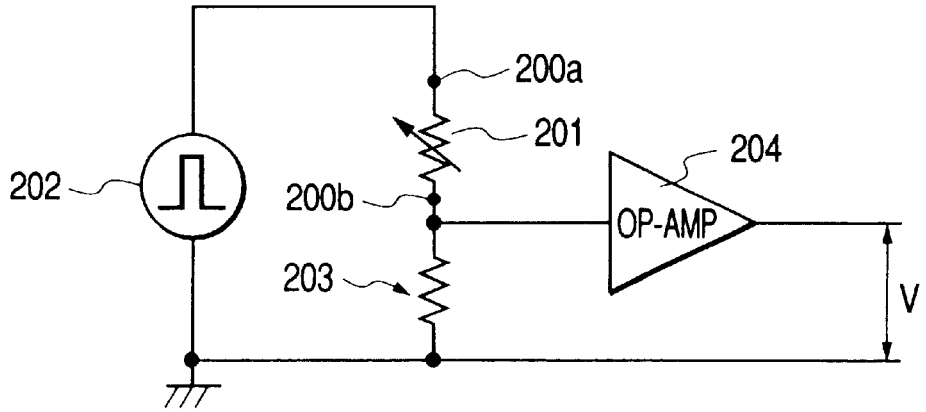

The above-described drive control utilizing the resistance sensors or temperature sensors may also be applied for detecting the viscosity or concentration of the liquid in the liquid path and controlling the drive of the heat generating member 32 so as to maintain these properties within a desired range. As an example, FIG. 3A is a cross-sectional view, along the liquid path, of a liquid discharge head having a function of detecting the viscosity of the liquid in the liquid path, while FIG. 3B is a schematic circuit diagram of a viscosity measuring circuit provided on the top plate. In FIG. 3A, components same as those in FIG. 2 are represented by same numbers.

In this example, there are provided an element substrate 1 bearing plural heat generating members 2 (one being shown in FIG. 3A) arranged in parallel manner, for providing the liquid with thermal energy for generating a bubble therein, a top plate 3 adjoined onto the element substrate 1 and bearing electrodes 200*a*, 200*b* of viscosity sensors 200, an orifice plate 4 adjoined to the front end face of the element substrate 1 and the top plate 3, and a movable member 6 provided in a liquid path constituted by the element substrate 1 and the top plate 3.

On the surface of the top plate 3 there are formed viscosity sensors 200 for measuring the viscosity of the liquid in respective first liquid path 7*a*. The viscosity sensor 20 is provided, in the vicinity of the discharge aperture 5, with electrodes 200*a*, 200*b* positioned in parallel to the direction of flow, so as to be in contact with the liquid.

As shown in FIG. 3B, the viscosity measuring circuit is composed of a resistor 201 varying the resistance according to the viscosity of the liquid between the electrodes 200*a*, 200*b*, a resistor 203 for providing a reference resistance, and an operational amplifier 204 serving as a buffer. The circuit elements constituting the viscosity measuring circuit are formed by a semiconductor wafer process on the top plate.

The above-described viscosity measuring circuit provides, as the result of detection of the liquid viscosity, an output voltage V determined by an input pulse voltage, applied from a viscosity sensor drive circuit (not shown) for driving the viscosity sensor 200, and the resistance of the resistor 201. Based on such result of detection, there is executed the drive control explained in the foregoing.

<Drive Control Utilizing Rank Heater 43>

The rank heater 43 is formed on the element substrate 31 and directly detects the resistance of the heat generating member 32 or the temperature of the element substrate 31. The rank sensor 43 can be composed, for example, of a temperature sensor capable of directly measuring the temperature in the vicinity of the heat generating the resistance of the heat generating member 32. As the temperature or resistance to be detected shows a large change, such rank heater 43 is influenced little by the aforementioned noise of the heater drive current, though such noise is superposed on the output.

In case the rank heater 43 detects an abnormally high temperature of the element substrate 31, the corresponding result is supplied to the drive signal control circuit 46, which in response executes an operation of limiting or interrupting the drive of the heat generating member 32.

In the above-described drive control for the heat generating member 32, the sensor portion 11 may be provided with plural units of each of the resistance sensor and the temperature sensor and both the heat pulse and the pre-heat pulse may be controlled according to the result of detection by these sensors to further improve the image quality.

It is also possible to divide the array of the heat generating members 32 into plural blocks and to detect the liquid state in each block by the sensor portion 11. In such case, the drive control of the heat generating members 32 by the drive signal control circuit 46 and the image data output by the image data transfer portion 42 are executed in the unit of such divided block. It is thus rendered possible to easily accommodate a higher printing speed.

It is furthermore possible to store the outputs of the sensors of the sensor portion 11 and of the rank heater 43, and to control the drive of the heat generating members 32 based on the results of such detection and on the liquid discharge characteristics stored in advance and corresponding to such results of detection.

Further, the head information stored in the memory 49 may include, in addition to the aforementioned resistance data of the heat generating members, kind of the liquid to be discharged (for example ink color in case the liquid is ink). This is because the physical property and discharge characteristics of the liquid vary depending on the kind thereof. Such head information may be stored in the memory 49 in non-volatile manner after the assembly of the liquid discharge head or may be transferred from the liquid discharge apparatus employing the liquid discharge head after the apparatus is started up.

In the following there will be explained an example of the process of forming the circuits on the element substrate 31 and the top plate 33.

The element substrate 31 is obtained by forming circuits constituting the drive timing controlling logic circuit 38, image data transfer portion 42 and rank heater 43 by a semiconductor wafer process on a silicon substrate, then forming the heat generating members 32 and finally forming the connecting contact pads and external contract pads.

The top plate 33 is obtained by forming the sensor portion 11, selector switch 12, amplifier 13, drive signal control circuit 46 and sensor drive circuit 47 by a semiconductor wafer process on a silicon substrate, then forming grooves and a supply aperture constituting the liquid paths and common liquid chamber by a film forming technology and etching, and finally forming the connecting contact pads.

When the element substrate 31 and the top plate 33 of the above-described configuration are adjoined with mutual alignment, the heat generating members 32 are positioned respectively corresponding to the liquid paths and the circuits formed on the element substrate 31 and the top plate 33 are electrically connected through the connecting pads. The electrical connection can be achieved, for example, by placing a gold bump on each connecting pad, but there may also be adopted other methods. After the adjoining of the element substrate 31 and the top plate 33, the orifice plate is adjoined to the front end of the liquid paths, whereby the liquid discharge head is completed. As shown in FIG. 2, the liquid discharge head of the present embodiment has the movable members 6, and such movable members 6 may be formed by a photolithographic process on the element substrate 31, after the formation of the circuits thereon as explained in the foregoing.

Figure 4:
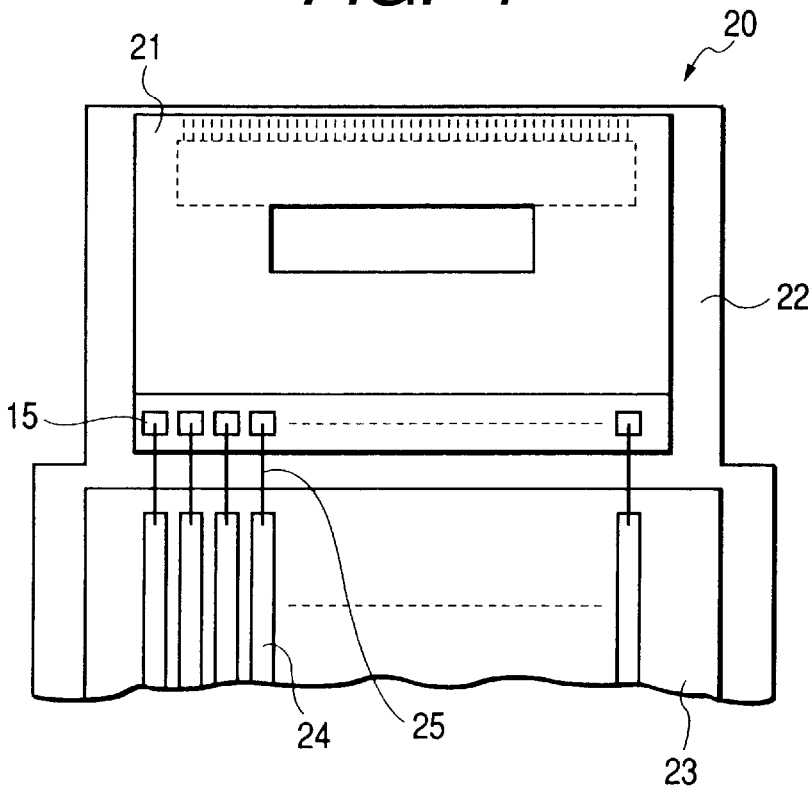
FIG. 4 is a plan view of a liquid discharge head unit bearing the liquid discharge head shown in FIG. 1.

In mounting thus obtained liquid discharge head on a head cartridge or on a liquid discharge apparatus, the head is fixed on a base board 22 bearing a printed circuit board 23, thereby forming a liquid discharge head unit 20. Referring to FIG. 4, the printed circuit board 23 is provided with plural wiring patterns 24 to be electrically connected with the head control portion of the liquid discharge apparatus, and such wiring patterns 24 are electrically connected with the external contact pads 15 through bonding wires 25. In the foregoing there has been explained a configuration in which the external contact pads 15 are provided solely on the element substrate, but they may be also provided solely on the top plate.

In the liquid discharge head explained in the foregoing, the heat generating members 32 are controlled according to the sensor outputs, but there may also be adopted a configuration in which the temperature of the element substrate 31 is controlled according to the sensor outputs. In the following there will be explained a liquid discharge head capable of controlling the temperature of the element substrate.

Figure 5:
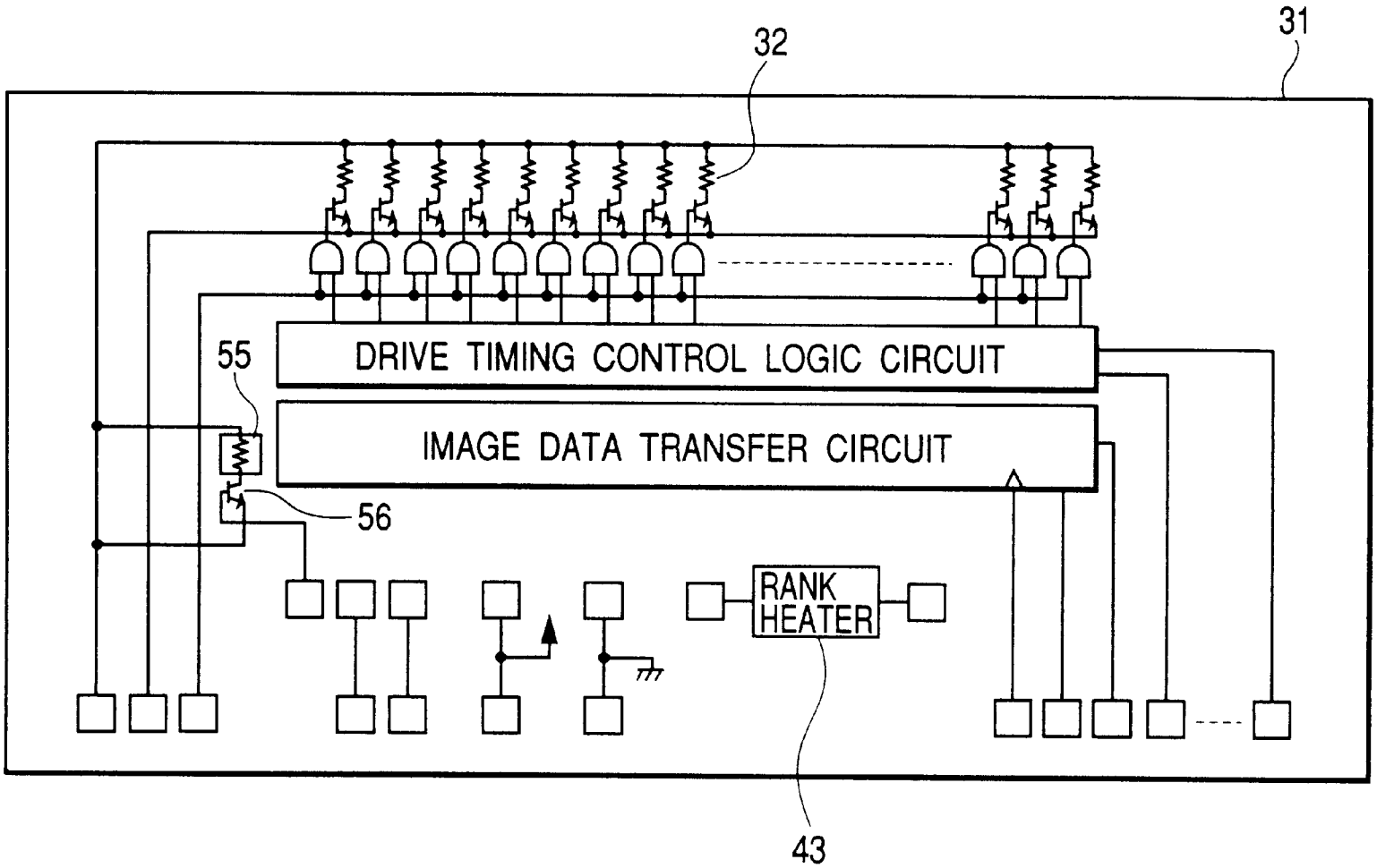
FIG. 5 is a view showing a liquid discharge head capable of controlling the temperature of the element substrate and constituting an embodiment of the present invention.

FIG. 5 is a view showing the circuit configuration of the element substrate and the top plate in the configuration capable of controlling the temperature of the element substrate according to the sensor outputs, wherein components equivalent to those in FIGS. 1A and 1B are represented by same numbers.

In this configuration, as shown in FIG. 5, the element substrate 31 is provided, in addition to the heat generating members 32 for liquid discharge, with a temperature holding heater 55 for heating the element substrate 31 itself in order to regulate the temperature thereof and a power transistor 56 constituting a driver for the temperature holding heater 55. In this configuration, the sensors of the sensor portion 11 on the top plate are composed of temperature sensors.

In this embodiment, the drive signal control circuit 46 is provided with a comparator, which compares the output of each sensor with a threshold value determined in advance from the temperature required for the element substrate 31 and, if the output of the sensor is larger than the threshold value, outputs a heater control signal for driving the temperature holding heater 55. The above-mentioned temperature at which the liquid in the liquid discharge head has a viscosity within a stable discharge range. The heater control signal from the drive signal control circuit 46 is supplied to the power transistor 56 for the temperature holding heater, through terminals (connecting pads) formed on the element substrate 31 and the top plate 33.

In the above-described configuration, the temperature holding heater 55 is driven by the drive signal control circuit 46 according to the output of each sensor, whereby the temperature of the element substrate 31 is maintained at a predetermined value. As a result, the viscosity of the liquid in the liquid discharge head is maintained with the stable discharge range to enable stable liquid discharge.

The sensors show individual fluctuation in the output. For achieving more accurate temperature control, it is also possible to store the correction values for the fluctuation of the outputs as the head information in the memory 49 and to adjust the threshold value set in the drive signal control circuit 46 according to such correction value stored in the memory 49.

In the following there will be explained, as variations of the foregoing liquid discharge head, certain examples having at least a temperature sensor for detecting the presence or absence of ink and an amplifier for the output thereof on the top plate and the head driving function of such examples based on the result of detection by such temperature sensor.

Figure 6A:
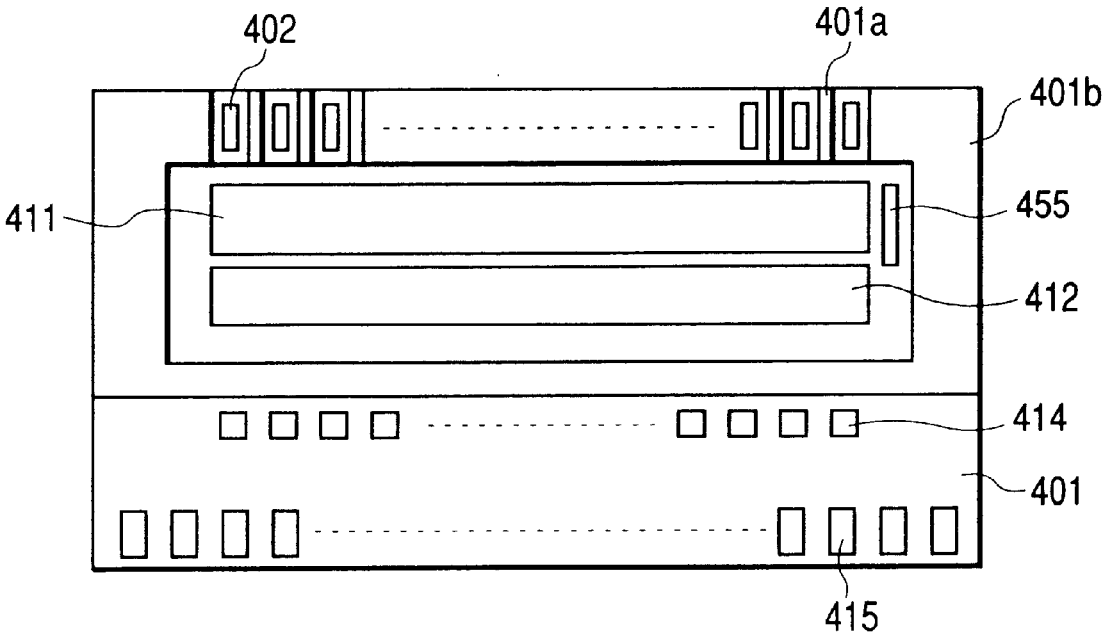
Figure 6B:
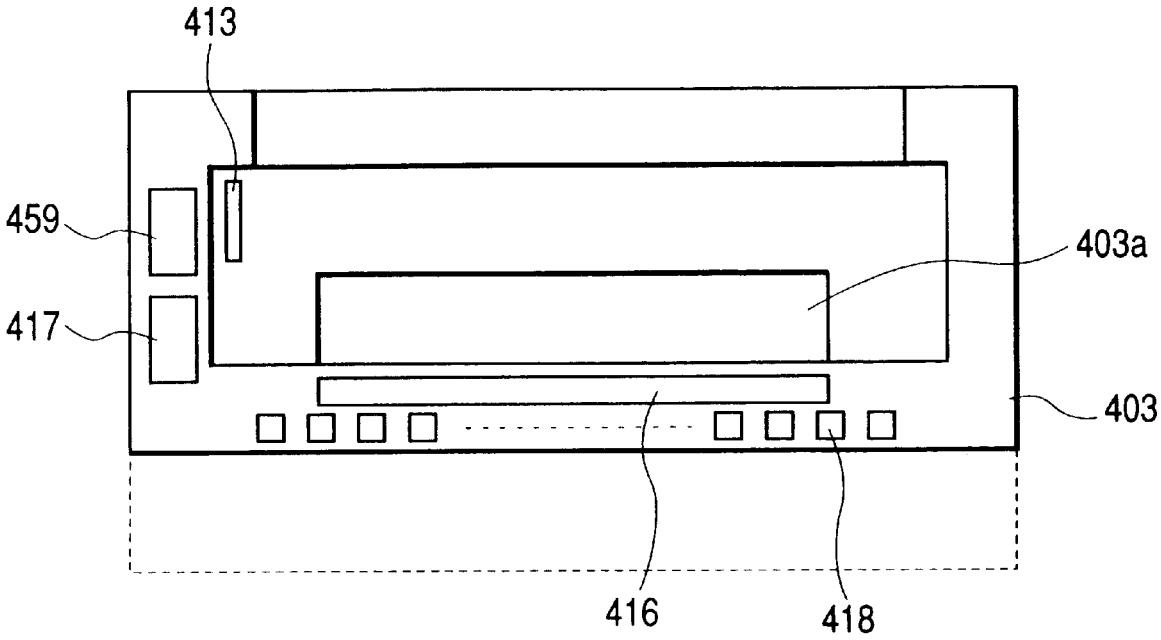
Figure 7A:
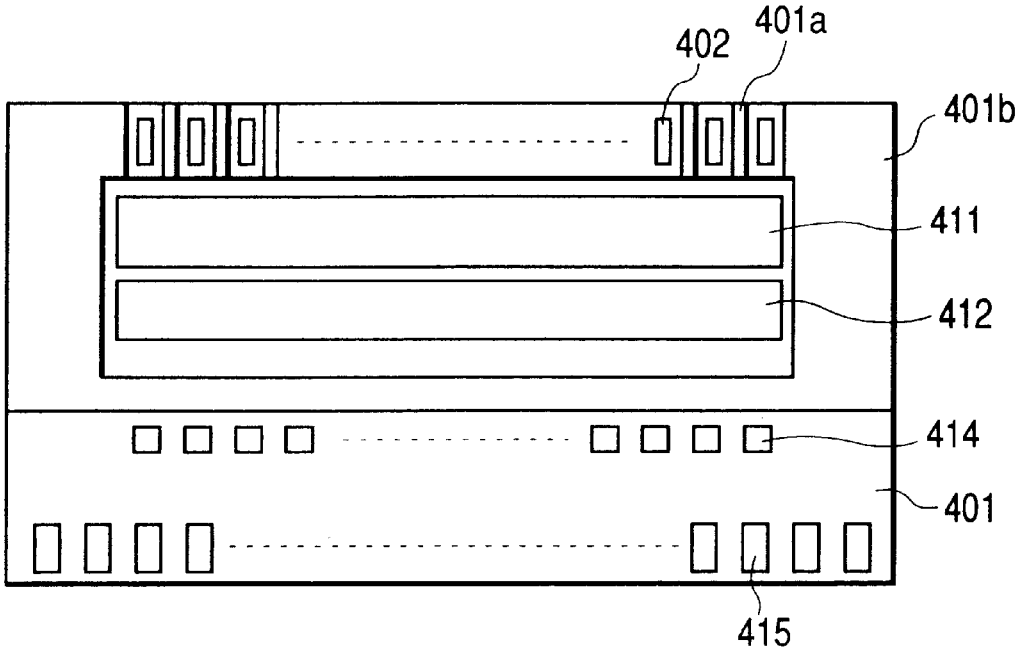
Figure 7B:
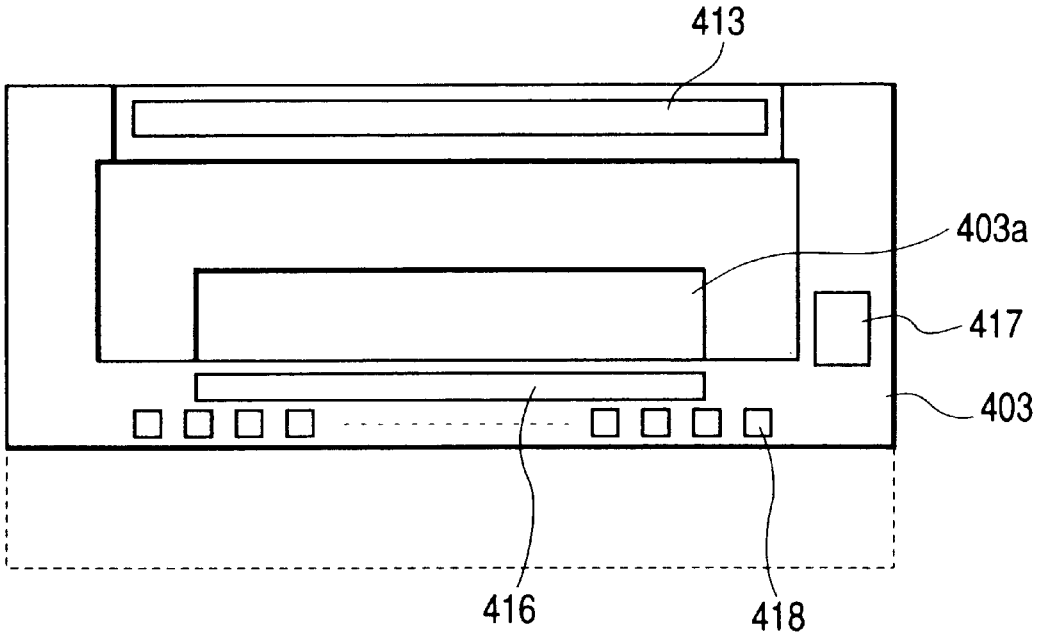
Figure 8A:
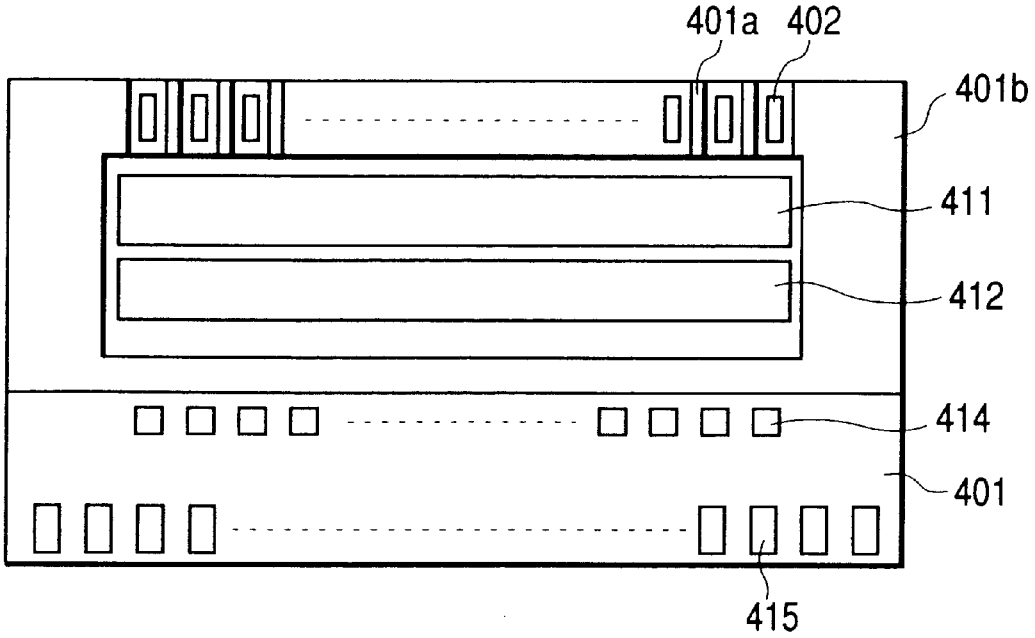
Figure 8B:
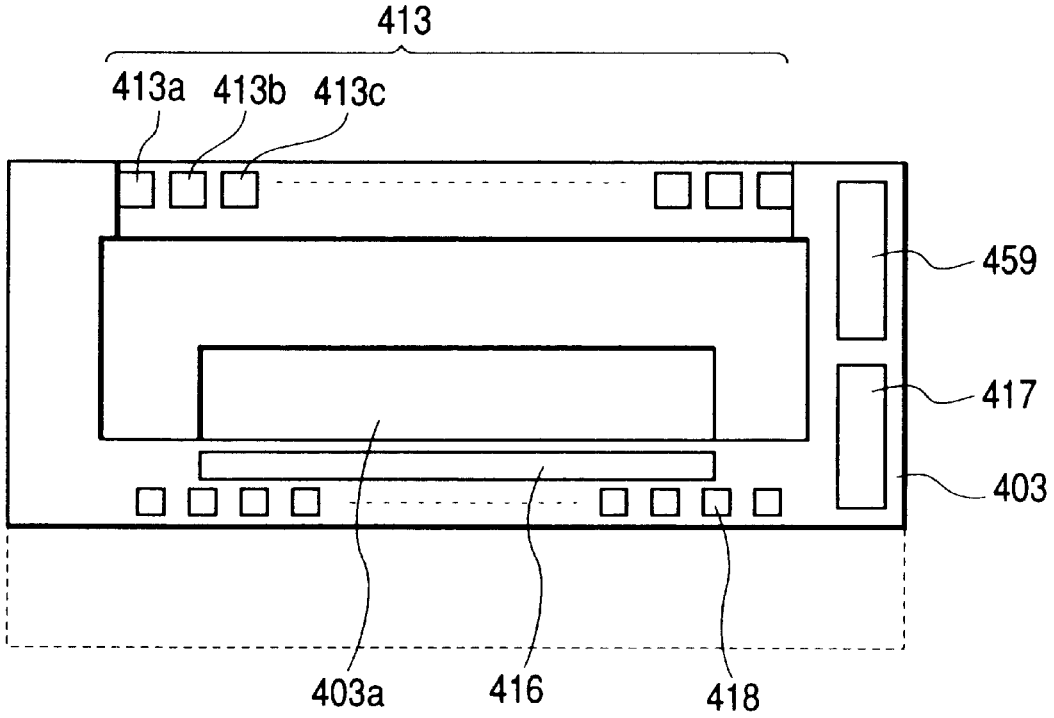
Figure 9:
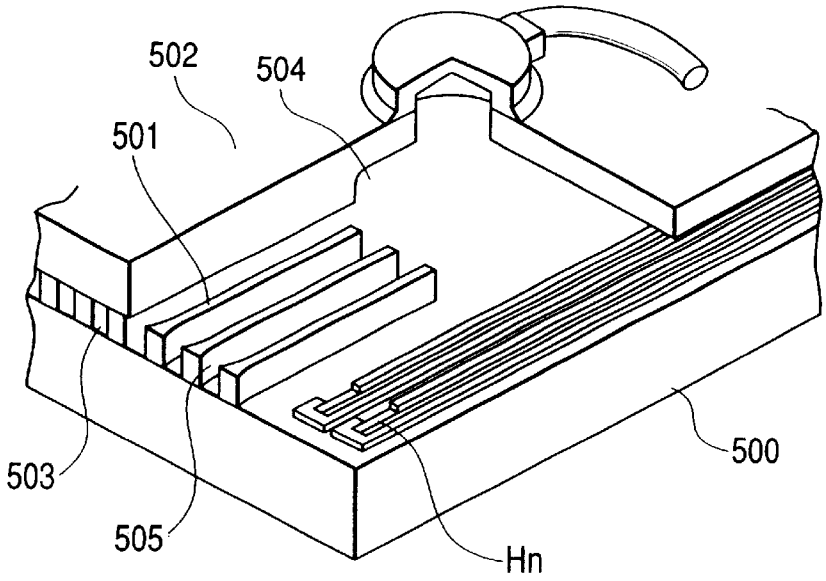
FIG. 9 is a schematic view showing the configuration of an ink jet recording head.
Figure 10:
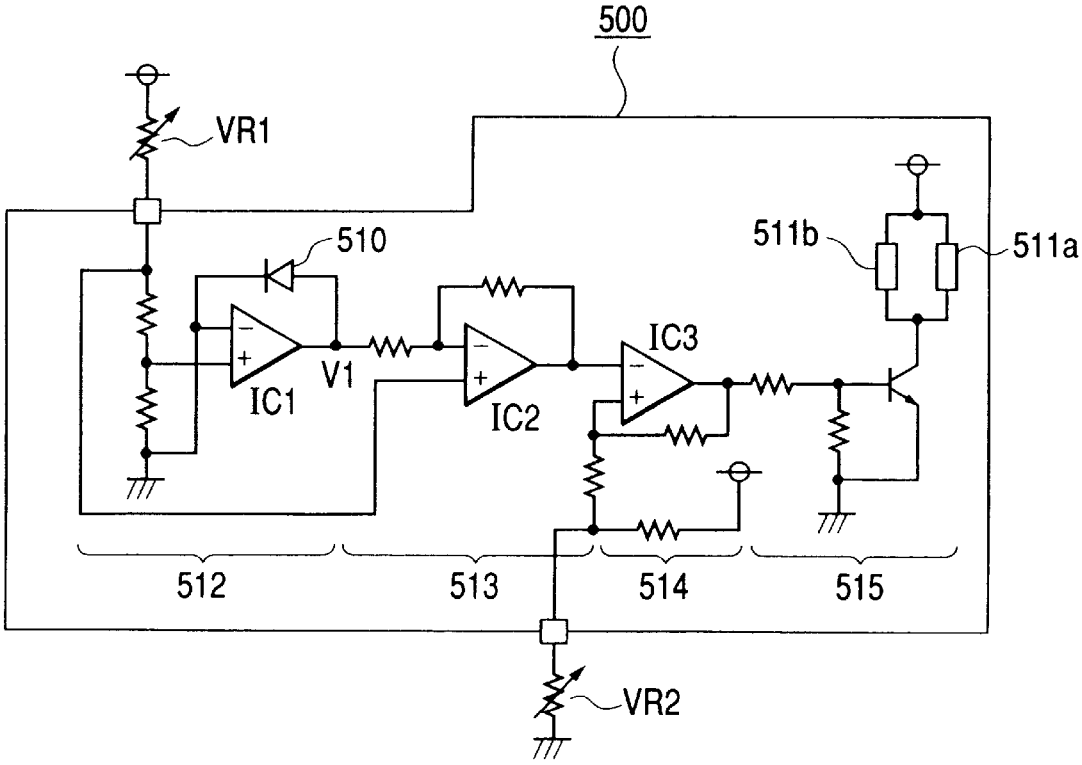
FIG. 10 is a circuit diagram showing the configuration of a temperature control circuit formed on a head substrate of the ink jet recording head shown in FIG. 9.

FIGS. 6A and 6B to 8A and 8B are schematic views of variations of the circuit configuration in the element substrate and the top plate of the liquid discharge head of the present embodiment, wherein FIGS. 6A, 7A and 8A are plan views of the element substrate while FIGS. 6B, 7B and 8B are plan view of the top plate. As in FIGS. 6A and 7B, the views A and B show the mutually opposed faces of the element substrate and the top plate, and a broken-lined portion in each view B indicates the position of the liquid chamber and the liquid paths when the top plate is adjoined to the element substrate. The amplifier for the output of the temperature sensor is not illustrated in these views, but is assumed to be provided on the top plate in each example. In the following description, any configuration obtained by combining the examples shown in FIGS. 6A and 6B to 8A and 8B is also naturally included in the present invention, unless otherwise stated. Also in the following description, components of an equivalent function are represented by a same number.

Referring to FIG. 6A, an element substrate 401 is provided with plural heat generating members 402 arranged in parallel manner respectively corresponding to the liquid paths, a sub heater 455 provided in the common liquid chamber, drivers 411 for driving the heat generating members 402 according to the image data, and an image data transfer portion 412 for transferring the entered image data to the drivers 411. In addition, the element substrate 401 is provided with liquid path walls 401*a* for forming the nozzles and a liquid chamber frame 401*b* for forming the common liquid chamber.

Referring to FIG. 6B, a top plate 43 is provided with a temperature sensor 413 for measuring the temperature in the common liquid chamber, a sensor drive portion 417 for driving the temperature sensor 413, a limiting circuit 459 for limiting or interrupting the drive of the heat generating members 402 according to the outputs of the temperature sensors, and a heat generating member control portion 416 for controlling the drive condition of the heat generating members 402 according to the signals from the sensor drive portion 417 and the limiting circuit 459, and is further provided with a supply aperture 403*a* communicating with the common liquid chamber for liquid supply thereto from the exterior.

Also in the mutually opposed portions on the adjoining faces of the element substrate 401 and the top plate 403, there are provided connecting contact pads 414, 418 for electrically connecting the circuits formed on the element substrate 401 with those formed on the top plate 403. The element substrate 401 is further provided with external contact pads 415 serving as input terminals for the external electrical signals. The element substrate 401 is larger than the top plate 403, and the external contact pads 415 are provided in a portion to protrude of the element substrate 401 when it is adjoined with the top plate 403. These circuits are formed by a semiconductor wafer process. When the element substrate 401 and the top plate 403 are adjoined with mutual alignment, the heat generating members 402 are positioned respectively corresponding to the liquid paths and the circuits formed on the element substrate 401 and the top plate 403 are electrically connected through the connecting contact pads 414, 418.

Between the element substrate (first substrate) 401 and the top plate (second substrate) 403, a space of several ten microns is filled with ink. Therefore, under heating with the sub heater 455, the heat conduction to the second substrate varies according to the presence or absence of ink. Therefore, the presence or absence of ink in the liquid chamber can be detected by detecting the heat conduction with a temperature 413 composed for example of a diode sensor utilizing a PN junction. Thus, according to the result of detection by the temperature sensor 413, for example in case the temperature sensor 413 detects an abnormal temperature in comparison with the case of presence of the ink, the limiting circuit 459 limits or interrupts the drive of the heat generating members 402 or outputs a warning signal to the main body of the apparatus, thereby preventing physical damage in the head and providing a head capable of constantly exhibiting stable discharge ability.

Particularly in the present invention, since the temperature sensor and the limiting circuit mentioned above can be formed by a semiconductor wafer process, these components can be provided in an optimum position and the function for preventing the damage of the head can be added without any increase in the cost of the head.

FIGS. 7A and 7B show a variation of the embodiment shown in FIGS. 6A and 6B, different in that the discharge heaters or the heat generating members 402 are utilized instead of the sub heater. In the variation shown in FIGS. 7A and 7B, the temperature sensor 413 is provided in an area of the top plate 403 opposed to the heat generating members 402, and detects the presence or absence of ink by detecting the temperature when the heat generating members 402 are activated with a short pulse or a low voltage not inducing the bubble generation. In addition to the detection of presence or absence of ink, it is also possible to execute monitoring of the temperature and feedback to the driving condition in the course of the liquid discharge operation. The present variation is particularly effective in case it is difficult to position the sub heater in the common liquid chamber. In this variation, the heat generating member control portion 416 limits or interrupts the head drive according to the output of the temperature sensor 413.

A variation shown in FIGS. 8A and 8B is different from that shown in FIGS. 7A and 7B in that the temperature sensor 413 is so provided as form plural groups corresponding to different heat generating members 402 (in FIG. 8B the temperature sensors 413*a*, 413*b*, 413*c*, . . . correspond to the respective nozzles). Since the heat generating members 402 can be selectively driven, such plural temperature sensors allow more detailed detection of ink state, such as the presence or absence of ink in finer portions.

Also such temperature sensors respectively corresponding to the heat generating members 402 allow to detect the temperature change at the liquid discharge in each nozzle, thereby detecting the presence or absence of ink or the bubble generating state in each nozzle through the temperature. The partial discharge failure resulting from the absence of ink in each nozzle may be detected by providing a memory for storing the temperature change under the heating with the heat generating member between the presence and absence of the ink as head information in the manufacturing process of the head and providing the heat generating member control portion 416 with such head information, thereby effecting comparison with the data corresponding to the normal discharge state stored in such memory, or by comparison of the data with those of the adjacent plural nozzles (for example the nozzle 413*b* is judged abnormal if an abnormal output is obtained from the nozzle 413*b* among the data from the nozzles 413*a*, 413*b*, 413*c*, . . . ). The presence or absence of ink can be more precisely detected through such comparison of the sensor output with the value stored in the memory.

In the above-described configuration, the temperature sensors 413*a*, 413*b*, 413*c* etc. are not electrically connected with the heat generating members 402, so that such sensors may be provided on the top plate without the drawback of complication of the electrical wirings. Also the plural sensor may be provided without an increase in the cost, since they can be prepared by a semiconductor wafer process.

The foregoing embodiment and variations are applicable not only to the liquid discharge head shown in FIG. 2 but also to various liquid discharge heads utilizing thermal energy.

[Second Embodiment]

This embodiment provides a liquid discharge head and a producing method therefor capable, in adjoining the element substrate and the top plate so as to electrically connect the functional elements and the electrical circuits thereof, of easy alignment of the element substrate and the top plate and of improving the production yield.

More specifically, in the present embodiment, there is provided a liquid discharge head in which plural elements or electrical circuits of different functions for controlling the drive condition of the energy converting elements are dividedly formed on a first substrate and a second substrate according to the functions, wherein plural protruding electrical connecting portions are formed on either of the first and second substrates while plural recessed electrical connecting portions, for respectively engaging with and for being electrically connected with the protruding electrical connecting portions, are formed the other of the first and second substrates, whereby, in the adjoining of the first and second substrates, the mutual engagement of the protruding and recessed electrical connecting portions enable the positional alignment of a certain level. Also in case a lateral wall constituting the recessed electrical connecting portion is composed of a silicon-containing hard lateral wall, there is executed eutectic bonding involving the melting of metals constituting the protruding and recessed electrical connecting portions to improve the positional precision between the first and second substrates by means of such hard lateral wall. Furthermore, the presence of such protruding and recessed electrical connecting portions in the first and second substrates and the adjoining thereof by the eutectic bonding of such connecting portions enable bonding of the wafers in case the first and second substrates are composed of wafers, thereby improving the production yield in the manufacture of the liquid discharge head. As a result, the manufacturing cost of the liquid discharge head can be reduced. According to the present embodiment, there is thus provided a liquid discharge head comprising plural discharge apertures for discharging liquid, first and second substrates to be mutually adjoined to constitute plural paths communicating respectively with the discharge apertures, plural energy converting elements provided in the liquid paths for converting electrical energy into energy for discharging liquid present in the liquid paths, and plural elements or electrical circuits of different functions for controlling the drive condition of the energy converting elements, such plural elements or electrical circuits being dividedly provided on the first and second substrates are respectively provided with electrical connecting portions for mutually connecting electrically the elements or the electrical circuits of the first and second substrates and the electrical connecting portion of the first substrate is adjoined to that of the second substrate by eutectic bonding.

In the above-described configuration, the first and second substrates are respectively provided with electrical connecting portions for mutually and electrically connecting the elements or electrical circuits of the substrates and the electrical connecting portions of the first and second substrates are mutually connected by eutectic bonding, whereby the first and second substrates can be adjoined by such eutectic bonding. Thus, in case the first and second substrates are composed of wafers, such wafer can be bonded to improve the yield in the manufacture of the liquid discharge head. As a result, there can be reduced the manufacturing cost of the liquid discharge head. In such case, the first and second substrates are provided with engaging portions for mutual engagement, different from the aforementioned electrical connecting portions.

According to the present embodiment, there is also provided a method for producing a liquid discharge head including plural discharge apertures for discharging liquid; first and second substrates which are to be mutually adjoined to form plural liquid paths respectively communicating with the discharge apertures; plural energy conversion elements respectively provided in the liquid paths, for converting electrical energy into energy for discharging the liquid in the liquid paths; and plural elements or electrical circuits of different functions for controlling the drive condition of the energy conversion elements, the elements or electrical circuits being dividedly provided on the first and second substrates according to the functions, the method comprising:

a step of forming plural protruding electrical connecting portions, on either of the first and second substrates, for mutually and electrically connecting the elements or electrical circuits of the first and second substrates;

a step of forming plural recessed electrical connecting portions, on the other of the first and second substrates, for respectively engaging with the protruding electrical connecting portions and being electrically connected therewith; and a step of engaging the plural protruding electrical connecting portions with the respectively corresponding plural recessed electrical connecting portions at the adjoining of the first and second substrate.

In the above-mentioned step of adjoining the first and second substrates, the protruding electrical connecting portion and the recessed electrical connecting portion are adjoined by eutectic bonding.

It is also preferred that the lateral of the recessed electrical connecting portion is composed of a part of the liquid path forming member for constituting the liquid paths and that the step of forming the recessed electrical connecting portion is composed of a step, in forming the liquid paths by eliminating portions of the liquid path forming member corresponding to the liquid paths, of eliminating a predetermined portion of the liquid path forming member together with the portions corresponding to the liquid paths thereby forming the recessed shape of the recessed electrical connecting portion.

In the above-mentioned method of the present invention for producing a liquid discharge head in which plural elements or electrical circuits of different functions for controlling the drive condition of the energy converting elements are dividedly formed on a first substrate and a second substrate according to the functions, plural protruding electrical connecting portions are formed on either of the first and second substrates while plural recessed electrical connecting portions, for respectively engaging with and for being electrically connected with the protruding electrical connecting portions, are formed the other of the first and second substrates, whereby, at the adjoining of the first and second substrates, the protruding plural electrical connecting portions are made to respectively engage with the plural recessed electrical connecting portions to enable the positional alignment of a certain level. Also in case a lateral wall constituting the recessed electrical connecting portion is composed for example of a silicon-containing hard lateral wall, there is executed eutectic bonding involving the melting of metals constituting the protruding and recessed electrical connecting portions to improve the positional precision between the first and second substrates by means of such hard lateral wall. Furthermore, the presence of such protruding and recessed electrical connecting portions in the first and second substrates and the adjoining thereof by the eutectic bonding of such connecting portions enable bonding of the wafers in case the first and second substrates are composed of wafers, thereby improving the production yield in the manufacture of the liquid discharge head. As a result, the manufacturing cost of the liquid discharge head can be reduced.

According to the present embodiment, there is also provided a method for producing a liquid discharge head including plural discharge apertures for discharging liquid; first and second substrates which are to be mutually adjoined to form plural liquid paths respectively communicating with the discharge apertures; plural energy conversion elements respectively provided in the liquid paths, for converting electrical energy into energy for discharging the liquid in the liquid paths; and plural elements or electrical circuits of different functions for controlling the drive condition of the energy conversion elements, the elements or electrical circuits being dividedly provided on the first and second substrates according to the functions, the method comprising:

- a step of preparing a first silicon wafer including plural first substrates, each provided with a first electrical connecting portion for mutually and electrically connecting the elements or electrical circuits of the first and second substrates;
- a step of preparing a second silicon wafer including plural second substrates, each provided with a second electrical connecting portion for mutually and electrically connecting the elements or electrical circuits of the first and second substrates;
- an impingement step of impinging the first silicon wafer on the second silicon wafer in such a manner that the first electrical connecting portion is opposed to the second electrical connecting portion corresponding to the first electrical connecting portion;
- an adjoining step of adjoining the first electrical connecting portion with the second electrical connecting portion corresponding to the first electrical connecting portion by eutectic bonding; and
- a cutting step of integrally cutting the adjoined first and second silicon wafers after the adjoining step.

In the above-described configuration, in cutting the integrally adjoined first and second silicon wafers, plural liquid discharge heads (head chips) can be produced with a high yield since the first and second silicon wafers do not peel or displace by the eutectic bonding of the first and second electrical connecting portions. In such producing method, the productivity is further improved since the number of aligning operations can be significantly reduced in comparison with a case where the first and second substrates are aligned in each head.

In the above-mentioned producing method for the liquid discharge head, it is preferred that each of the first and second electrical connecting portion electrical connecting portions is provided in plural units and that either of the first and second electrical connecting portions is formed in a protruding shape while the other is formed in a recessed shape to be electrically connected with the protruding electrical connecting portion.

In the following the present embodiment will be explained in detail with reference to the attached drawings.

FIGS. 11A to 11D are views showing steps of adjoining the top plate 3 to the element substrate 1 bearing the movable members 6 and the liquid path walls 9 thereon. FIGS. 11A to 11D are cross-sectional view of the element substrate 1 and the top plate 3 along the liquid paths.

Now there will be explained the steps of adjoining the top plate 3 to the element substrate 1 bearing the movable members 6 and the liquid path walls 9 thereon, with reference to FIGS. 11A to 11D.

Figure 11A:
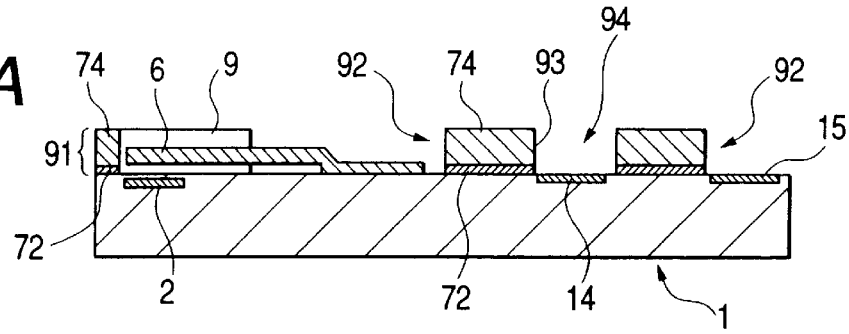
FIGS. 11A, 11B, 11C and 11D are views showing steps of adjoining the top plate to the element substrate, bearing movable members and liquid path walls thereon, in the second embodiment of the present invention.
Figure 11B:
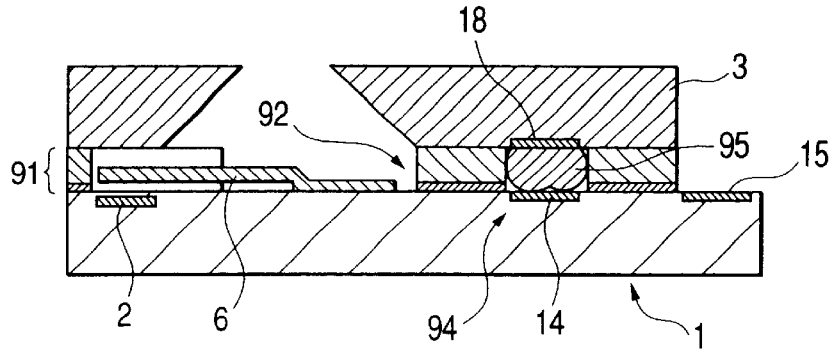
Figure 11C:
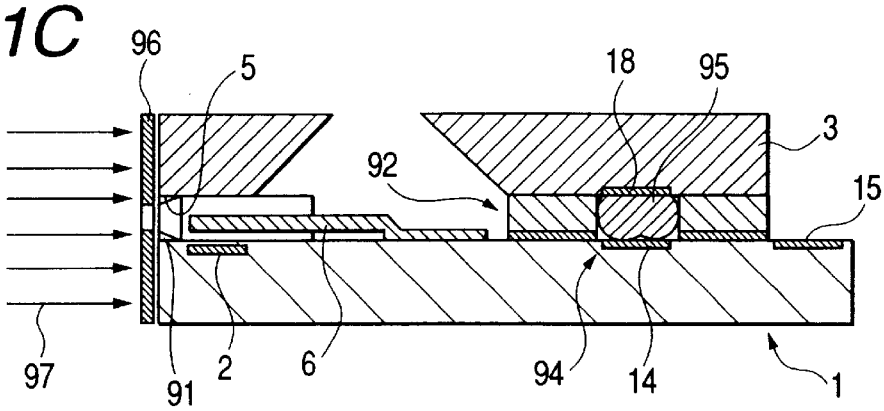
Figure 11D:
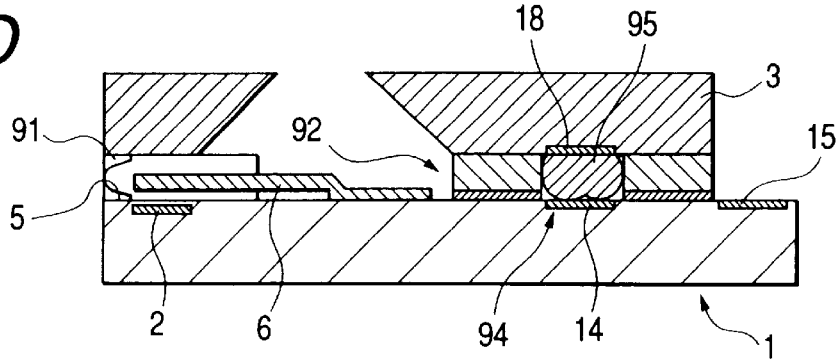

As shown in FIG. 11A, at the free end side of the movable member 6 on a face of the element substrate 1, bearing the heat generating members 2, namely at a front end portion on the element substrate 1, there is formed an orifice plate portion 91 composed of SiN films 72, 74 remaining on the element substrate 1. Also around the connecting contact pad 14 on a face of the element substrate 1, bearing the heat generating members 2, there is formed a lateral wall portion 92 composed of SiN films 72, 74 remaining on the element substrate 1. As shown in FIG. 11B, the aforementioned etching step partially eliminates the SiN films 72, 74 so as to form the orifice plate portion 91 and the lateral wall portion 92 on the element substrate 1, in addition to the liquid path walls 9. In this operation, a portion of the SiN films 72, 74 corresponding to the connecting contact pad 14 is eliminated to form a recess 93 on the element substrate 1, and a recessed electrode portion 94, having the recess 93, is composed of a lateral wall portion 92 constituting the recess 93, a connecting contact pad 14 at the bottom of the recess 93, and an Au metal film on the connecting contact pad 14. Such recessed electrode 94 constitutes a first electrical connecting portion provided on the element substrate 1 which is the first substrate.

On the other hand, a top plate 3 provided with the connecting contact pad 18 etc. is separately prepared in advance as explained in the foregoing, and, prior to the adjoining of the top plate 3 with the element substrate 1, a gold metal bump 95 is formed as a protruding electrical connecting portion on the connecting contact pad 18 as shown in FIG. 11B. Such gold bump 95 constitutes a second electrical connecting portion provided on the top plate 3 which is the second substrate.

Then, as shown in FIG. 11B, after formation of the gold bump 95 constituting the protruding electrical connecting portion on the connecting contact pad 18, a face of the top plate bearing the gold bump 95 is made to be opposed to a face of the element substrate bearing the recessed electrode portion 94, and the gold bump 95 is made to enter into the recess 93 of the recessed electrode portion 94 thereby engaging the recessed electrode portion 94 with the gold bump 95. Then the gold bump 95 and the Au film on the connecting contact pad 18 are fused to execute eutectic bonding therebetween. The use of a same metal in the gold bump 95 and the Au film on the connecting contact pad 18 allows to reduce the temperature and pressure required in bonding, and to increase the strength of adjoining.

Figure 12:
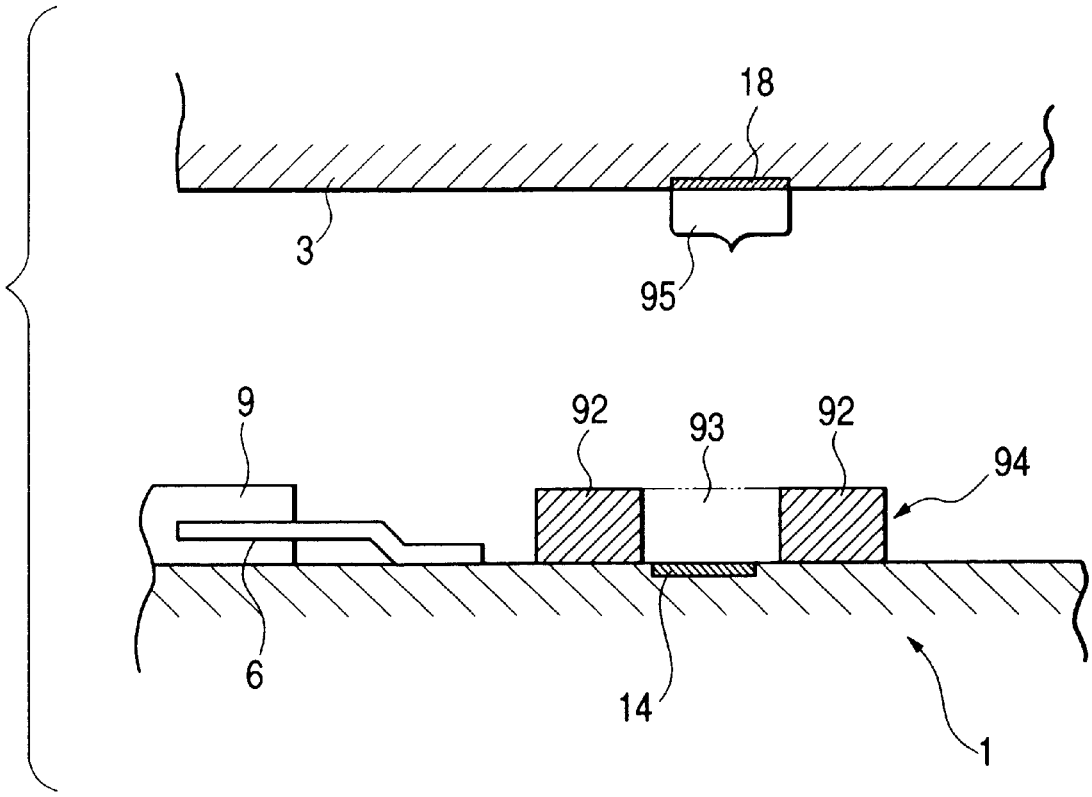
FIG. 12 is a view showing the positional relationship between a gold bump and a recessed electrode portion.

Now there will be explained the engaging relationship of the gold bump 95 and the recessed electrode portion 94 with reference to FIG. 12, showing a state prior to the adjoining thereof. The volume V1 of the gold bump 95 and the volume V2 of the recess 93 of the recessed electrode portion 94 in a state prior to the adjoining, as shown in FIG. 12, are so selected as to satisfy a relation:

$$V1 \leq V2.$$

The volume V2 of the recess 93 is thus made larger than the volume V1 of the gold bump 95 in order to prevent formation of a gap between the upper face of the lateral wall portion 92 and the top plate 3 when the gold bump 95 is fused and adjoined to the recessed electrode portion 94. Such selection of the volumes of the gold bump 95 and the recess 93 may vary the density of the wirings, but, since the connecting contact pads 14, 18 are used only for the signal transmission or reception, such density of the wirings does not affect the signal transmission or reception.

As already explained with reference to FIG. 4, the top plate 3 is provided with a sensor drive portion 17 for driving the sensors 13 provided on the element substrate 1 and a heat generating member control portion 16 for controlling the drive condition of the heat generating members 2, based on the output from the sensors driven by the sensor drive portion 17. Consequently the signal transmission from the sensor drive portion 17 of the top plate 3 to the sensors 13 of the element substrate 1 and the signal exchange between the heat generating member control portion 16 of the top plate 3 and the functional elements or electrical circuits of the element substrate 1 are executed through the gold bump 95 and the recessed electrode portion 94.

Then, as shown in FIG. 1C, the front end side of the orifice plate portion 91, opposite to the side of the movable member 6, is irradiated with an excimer laser light 97 through a mask 96, whereby plural discharge apertures 5 are formed in the orifice plate portion 91. Thus the liquid discharge head is obtained as shown in FIG. 1D.

In the above-described producing method, plural elements or electrical circuits of different functions for controlling the drive condition of the energy converting elements 2 are dividedly formed on the element substrate 1 and the top plate 3 according to the functions, wherein the gold bump 95 is formed as the protruding electrical connecting portion on the top plate 3 while the recessed electrode portion 94 for engaging with and for being electrically connected with the gold bump 95 is formed on the element substrate 1. Thus, in the adjoining of the element substrate 1 and the top plate 3, the mutual engagement of the gold bump 95 and the recessed electrode portion 94 enables the positional alignment of a certain level. Also the lateral wall portion 92 constituting the recessed electrode portion 94 is composed of a silicon-containing hard lateral wall, there is executed eutectic bonding involving the melting of metals in the gold bump 95 and the recessed electrode portion 94 to improve the positions precision between the element substrate 1 and the top plate 3 by means of such hard lateral wall.

Furthermore, the presence of such recessed electrode portion 94 and gold bump 95 respectively on the element substrate 1 and the top plate 3 and the adjoining thereof by the eutectic bonding of such gold bump 95 and recessed electrode portion 94 enable adjoining of the element substrate 1 and the top plate 3, namely adjoining of the wafers, thereby improving the production yield in the manufacture of the liquid discharge head. As a result, the manufacturing cost of the liquid discharge head can be reduced.

Thus, also in case of adjoining the element substrate 1 bearing the movable member 6 and the top plate bearing the liquid path walls thereon, there are for example formed a gold bump as the protruding electrical connecting portion on the connecting contact pad 14 of the element substrate 1 and a lateral wall portion around the connecting contact pad 18 of the top plate 3 to constitute a recessed electrical connecting portion similar to the aforementioned recessed electrode portion 94. In this case, an Au film is formed in advance on the connecting contact pad 18 of the top plate 3. Then, after the gold bump on the element substrate is made to enter into and to engage with the recess of the recessed electrical connecting portion of the top plate 3, the gold bump and the Au film on the connecting contact pad 18 are fused to execute eutectic bonding therebetween.

Also in this case, therefore, the mutual engagement of the gold bump of the element substrate 1 and the recessed electrical connecting portion of the top plate 3, in the adhesion thereof, enables the positional alignment of a certain level. Also in case a lateral wall constituting the recessed electrical connecting portion provided on the top plate 3 is composed of a silicon-containing hard lateral wall, there is executed eutectic bonding involving the melting of metals constituting the protruding and recessed electrical connecting portions to improve the positional precision between the element substrate 1 and the top plate 3 by means of such hard lateral wall.

More specifically, in the liquid discharge head of the present embodiment, plural elements or electrical circuits of different functions for controlling the drive condition of the energy converting elements 2 are dividedly formed on the element substrate 1 and the top plate 3 according to the functions, and a gold bump is formed as the protruding electrical connecting portion on either of the element substrate 1 and the top plate 3 while a recessed electrical connecting portion for engaging with and for being electrically connected with the gold bump is formed on the other. Thus, in the adjoining of the element substrate 1 and the top plate 3, the mutual engagement of the gold bump and the recessed electrical connecting portion enables the positional alignment of a certain level between the element substrate 1 and the top plate 3. Also in case a lateral wall constituting the recessed electrical connecting portion is composed of a silicon-containing hard lateral wall, there is executed eutectic bonding involving the melting of metals constituting the protruding and recessed electrical connecting portions to improve the positional precision between the element substrate 1 and the top plate 3 by means of such hard lateral wall.

In the foregoing embodiment, the metal bump (consisting of gold, copper, platinum, tungsten, aluminum or ruthenium or an alloy thereof) constituting the protruding electrical connecting portion enables connection with the recessed electrical connecting portion even if the bumps are not completely uniform in shape or volume.

The configuration of the protruding and recessed electrical connecting portions is not limited to the above-described one in which the protruding electrical connecting portion alone is deformed at the adjoining. For example, the electrical connecting portion of the present invention also includes a configuration in which conductive sheets are individually applied to the recesses, formed in advance on the first substrate (element substrate 1) corresponding to the protruding electrical connecting portions of the second substrate (top plate 3), whereby the recesses are flat prior to the adjoining of the protruding electrical connecting portions and become recessed after the adjoining, since such configuration allows alignment of the element substrate 1 and the top plate 3 at a certain level. Any configuration satisfying such condition is included in the electrical connecting portion of the present invention, for example a configuration in which both the protruding and recessed electrical connecting portions deform at the adjoining.

Furthermore, the presence of such protruding and recessed electrical connecting portions in the element substrate 1 and the top plate 3 and the adjoining thereof by the eutectic bonding of such connecting portions enable bonding of the wafers in case the element substrate 1 and the top plate 3 are composed of wafers, thereby improving the production yield in the manufacture of the liquid discharge head. As a result, the manufacturing cost of the liquid discharge head can be reduced.

Figure 13A:
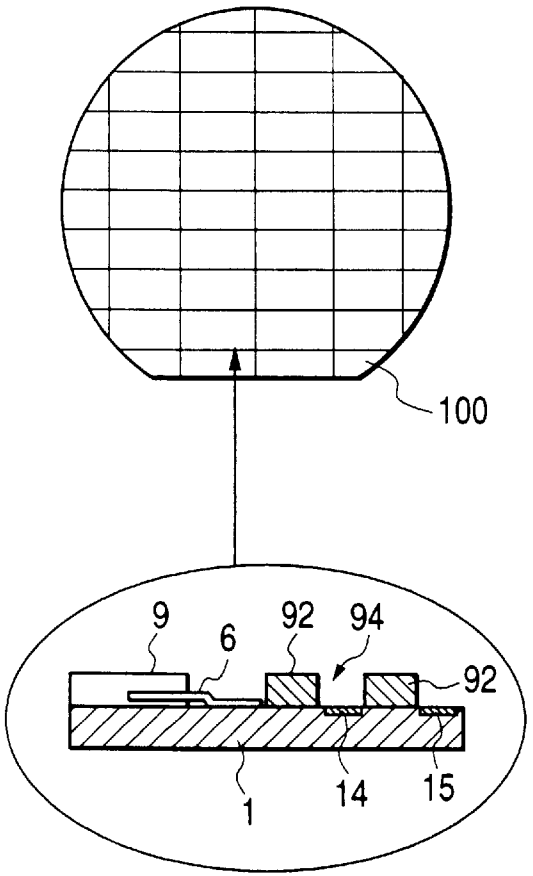
FIGS. 13A, 13B and 13C are views showing an example of the method for producing the liquid discharge head of the second embodiment of the present invention.
Figure 13B:
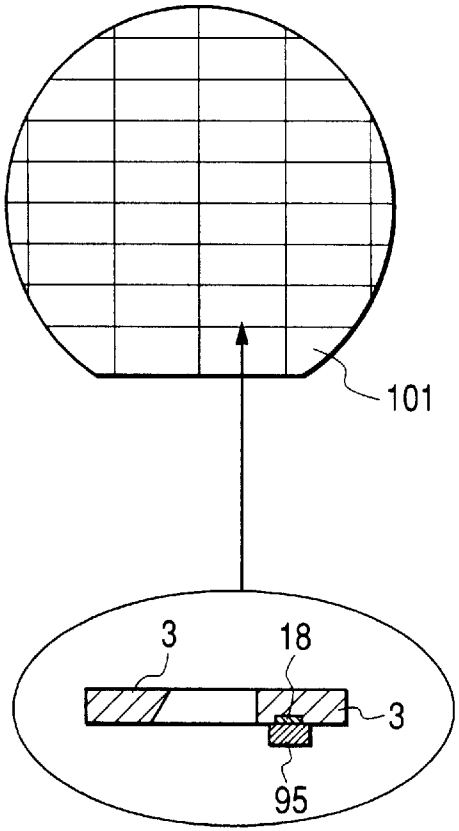
Figure 13C:
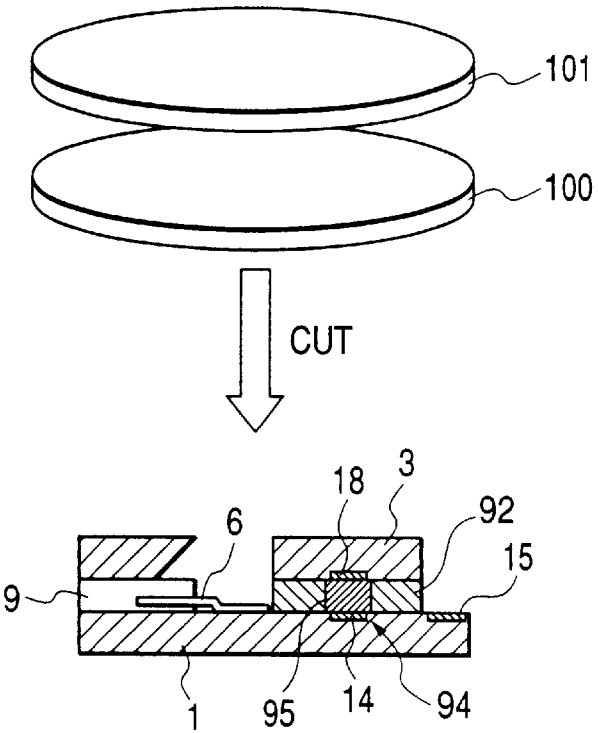

In the following there will be given a supplementary explanation on the above-described effect, with reference to FIGS. 13A to 13C, showing an example of the method for producing the liquid discharge head of the present invention. As explained in the foregoing embodiment, the element substrate 1 and the top plate 3 are formed collectively in plural units corresponding to the number of heads, respectively on a first silicon wafer 100 and a second silicon wafer 101, as shown in FIGS. 13A and 13B. On each element substrate 1 there are formed the movable member 6, liquid path walls 9 and recessed electrode portion 94, and, on each top plate 3 there is formed the gold bump 95 constituting the protruding electrical connecting portion. It is therefore rendered possible, after aligning the first silicon wafer 100 and the second silicon wafer 101 by the gold bump 95 and the recessed electrode portion 94 as shown in FIG. 13C, to adjoin the gold bump 95 and the recessed electrode portion 94 by eutectic bonding. Thus, after the first silicon wafer 100 is made to impinge on the second silicon wafer 101 in such a manner that the recessed electrode portion 94 is opposed to the gold bump 95 corresponding to such recessed electrode portion 94, there are adjoined the recessed electrode portion 94 and the gold bump 95 corresponding thereto by eutectic bonding. By cutting the integrally adjoined first and second silicon wafers 100, 101, plural liquid discharge heads (head chips) can be produced with a high yield since the first and second silicon wafers do not peel or displace by the eutectic bonding of the element substrate 1 and the top plate 3. In such producing method, the productivity is further improved since the number of aligning operations can be significantly reduced in comparison with a case where the element substrate 1 and the top plate 3 are aligned in each head.

The above-described effect can be achieved in a configuration in which the first silicon wafer 100 and the second silicon wafer 101 are aligned by the combination of the protruding and recessed shapes, but more preferably in a configuration in which the electrical connecting portions provided on the element substrate 1 and the top plate 3 are mutually adjoined by the eutectic bonding. In case of adjoining by eutectic bonding, the electrical connecting portions need not necessarily be the combination of protruding and recessed shapes but the first silicon wafer 100 and the second silicon wafer 101 may be provided with means enabling mutual alignment such as mutually engaging protruding and recessed portions provided separately from the electrical connecting portions or another aligning method to enable the alignment at the adjoining.

[Third Embodiment]

In the aforementioned adjoining method for the element substrate and the top plate, the optimum top plate adjoining is difficult to achieve constantly because the top plate may fluctuate in shape, depending on the material and manufacturing process of the top plate. Also in recent years, it is being required to further improve the adjoining accuracy of the top plate and the element substrate, in order to realize arrangement of the discharge aperture at a higher density and high-quality image by stable liquid discharge.

It is often difficult to achieve an accuracy meeting to the above-described requirements by a mechanical impingement method or a mechanical fitting method, such as crushing a protruding portion. Also in a method utilizing image processing, the top plate is moved for adjoining after the position thereof is confirmed by image processing, so that the adjoined state of the element substrate and the top plate cannot be directly observed and there cannot be the influence of eventual aberration at the adjoining step.

Also for confirming whether the adjoining is satisfactory after the adjoining is made, there is conceived a method of extracting samples and inspecting such samples by breaking, but such method is not practical as it is cumbersome and involves losses. Therefore the only possible method is to confirm the ink discharge after the ink jet recording head is assembled to the final form, and such method inevitably involves waste of the components.

Also since the adjoined state cannot be confirmed immediately, the defective products may be produced in continuation even in case of an aberration in the pitch, so that such defective products may be forwarded to the final confirming stage by actual printing.

Such loss in the yield of top plate adjoining or generation of the defective products results in an increase in the manufacturing cost.

In consideration of the foregoing, the present embodiment executes adjoining of the top plate according to the fluctuation in the shape of the top plate or the element substrate, thereby suppressing the preparation of the defective products and allowing to obtain the information on the adjoining state immediately after the adjoining of the top plate.

In the following the present embodiment will be explained in detail, with reference to the attached drawings.

At first there will be explained an example of the process for forming the circuits etc. on the element substrate 1 and the top plate 3 in the present embodiment.

The element substrate 1 is obtained by forming circuits constituting the driver, image data transfer portion and sensors by a semiconductor wafer process on a silicon substrate, then forming the heat generating members 2 as explained in the foregoing and finally forming the connecting contact pads 14 and the external contact pads 15 (cf. FIGS. 11A to 11D).

The top plate 3 is obtained by forming circuits constituting the aforementioned heat generating member control portion and sensor drive portion by a semiconductor wafer process on a silicon substrate, then forming grooves and a supply aperture constituting the liquid paths and common liquid chamber by a film forming technology and etching as explained in the foregoing, and finally forming the connecting contact pads 18.

The forming method of an adjoining state sensor is variable depending on the kind thereof, so that the formation thereof is to be included in one of the foregoing steps.

The adjoining state sensor can be of any type as long as it is capable of sensing the adjoining state of the element substrate 1 and the top plate 3, but, it can be more specifically composed of a distance sensor provided on both the element substrate 1 and the top plate 3 for sensing the mutual distance therebetween, or a pressure sensor provided on either of the element substrate 1 and the top plate 3 for directly sensing the adjoined state, as will be explained later in more details.

When the element substrate 1 and the top plate 3 of the above-described configuration are adjoined with mutual alignment, the heat generating members 2 are positioned respectively corresponding to the liquid paths and the circuits formed on the element substrate 1 and the top plate 3 are electrically connected through the connecting pads 14, 18. The electrical connection can be achieved, for example, by placing a gold bump on each of the connecting pad 14, 18, but there may also be adopted other methods. Thus the element substrate 1 and the top plate 3 can be electrically connected through the connecting contact pads 14, 18, so that the aforementioned circuits can be electrically connected simultaneously with the adjoining of the element substrate 1 and the top plate 3. The adjoining state sensor is to sense such adjoined state.

In the foregoing there has been explained the basic configuration of the present embodiment. In the following there will be explained specific examples of the aforementioned circuits.

<Kind and Function of Adjoining State Sensor, Forming Method Therefor>

In the following there will be explained the adjoining state sensor, which can be a distance sensor provided on both the element substrate 1 and the top plate 3 for sensing the mutual positions, or a pressure sensor provided on either of the element substrate 1 and the top plate 3 for directly sensing the adjoined state. The distance sensor is provided on both the element substrate 1 and the top plate 3 for sensing the mutual position, and the condition of top plate adjoining is adjusted according to thus obtained information. The specific form of such sensor is not limited, but it is exemplified by a configuration employing a light emitting element and a photosensor element.

Figure 14:
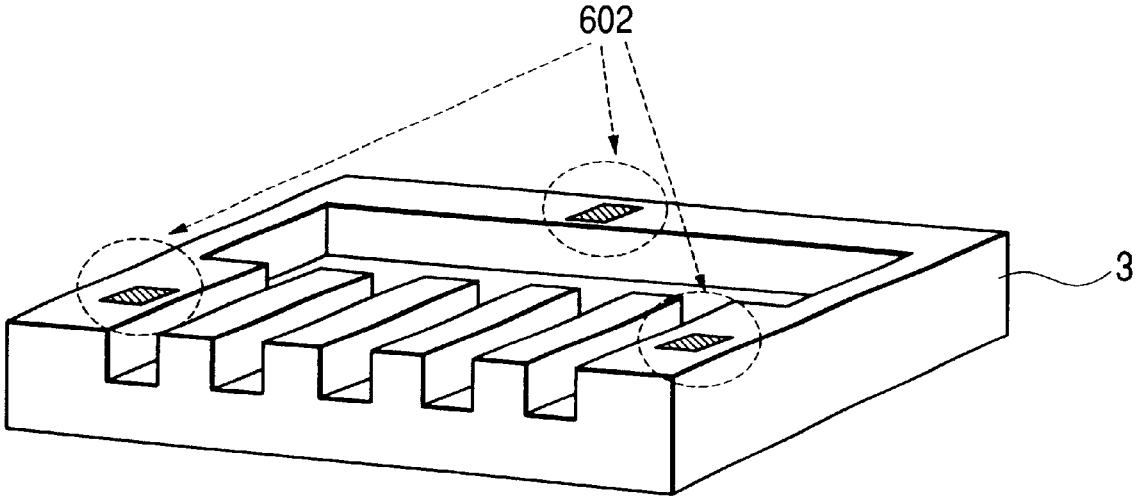
FIG. 14 is a view showing a top plate in a third embodiment of the present invention.
Figure 15:
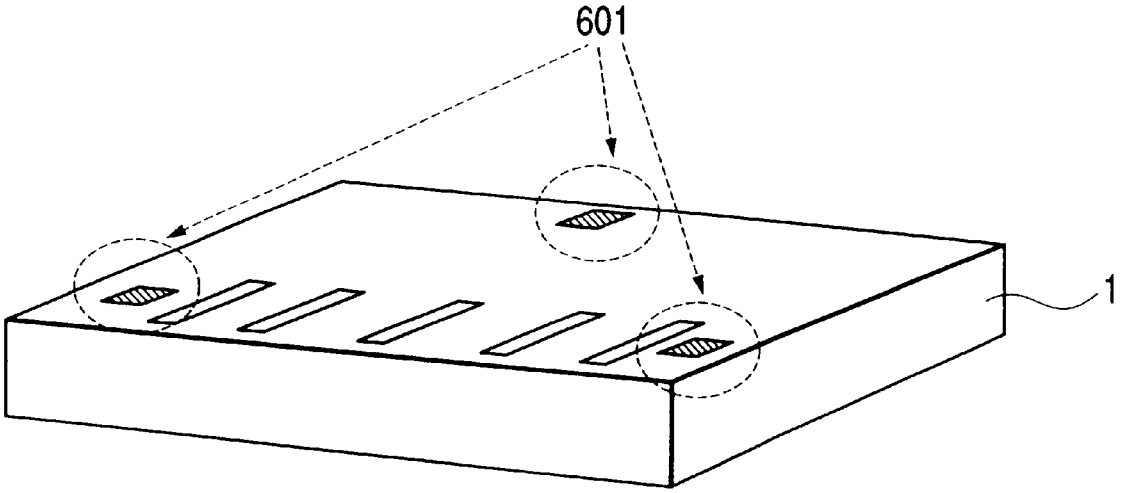
FIG. 15 is a view showing an element substrate (heater board) in the third embodiment of the present invention.
Figure 16:
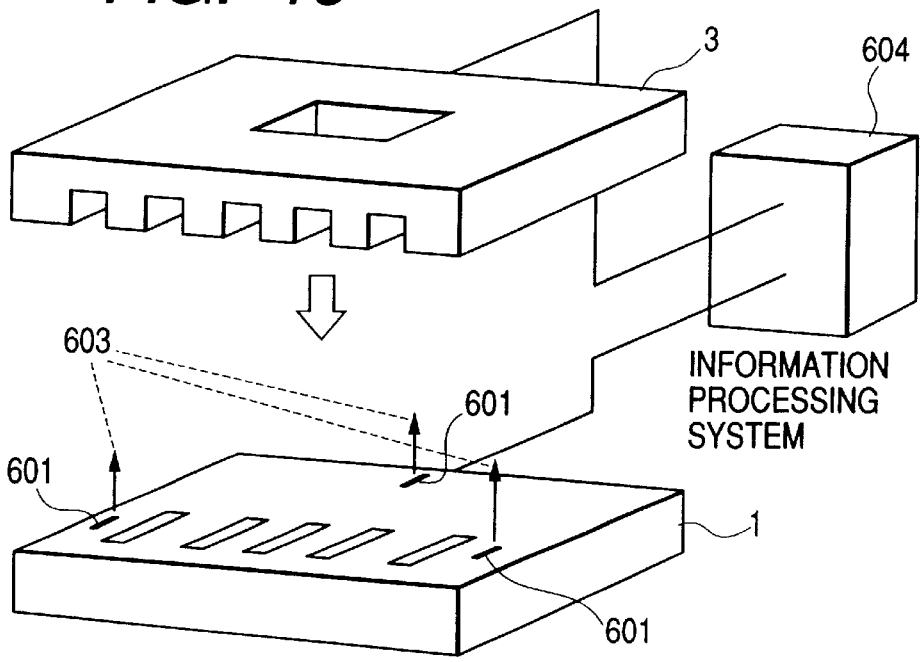
FIG. 16 is a schematic view showing a top plate adjoining step.
Figure 17:
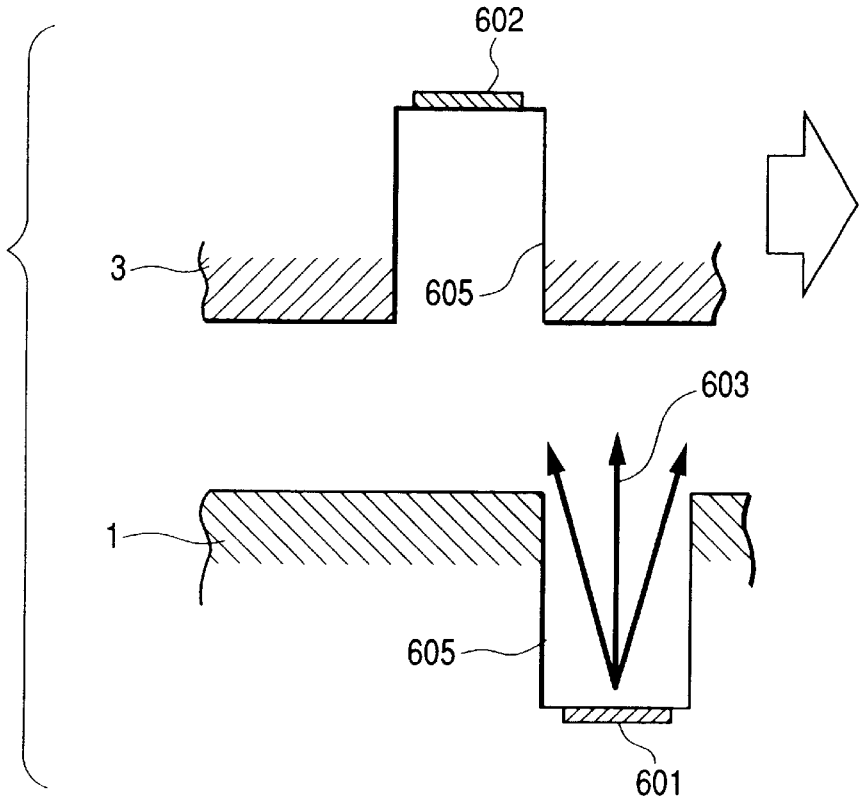
FIG. 17 is a detailed view showing the top plate and the element substrate (heater board) in the third embodiment of the present invention.

There are employed a light emitting element 601 such as an LED or a phototransistor on the element substrate 1 and a photosensor element 602 such as a photocoupler on the top plate 3. The mutual positions are detected by the intensity of the light received by the photocoupler and the position of top plate adjoining is finely adjusted (FIGS. 14, 15 and 16). The light-emitting and photosensor elements may be positioned on the bottoms of recesses 605 for improving the sensitivity (FIG. 17).

On the other hand, the pressure sensor is provided in plural units on the top plate 3 or a top plate adjoining area of the element substrate 1, thereby sensing the pressure of top plate adjoining and judging whether the adjoined state is satisfactory. Such pressure sensor may be based on a method utilizing a pressure-sensitive conductive rubber, a method utilizing a pressure-sensitive polymer film, a method for detecting random reflection of light, or a method utilizing a semiconductor pressure sensor.

(1) Method Utilizing Pressure-Sensitive Conductive Rubber

Figure 18A:
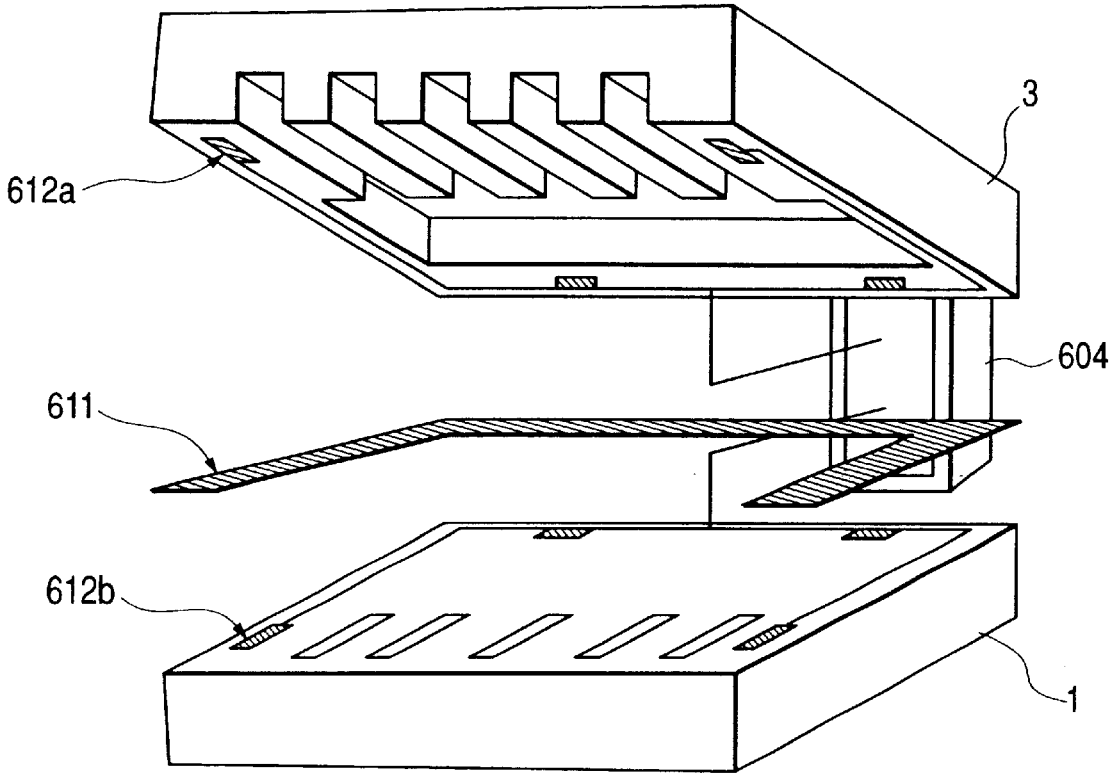
FIGS. 18A and 18B are schematic views showing the adjoining method for the top plate in an embodiment utilizing pressure-sensitive rubber.
Figure 18B:
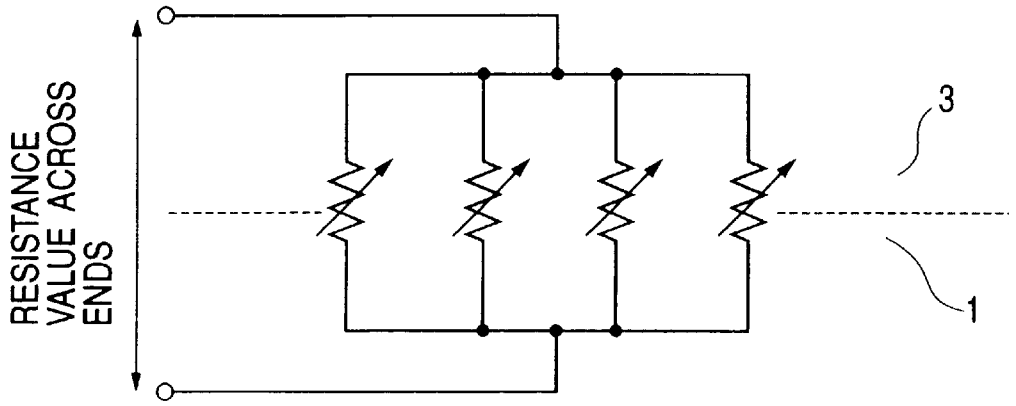

Silicon rubber containing fine metal or carbon particles therein shows a continuous change in the electrical resistance as a function of the pressure applied thereto. A contact sensor is constructed by positioning electrodes 612 on both faces of such silicon rubber (pressure-sensitive conductive rubber) 611 and measuring the resistance between the electrodes. This is based on a fact that the change in the adjoined state is reflected in the resistance between both ends. The electrodes 612*a*, 612*b* are respectively provided on the top plate and the element substrate, and the pressure-sensitive conductive rubber 611 is sandwiched therebetween (FIGS. 18A and 18B).

(2) Method Utilizing Pressure-Sensitive Polymer Film

Figure 19A:
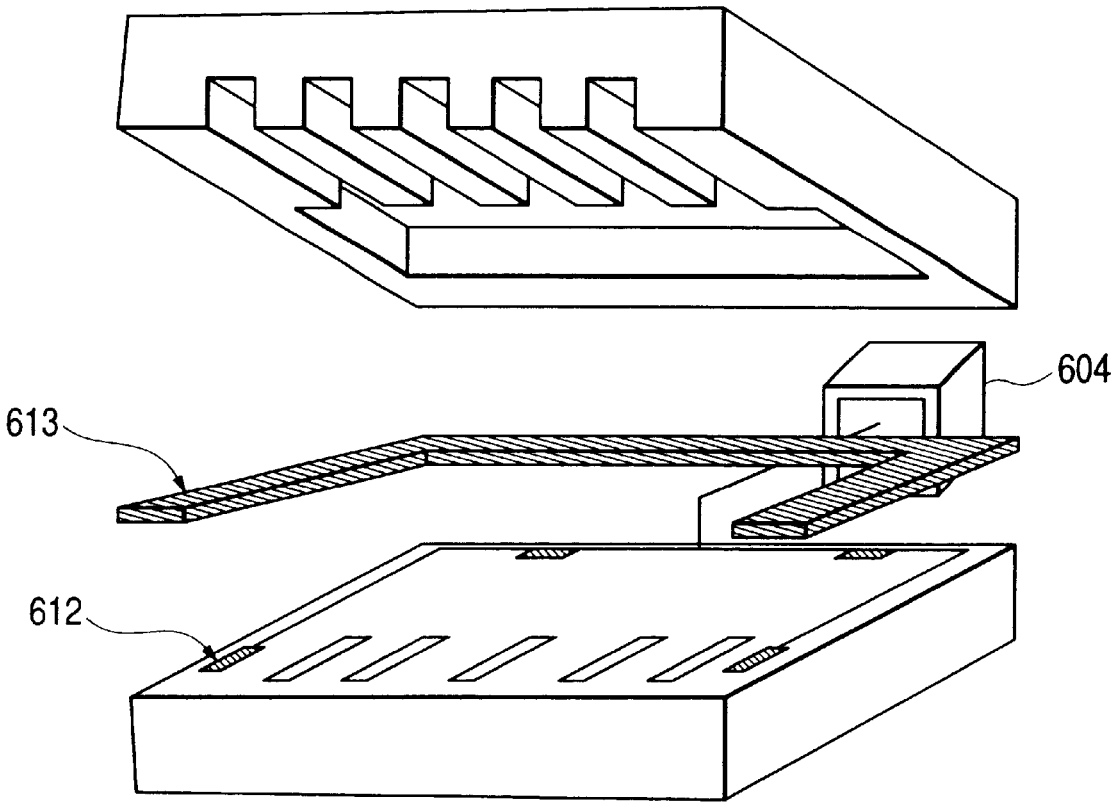
FIGS. 19A and 19B are schematic views showing the adjoining method for the top plate in an embodiment utilizing a piezoelectric polymer film.
Figure 19B:
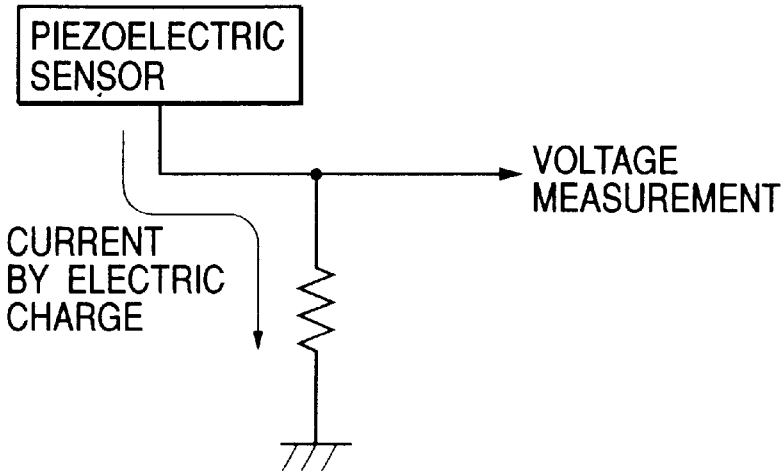

Certain polymer films, such as PVDF (polyvinylidene fluoride) or VDF/TrEE (vinylidene fluoride/trifluoroethylene copolymer), show a piezoelectric effect of generating an electric charge in response to a change in pressure, and are therefore capable of detecting the pressure distribution as in the pressure-sensitive resistance member (FIGS. 19A and 19B). The generated charge induces a current which generates a voltage in the presence of a resistor, and such generated voltage is detected.

(3) Method Utilizing Light

Figure 20:
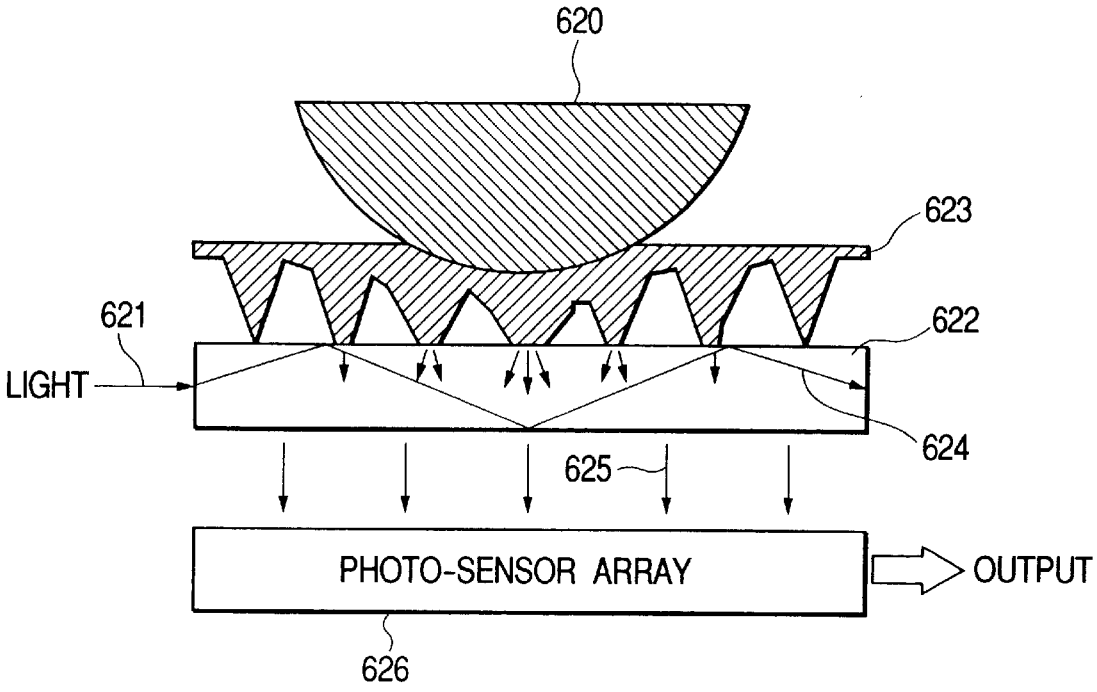
FIG. 20 is a schematic view of a pressure sensor based on the measurement of randomly reflected light.

The pressure distribution is detected by detecting a deformation of rubber with a photosensor element. A rubber sheet 623 having conical projections is placed on a transparent acrylic resin plate 622 in which the parallel incident light 621 is totally reflected therein. The internal light is randomly reflected by the deformation of the rubber, and the random reflection increases with the higher level of contact (larger contact area), so that the pressure distribution can be detected by measuring the level) of such random reflection (FIG. 20).

(4) Method Utilizing Semiconductor Pressure Sensor

Figure 21:
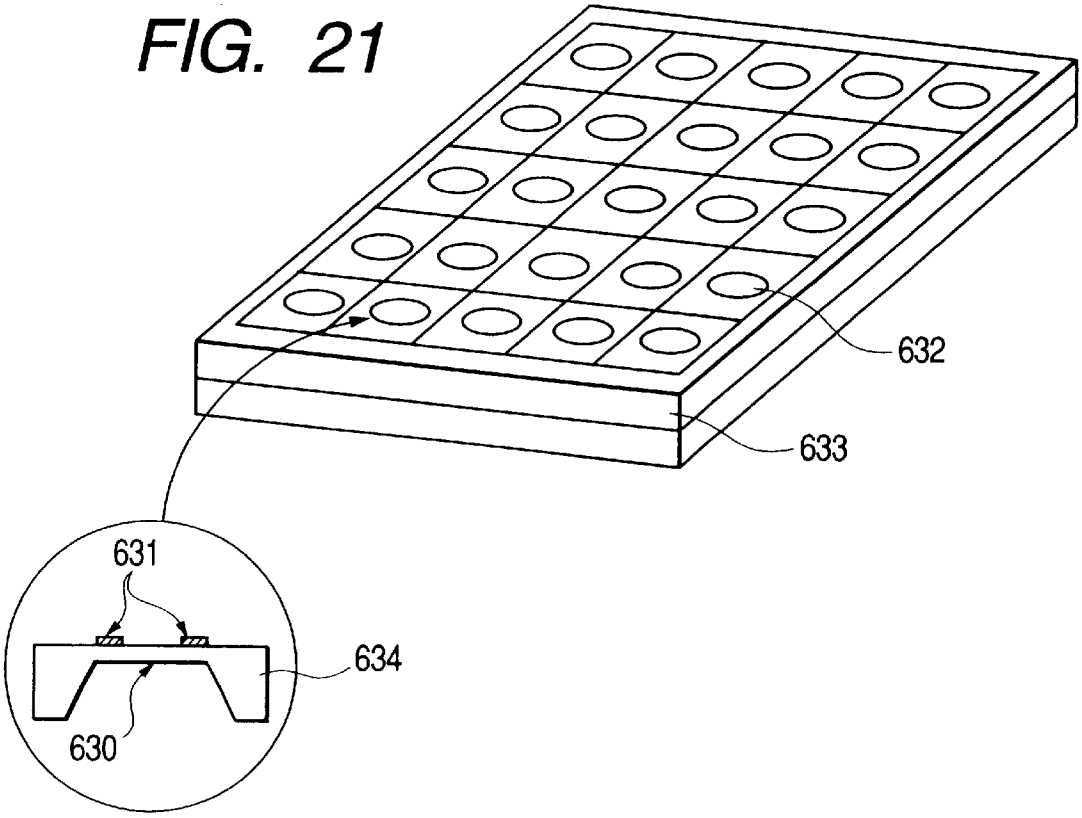
FIG. 21 is a view showing a semiconductor pressure sensor.

A silicon substrate is etched to form a diaphragm 630, on which semiconductor pressure sensors 634, each including a gauge 631 consisting of a piezo resistance element, are arranged in a two-dimensional matrix. Such method can easily realize a high density and a high sensitivity (FIG. 21).

In case of forming the ink jet recording head by adjoining first and second silicon substrates as in the present embodiment, it is rendered possible to achieve satisfactory adjoining of the top plate thereby improving the production yield, by providing the first and/or second with means for sensing the adjoining state and executing the adjoining operation under the sensing of the adjoined state. It is also possible to improve the yield in the succeeding steps since the adjoined state can be inspected in non-destructive manner immediately after the adjoining.

[Forth Embodiment]

This embodiment provides another method of adjoining under monitoring of the adjoined state of the first and second substrates.

This embodiment provides a recording head comprising first and second substrates for constituting plural liquid paths upon being mutually adjoined, the head being featured by a position sensor composed of electrodes provided in mutually opposed positions of the first and second substrates.

The above-mentioned position sensor is to detect the relative positional relationship of the first and second substrates preferably by measuring the electrostatic capacitance between the electrodes.

In the following the present embodiment will be explained in detail with reference to the attached drawings.

<Function of Position Sensor and Forming Method Therefor>

Figure 22:
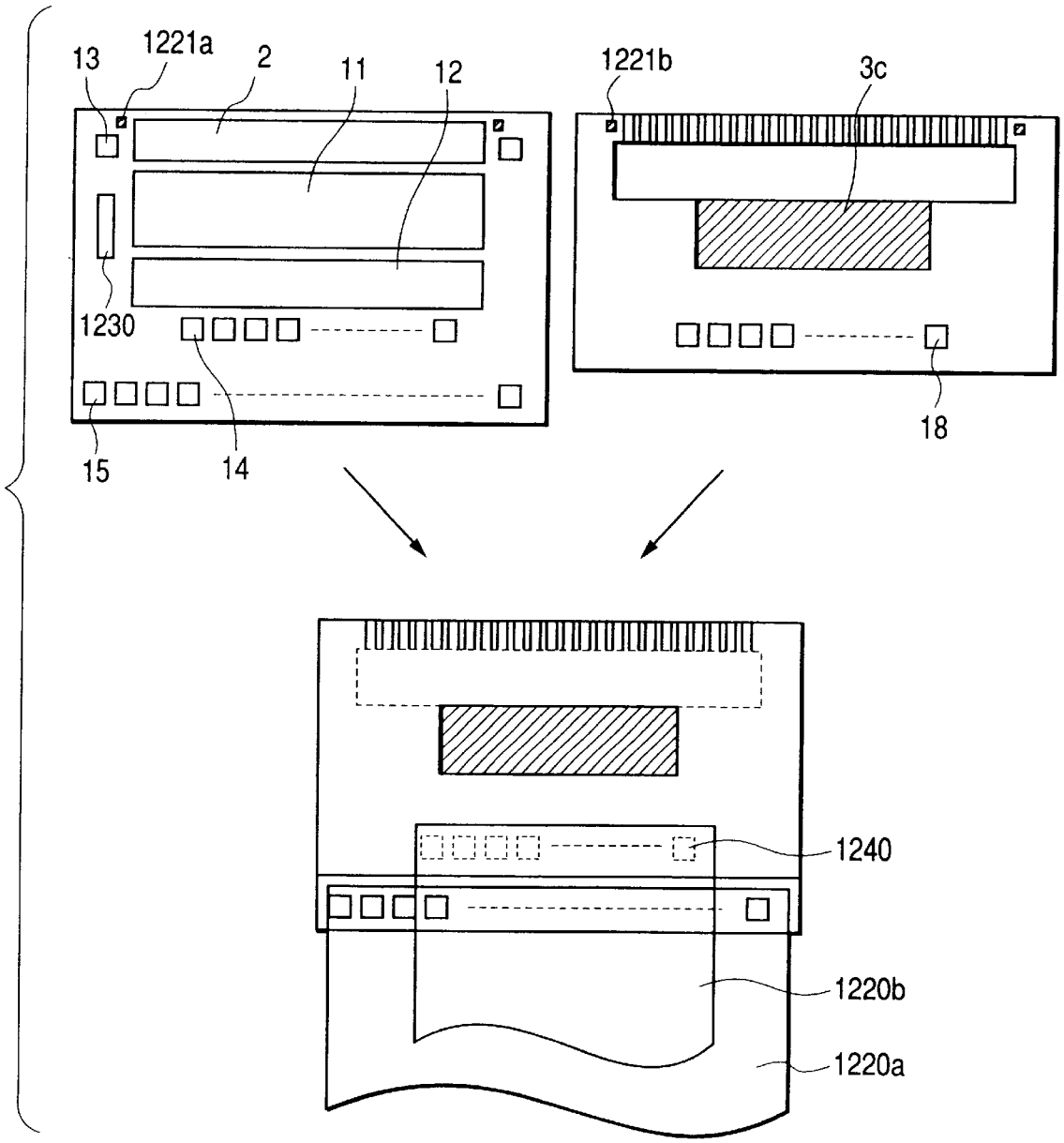
FIG. 22 is a plan view of an element substrate, a top plate and a liquid discharge head unit formed by combining the element substrate and the top plate, constituting a forth embodiment in which a TAB for extracting the electrical signals is provided in each of the element substrate and the top plate.

FIG. 22 shows the configuration of a head (element substrate 1 and top plate 3).

As shown in FIG. 22, a position sensor 1221 (*a, b*) is provided on both ends of each of the element substrate 1 and the top plate 3, and the output electrical signal is extracted by a TAB 1220 from each substrate. The element substrate 1 and the top plate 3 are adjoined under the monitoring of such output whereby the accuracy of adjoining can be significantly improved.

Figure 23:
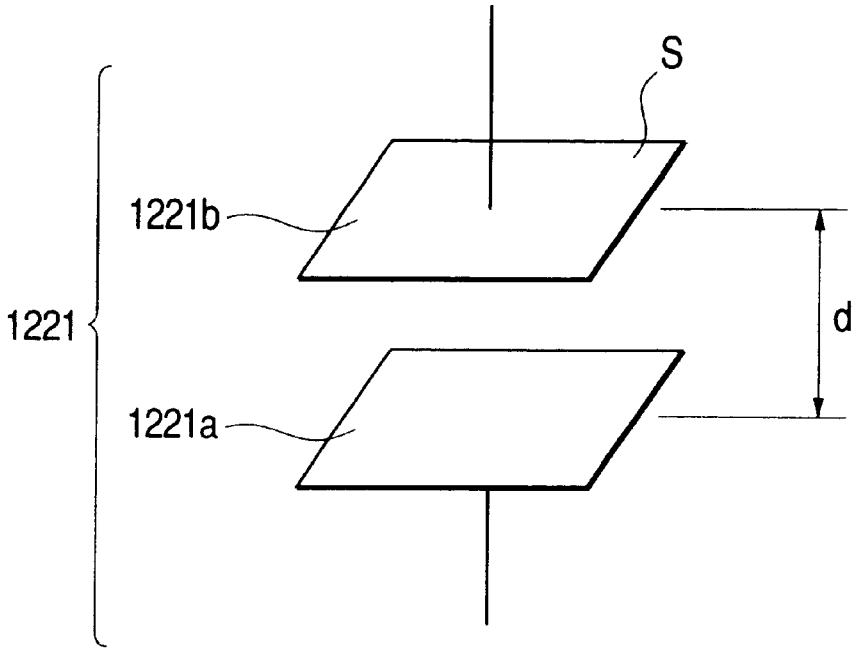
FIG. 23 is a schematic view of a position sensor (capacitor) 1221 formed by parallel electrodes.

FIG. 23 is a schematic view of the position sensor (capacitor) 1221, formed by parallel electrodes. When a potential is given between the mutually opposed two electrodes, there is accumulated, between the electrodes, a charge Q represented by:

$$Q=c*v$$

wherein C is the electrostatic capacitance between the electrodes and V is the potential therebetween.

The electrostatic capacitance C is a function of the opposed electrode area S and the opposed distance d, and can be approximated by the following equation in case the electrodes are composed of mutually parallel flat plates:

$$C=\in^{*}S/d$$

wherein ∈ is the dielectric constant of the dielectric material between the electrodes.

Therefore, for a given dielectric constant e, the electrostatic constant c is proportional to the opposed area S of the electrodes and inversely proportional to the distance d thereof.

Figure 24:
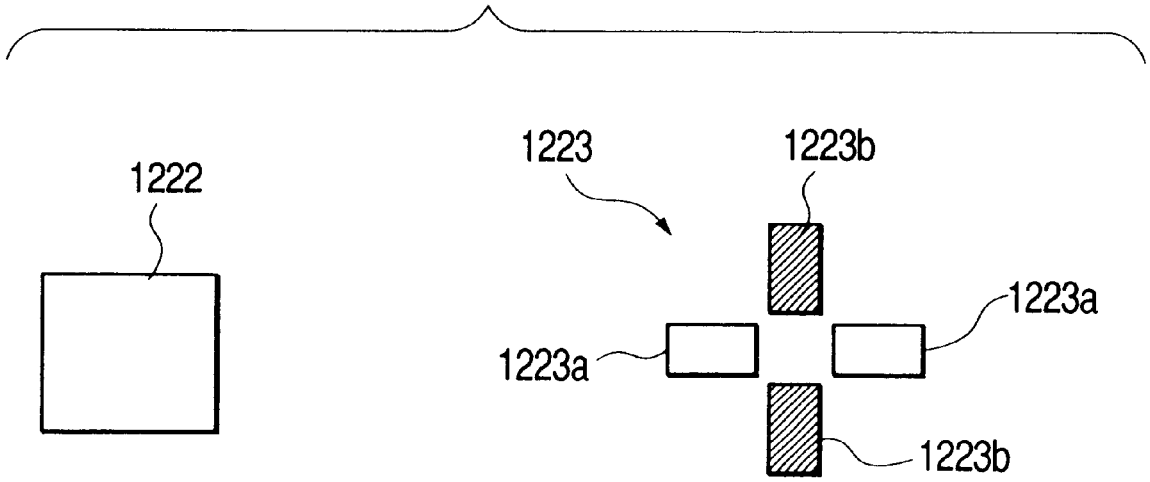
FIG. 24 is a view showing the shape of electrodes constituting the position sensor 1221.

FIG. 24 shows the shape of the electrodes constituting the position sensor 1221.

An electrode 1222 is formed on the first substrate while four electrodes 1223(*a, b*) are formed on the second substrate. The second ones are formed in two pairs, respectively constituting an X position sensor 1223*a* and a Y position sensor 1223*b* for respectively detecting the positional relationship with the first substrate electrode.

Figure 25A:
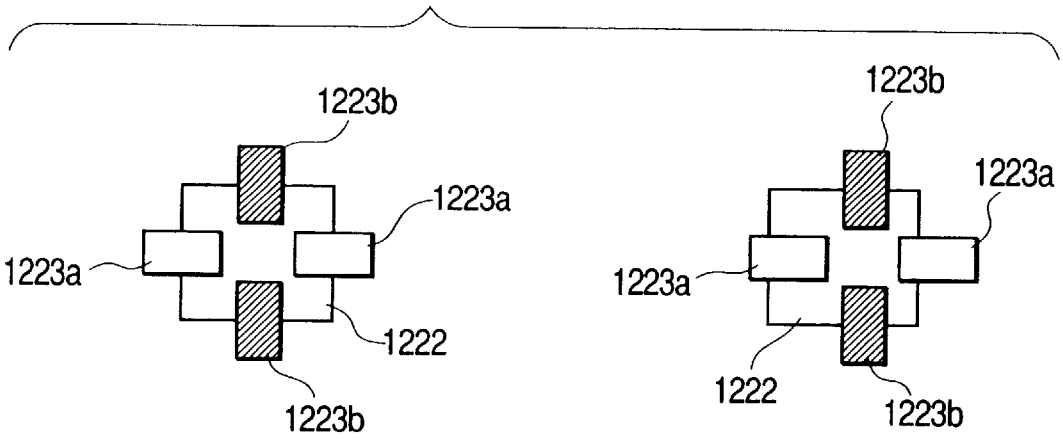
FIGS. 25A and 25B are views showing the position of the electrodes when the element substrate and the top plate are adjoined.
Figure 25B:
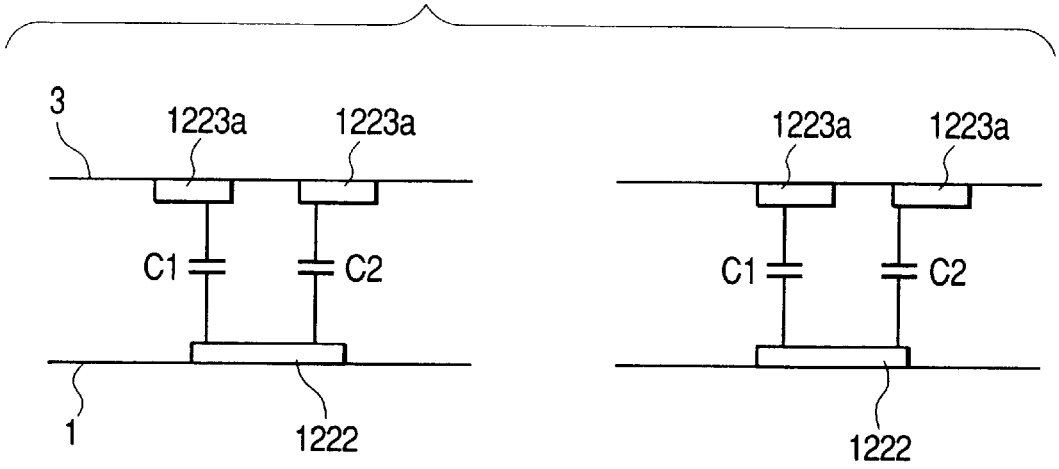

FIGS. 25A and 25B shows the positions of the electrodes when the element substrate 1 and the top plate 3 are mutually adjoined. FIG. 25B, which is a lateral view of the first and second substrates, schematically shows formation of capacitors C1 and C2.

Figure 26:
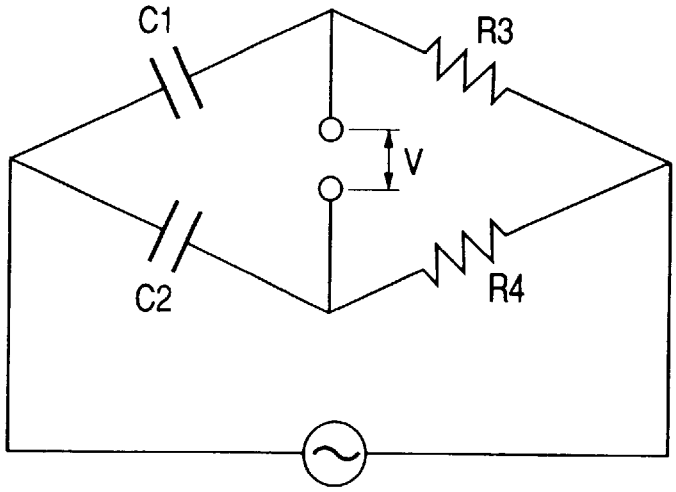
FIG. 26 is a circuit diagram showing an example of a circuit for detecting the positional relationship of the element substrate and the top plate by a capacitor.

FIG. 26 shows an example of the circuit for detecting the positional relationship of the first and second substrates based on the capacitors C1, C2. The circuit shown in FIG. 26 is a bridge circuit including capacitors, being balanced to provide a zero voltage V when:

$$R4/\omega C1=R3/\omega C2$$

wherein ω is the angular frequency.

Therefore, for given values of R3, R4 and ω, there is reached a condition C1=C2 with V=0 in the ideal adjoined state as shown in FIGS. 25A and 25B. It is therefore possible to detect the ideal adjoined state and to adjoin the substrates by moving the second substrate with respect to the fixed first substrate while monitoring the voltage V.

<Variations>

Figure 27:
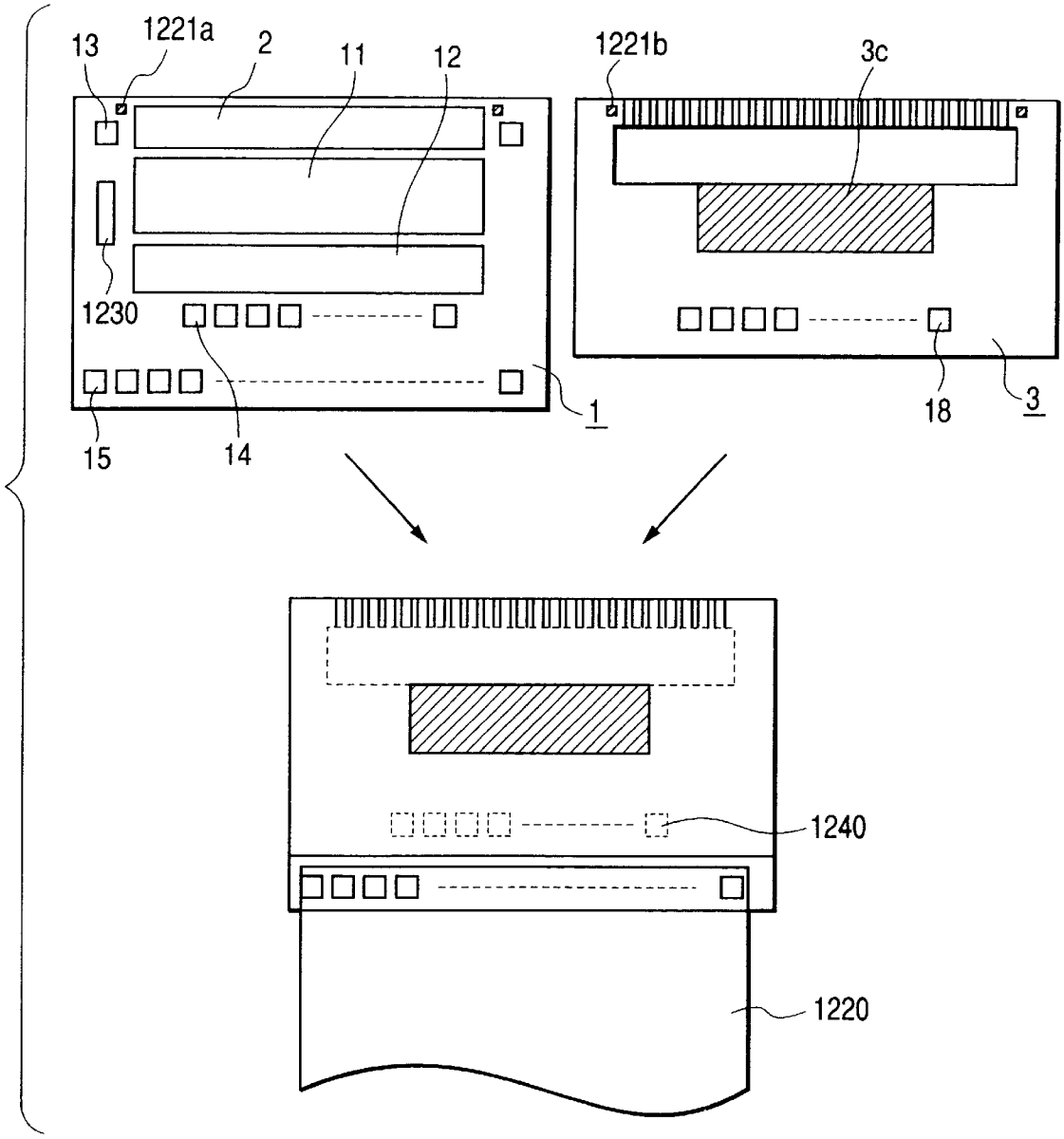
FIG. 27 is a plan view similar to FIG. 22, showing an embodiment in which a TAB for extracting electrical signals is provided only in the first substrate.

FIG. 27 shows the head configuration (element substrate 1 and top plate 3) in a variation of the present embodiment. It is different from the first embodiment in that the electrical signal is solely obtained from the first substrate, through a TAB 1220. Such configuration does not allow to adjoin the first and second substrates under monitoring of the output of the position sensor 1221, but allows to detect the adjoined state of the first and second substrates after the adjoining operation.

Thus there is not required a destructive inspection for example by sample extraction, since the quality of the head can be judged immediately after the adjoining operation. Also the defective product is not forwarded to the succeeding step. Also the adjoined state can be detected on all the heads immediately after the adjoining operation, whereby it is rendered possible to detect the defective products caused for example by an abnormality in the process and to prevent continued manufacture of such defective products.

Figure 28:
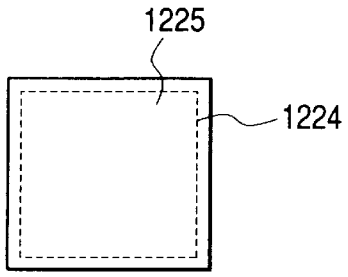
FIG. 28 is a view showing the shape of electrodes in another embodiment in which the electrodes constituting the position sensor 1221 are of approximately same dimensions.

<Shape of Electrodes: in case electrodes 1224, 1225 of first and second substrates are of an approximately same size> (FIG. 28)

In such case, the electrostatic capacitance (opposed electrode area) S of the capacitor becomes maximum in the ideal adjoined state, so that there can be detected a position of providing such maximum electrostatic capacitance.

The electrodes may be positioned on the respective nozzles and the capacitors formed for the respective nozzles are connected in parallel. In such case, the optimum position can be detected by the total sum of the capacitors for all the nozzles.

There can also be measured the height of the nozzle or valve. In the ideal adjoined state (FIG. 28), since the opposed electrode area S is known, the distance d of the electrodes can be determined by measuring C from:

$$d=\in\cdot S/C.$$

For example, the height of each nozzle can be detected by calculating:

position sensors (both ends)+height sensors (all nozzzles).

It is also possible to measure the height of the valve by forming an electrode on the valve of the first substrate.

In this manner it is rendered possible to detect the dimensional abnormality in each nozzle.

In the present embodiment, as explained in the foregoing, the first and second substrates can be adjoined under monitoring of the adjoined state thereof to significantly improve the adjoining accuracy, thereby achieving a high density arrangement of the discharge apertures or enabling a high quality image by stable liquid discharge, without sacrificing the production yield.

Also there is not required a destructive inspection for example by sample extraction, since the quality of the head can be judged immediately after the adjoining operation. Also the defective product is not forwarded to the succeeding step. Also the adjoined state can be detected on all the heads immediately after the adjoining operation, whereby it is rendered possible to detect the defective products caused for example by an abnormality in the process and to prevent continued manufacture of such defective products.

[Fifth Embodiment]

In the following there will be explained an embodiment having a voice sensor in the head.

The development of the ink jet recording apparatus is so continued as to meet the requirements of users such as improved convenience of use, relatively easy inspection and maintenance or maintenance-free configuration.

In the present embodiment, the liquid discharge head is provided with a voice sensor to execute image formation based on a voice input or to start image formation in response to a voice input. Also a sensor provided in the liquid discharge for detecting the acoustic wave at the liquid discharge allows to judge a malfunction in the head or a defective nozzle through comparison of the acoustic wave in a normal head.

The present embodiment will be explained in the following with reference to the attached drawings.

Figure 29A:
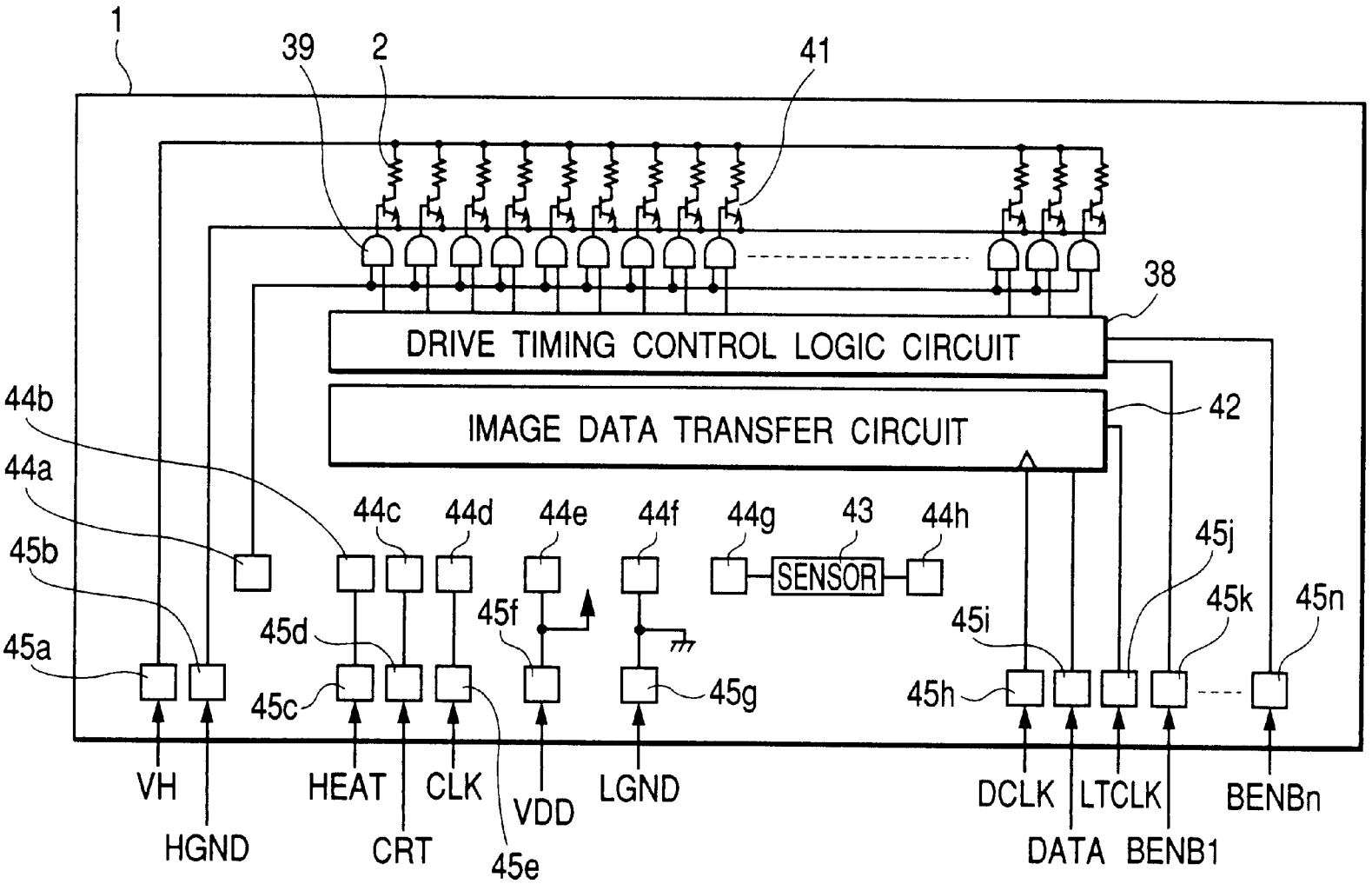
Figure 29B:
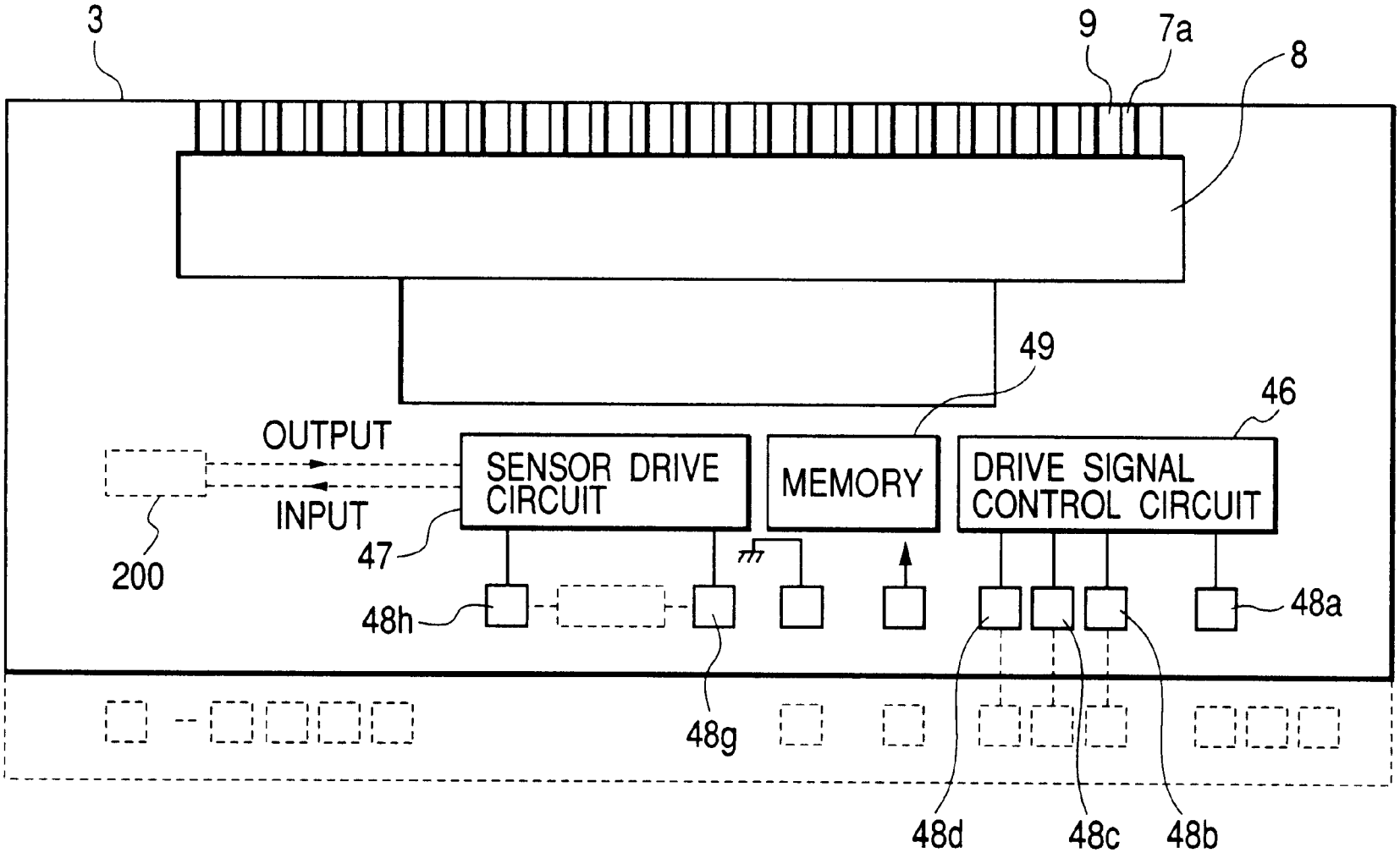

FIGS. 29A and 29B show an example of the circuit configuration of the element substrates 1, 3 for operating a voice signal, detected by a voice sensor, to control the energy applied to the heat generating members.

As shown in FIG. 29A, an element substrate 1 is provided with heat generating members 2 arranged in a linear array, power transistors 41 functioning as drivers, AND gates 39 for controlling the function of the power transistors 41, a drive timing controlling logic circuit 38 for controlling the drive timing of the power transistors 41, and an image data transfer circuit 42 constituted by a shift register and a latch circuit.

The drive timing controlling logic circuit 38 is provided for driving the heat generating members 2 in divided manner on time-shaped basis instead of simultaneous driving, in order to reduce the power supply capacity of the apparatus, and enable signals for activating the logic circuit 38 are entered from enable signal input terminals 45*k* to 45*n* constituting external contact pads.

In addition to the enable signal input terminals 45*k* to 45*n*, the external contact pads provided on the element substrate 31 includes an input terminal 45*a* for the power supply for driving the heat generating members 2, a ground terminal 45*b* for the power transistors 41, signal input terminals 45*c* to 45*e* for controlling the energy for driving the heat generating members 2, a driving power supply terminal 45*f* for the logic circuit, a ground terminal 45*g*, an input terminal 45*i* for the serial data entered into the shift register of the image data transfer circuit 42, an input terminal 45*h* for a serial clock signal synchronized with the serial data, and an input terminal 45*j* for a latch clock signal to be entered into the latch circuit.

On the other hand, as shown in FIG. 29B, an element substrate 3 constituting the top plate is provided with a sensor drive circuit 47 for driving a voice sensor 43, a drive signal control circuit 46 for monitoring the output of the voice sensor 43 and controlling the energy applied to the heat generating members 2 according to the result of such monitoring, and a memory 49 for storing codes ranked according to the output data or output value detected by the sensor 43 and the liquid discharge characteristics measured in advance for the respective heat generating member 2 (liquid discharge amount by the application of a predetermined pulse under a predetermined temperature) as head information and supplying such head information to the drive signal control circuit 46.

As contact pads for connection, the element substrate 31 and the top plate 32 are provided with terminals 44*g*, 44*h*, 48*g*, 48*h* for connecting the sensor 43 and the sensor drive circuit 47, terminals 44*b* to 44*d*, 48*b* to 48*d* for connecting the input terminals 45*c* to 45*e* for external signals for controlling the energy for driving the heat generating members 2 with the drive signal control circuit 46, and a terminal 48*a* for entering the output thereof into an input port of each of the AND gates 39.

In the example shown in FIG. 29A, the voice sensor 43 is provided on the element substrate 1, but it may also be provided on the element substrate 3 as indicated by a sensor 200 shown in FIG. 29B. In any case, the voice sensor may be provided in any position that is effective for converting the input voice into a pressure vibration and that allows efficient formation of the wirings connecting the various elements.

Figure 30:
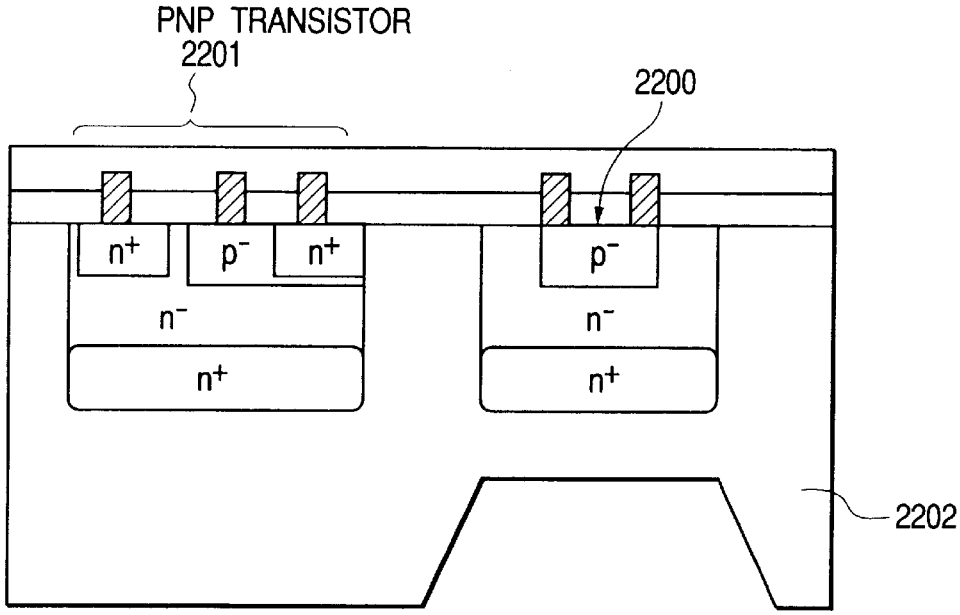
FIG. 30 is a cross-sectional view showing an example of the configuration of a sensor provided in the liquid discharge head of the present invention.

FIG. 30 schematically shows the cross section of the voice sensor in the aforementioned configuration. The sensor utilizes a silicon-based diaphragm 2202, and a piezo resistance (silicon strain gauge) 2200 is formed in a part thereof by a diffusion process while electrical circuits constituting an operational amplifier (for example PNP transistor 2201) are integrated around the sensor. Such circuits have functions of adjusting the amplification gain of the output, compensating the temperature characteristics (zero point, sensitivity) and adjusting the zero point, and there may be added a function of laser trimming of unrepresented thin-film resistors for regulating these functions.

Figure 31:
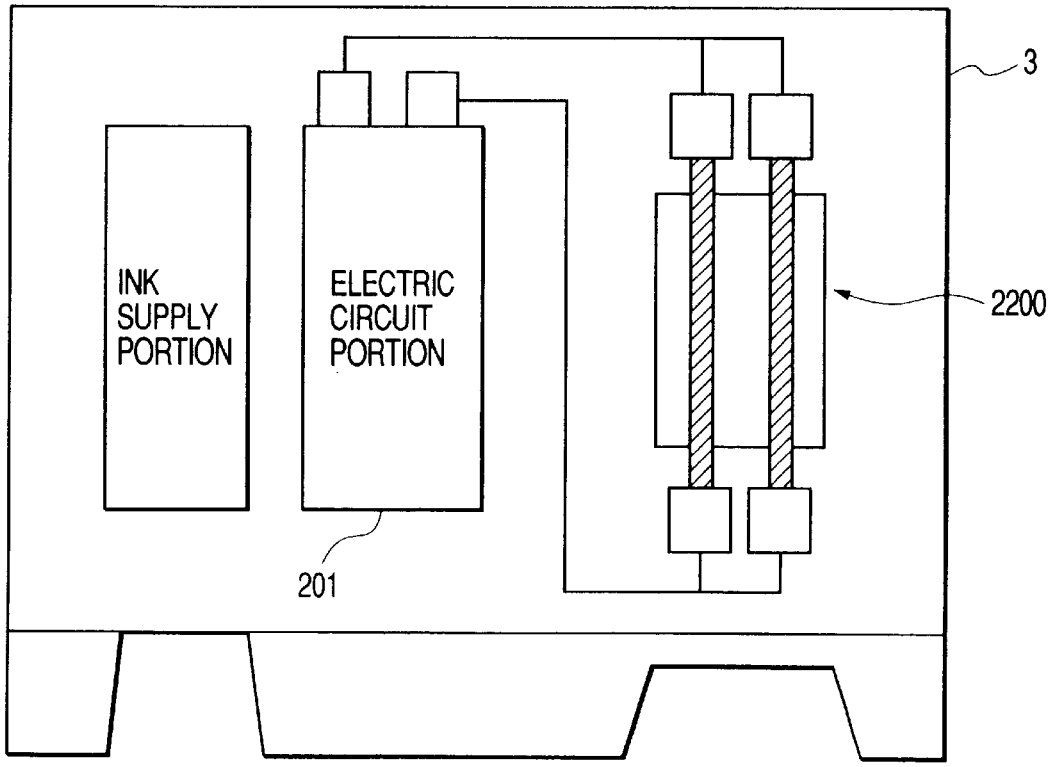
FIG. 31 is a schematic view showing the configuration in case a voice input sensor, utilizing the silicon strain gauge shown in FIG. 30, is formed in the element substrate.

FIG. 31 is a schematic view showing the configuration of the voice sensor having the silicon strain gauge 2200 in the element substrate 3. The silicon strain gauge is used to detect the vibration of the throat bone when voice is emitted. The ordinary voice recognition is executed after the entry of voice detected by a microphone, conversion of the frequency region and standardization of the length or tone of the voice. However, this voice sensor, utilizing the high piezoresistance effect of silicon, is capable of detecting the vibration of a pressure wave with a high sensitivity (with a gauge factor of silicon of about 2200). It is also possible to convert the strain caused by the pressure vibration wave and detected by the voice sensor into an electrical signal, then to process thus formed voice input signal into image data and to enter such image data into the image data transfer circuit 42 (cf. FIG. 29A) formed in the element substrate 1. Also such voice input signal may be used as a trigger signal for starting the recording operation of the liquid discharge recording apparatus to be explained later.

Figure 32:
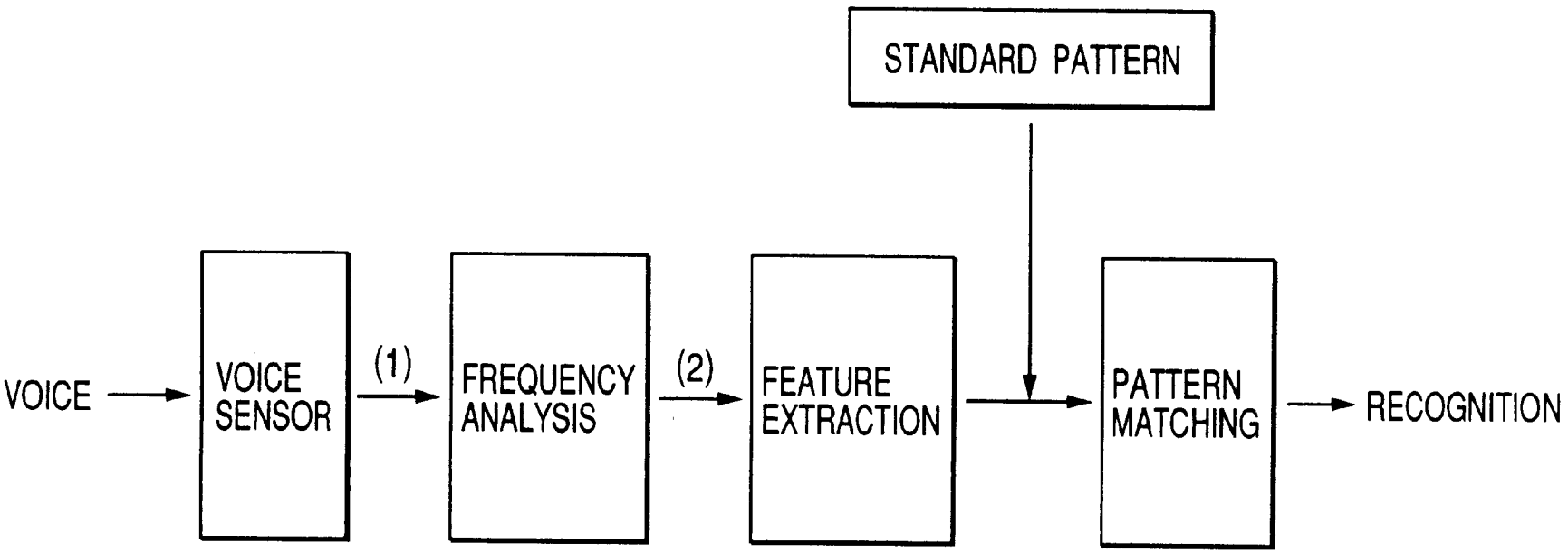
FIG. 32 is a flow chart showing the flow of voice recognition.
Figure 33:
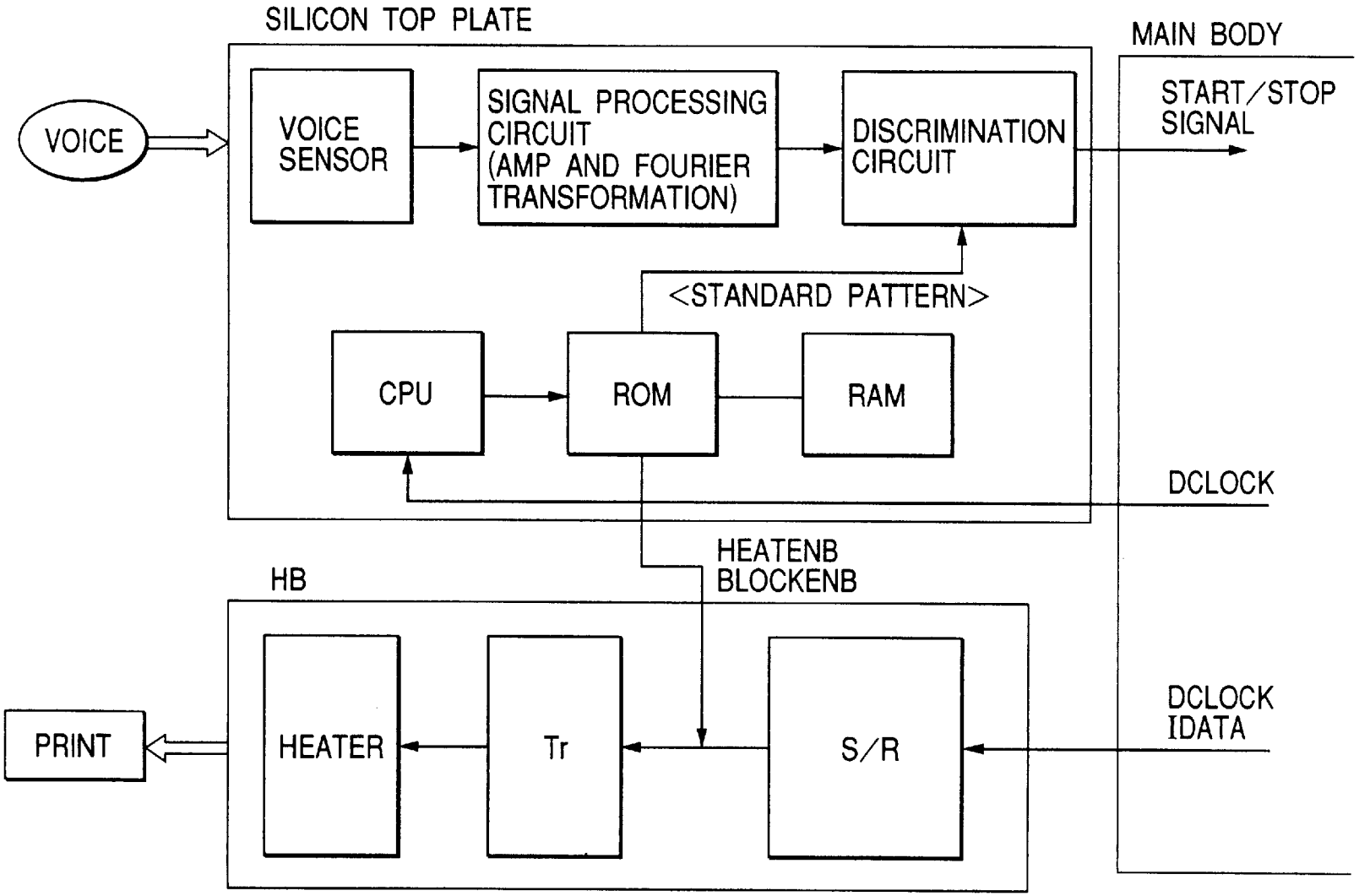
FIG. 33 is a block diagram showing the signal flow in an embodiment of the present invention.

In case the voice input signal is used as the trigger signal for starting the recording operation of the liquid discharge recording apparatus, the voice is recognized, as shown in FIGS. 32 and 33, by detection by the voice sensor in the top plate, then converted in the frequency region in the signal processing circuit, standardization of the length and tone, extraction of features, and matching with a standard pattern. The voice is recognized in the order of "single sound", "word", "phrase" and "text".

For example, a voice such as "start printing" or "stop printing" is transmitted as an electrical signal such as START/STOP. In response, a CLOCK signal is transmitted from the main body to the CPU of the top plate, while the CLOCK signal and IDATA (image data) are transmitted to an HB shift register. Then the CPU of the top plate transmits a HEAT/BLOCK signal (optimized) to HB through ROM to execute heater control through Tr, thereby executing the printing operation.

The recognized voice may also be recorded in a recording medium or emitted as an electrically synthesized voice from a speaker.

In the foregoing there has been explained a configuration of detecting an input sound from the exterior of the head, by a sensor provided in the element substrate 1 or 3, thereby executing image formation or starting the image recording.

The present invention is not limited to such configuration but also includes a configuration of detecting the acoustic wave at the liquid discharge by a sensor, thereby judging the state of the head or the nozzle. More specifically, an acoustic sensor is provided in the head to acoustically detect various states such as mechanical malfunction of the head, image unevenness caused by unevenness within the head, state of the heaters, time-dependent change in the heaters, failed discharge in the course of the printing operation etc. and to execute feedback control toward the normal state.

An example of the control method in such configuration will be explained with reference to the circuit diagram shown in FIGS. 29A and 29B. Also in this case, the sensor may be provided on the element substrate 1 or 3, and the configuration of the sensor is same as shown in FIG. 30. In such configuration, the nozzles of a satisfactory head are driven in succession, and the acoustic wave of such successive satisfactory states is stored in the memory 49. Subsequently, the acoustic wave is detected by driving the nozzles in succession at the inspection for shipping from the factory or at the preliminary discharge prior to the printing operation, and the detected wave is compared with the stored acoustic wave. In this manner the discharge state is judged for each nozzle, and information for correcting the discharge amount or for executing the suction recovery of the nozzle is supplied to the drive signal control circuit 46 or to the control portion of the ink suction means.

For example, if the aforementioned detected wave indicates a loss of the output in all the nozzles in comparison with the acoustic wave in the satisfactory state, there is judged a bubble trapped in the common liquid chamber and there is executed the suction recovery operation of the head. Also if the detected wave is zero in the entire head or in a part thereof, there is not liquid discharge in all the nozzles or a part thereof, so that the suction recovery operation for the head is executed also in this case. Also in case the detected acoustic wave indicates that the output is lower in a nozzle, the discharge characteristics are corrected on such nozzle. Also in case the detected wave includes abnormality in the high frequency components, there is judged defective adjoining of the element substrates 1 and 3, so that the head is removed at the inspection for the shipment or the head replacement is informed to the user in case of the recording operation at the user.

In the present invention, as explained in the foregoing, the voice sensor provided in the liquid discharge head allows to execute image formation based on a voice input or to start image formation triggered by a voice input. Also, the liquid discharge head may be provided with a sensor for detecting the acoustic wave at the liquid discharge, thereby being capable of judging a defect in the head or in the nozzle, through comparison with the acoustic wave in a normal head.

[Sixth Embodiment]

In the following there will be explained an embodiment in which an image sensor is provided in the head.

This embodiment will be explained in the following with reference to the attached drawings.

Figure 34A:
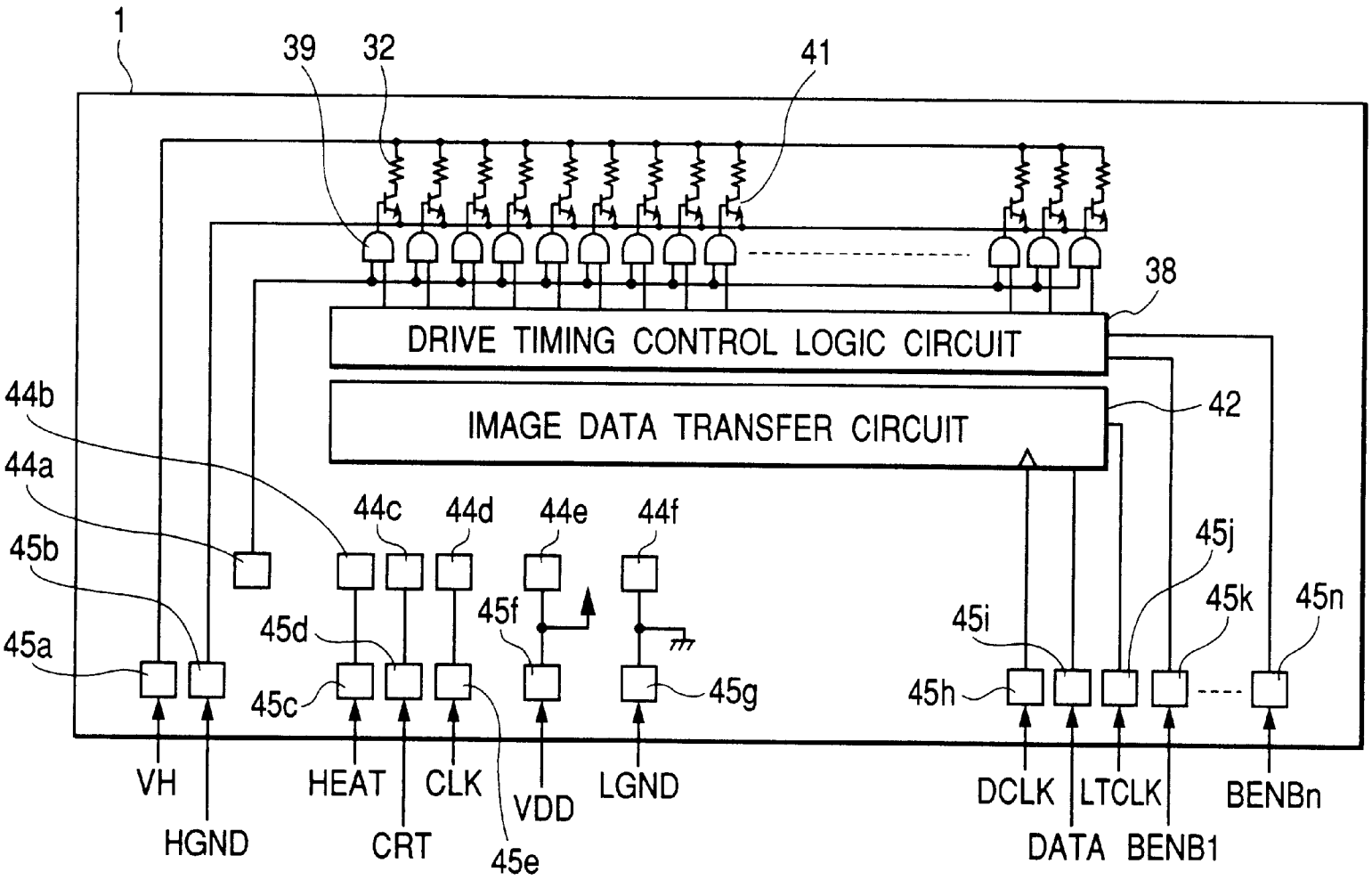
FIGS. 34A and 34B are views showing an example of the circuit configuration of the element substrate 1 for controlling the energy to be applied to the heat generating members and the top plate 3.
Figure 34B:
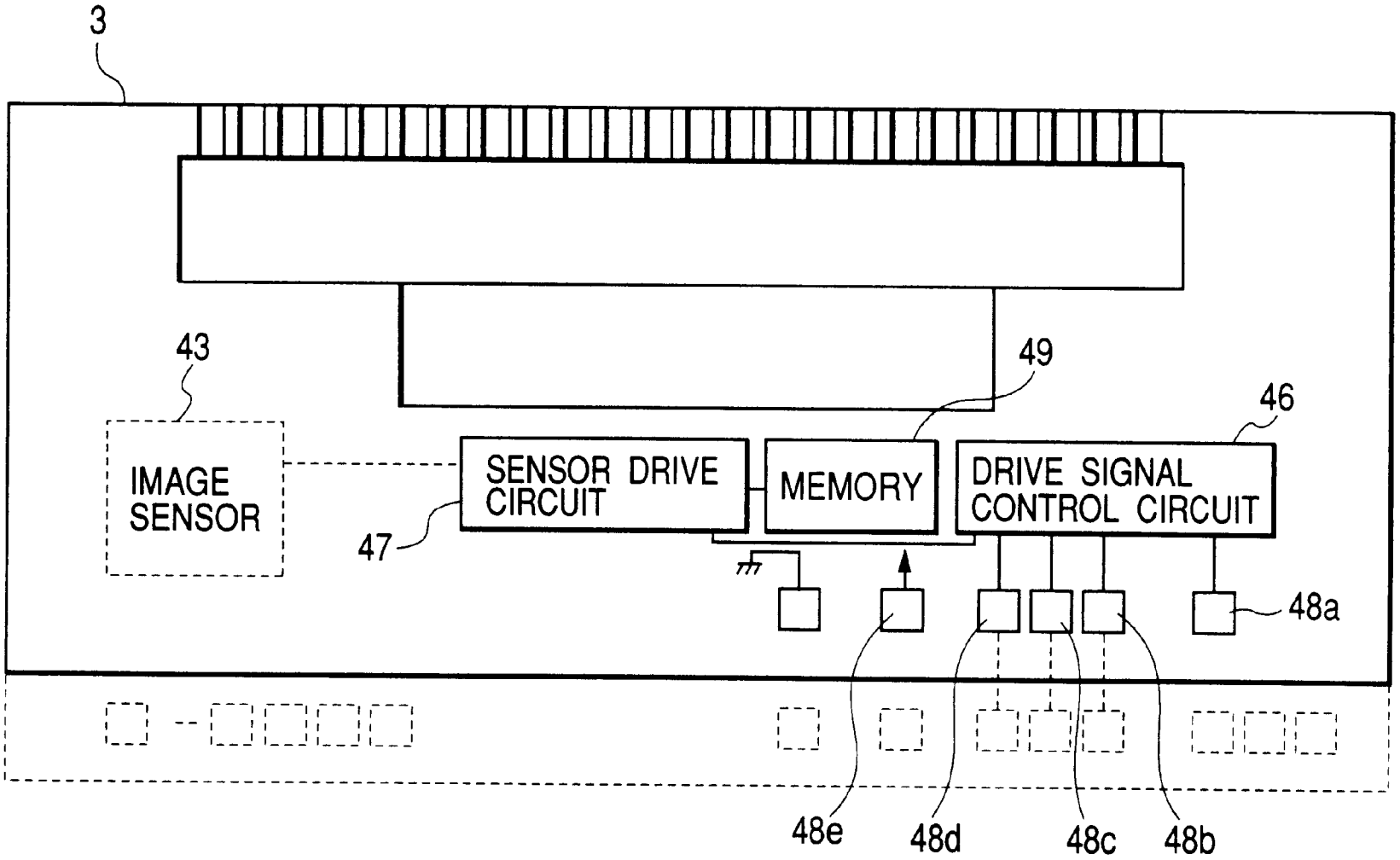

FIGS. 34A and 34B show an example of the circuit configuration of the element substrates 1 and 3, capable of controlling the energy applied to the heat generating members.

As shown in FIG. 34A, an element substrate 1 is provided with heat generating members 32 arranged in a linear array, power transistors 41 functioning as drivers, AND gates 39 for controlling the function of the power transistors 41, a drive timing controlling logic circuit 38 for controlling the drive timing of the power transistors 41, and an image data transfer circuit 42 constituted by a shift register and a latch circuit.

The drive timing controlling logic circuit 38 is provided for driving the heat generating members 32 in divided manner on time-shaped basis instead of simultaneous driving, in order to reduce the power supply capacity of the apparatus, and enable signals for activating the logic circuit 38 are entered from enable signal input terminals 45*k* to 45*n* constituting an external contact pad.

In addition to the enable signal input terminals 45*k* to 45*n*, the external contact pads provided on the element substrate 31 include an input terminal 45*a* for the power supply for driving the heat generating members 32, a ground terminal 45*b* for the power transistors 41, signal input terminals 45*c* to 45*e* for controlling the energy for driving the heat generating members 32, a driving power supply terminal 45*f* for the logic circuit, a ground terminal 45*g*, an input terminal 45*i* for the serial data entered into the shift register of the image data transfer circuit 42, an input terminal 45*h* for a serial clock signal synchronized with the serial data, and an input terminal 45*j* for a latch clock signal to be entered into the latch circuit.

On the other hand, as shown in FIG. 34B, a top plate 3 is provided with an image sensor 43, a sensor drive circuit 47 for driving the image sensor 43, a memory 49 for storing codes ranked according to the resistance data or resistance and the liquid discharge characteristics measured in advance for the respective heat generating member 32 as head information and supplying such head information to the drive signal control circuit 46, and a drive signal control circuit 46 for controlling the energy applied to the heat generating members 32 by referring to the data stored in the memory 49 and according to thus referred data.

As contact pads for connection between the element substrate 1 and the top plate 3, there are provided a terminal line for connecting the sensor drive circuit 47, terminals 44*b* to 44*d*, 48*b* to 48*d* for connecting the input terminals 45*c* to 45*e* for external signals for controlling the energy for driving the heat generating members 32 with the drive signal control circuit 46, and a terminal 48*a* for entering the output thereof into an input port of each of the AND gates 39.

As explained in the foregoing, various circuits for driving and controlling the heat generating members are divided between the element substrate 1 and the top plate 3 in consideration of the mutual electrical connection thereof, so that these circuits are not concentrated on a single substrate and the liquid discharge head can be made compact. Also the circuits provided on the element substrate 1 and those on the top plate 3 are electrically connected through the connecting contact pads, whereby the number of electrical connections to the exterior can be reduced to realize improvement in the reliability, reduction of the number of components and further compactization of the head.

Furthermore, the distribution of the above-mentioned circuits between the element substrate 1 and the top plate 3 allows to improve the yield of the element substrate 1, thereby reducing the production cost of the liquid discharge head. In addition, the element substrate 1 and the top plate 3, being composed of a same material based on silicon, have a same thermal expansion coefficient. As a result, when the element substrate 1 and the top plate 3 are thermal expanded by driving the heat generating elements, there is not generated an aberration therebetween so that the positional precision of the heat generating member and the liquid paths is satisfactorily maintained.

Figure 35:
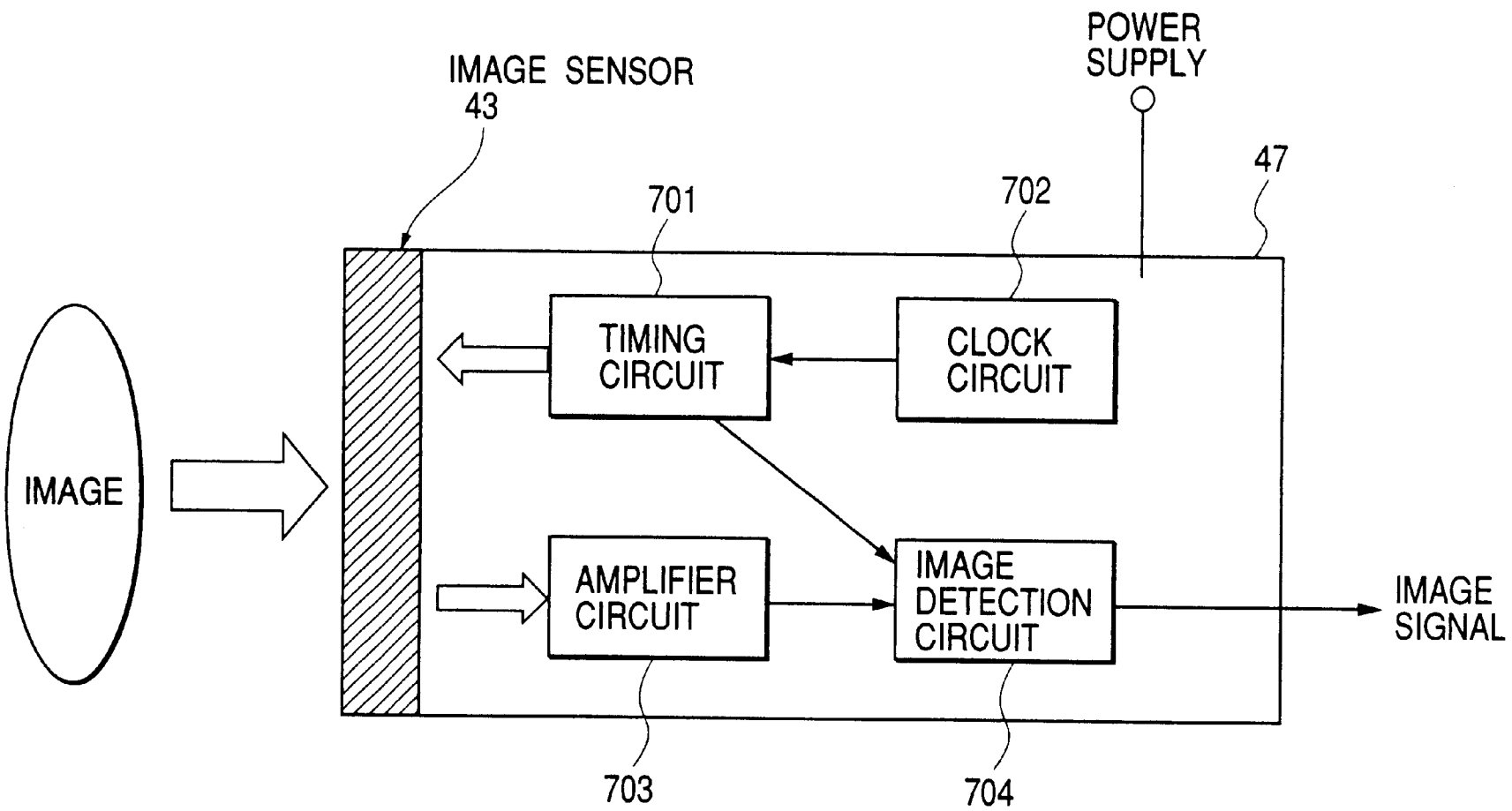
FIG. 35 is a view conceptually showing the function of an image sensor 43 and a sensor drive circuit 47 shown in FIGS. 34A and 34B.

FIG. 35 is a view conceptually showing the function of the image sensor 43 and the sensor drive circuit 47 in the above-described configuration.

The sensor drive circuit 47 is composed of a timing circuit 701, a clock circuit 702, an amplifying circuit 703 and an image detecting circuit 704.

When image bearing light falls on a photoelectric conversion portion of the image sensor 43, there are accumulated positive charges corresponding to the light intensity. Such charges are transferred in succession in the vertical direction and then in the horizontal direction, by clock pulses of the charge transfer portion, generated at timings determined by the timing circuit 701, whereby the output terminal provides voltage changes corresponding to the light intensity as serial signals. Such voltage changes are amplified by the amplifying circuit 703, and the image detection circuit 704 forms an image signal by adding a horizontal sync pulse at the timing determined by the timing circuit 701 and a vertical sync pulse at the end of scanning of an image frame, to thus amplified signals.

The light amount detected by the plural image sensors arranged regularly is amplified by digital signal processing and is converted in a time-sequential image signal, which is then stored in the memory 49.

In the present embodiment of the above-described configuration, the memory 49 is used in different manner in the recording operation and in the image detecting operation.

In the recording operation, the drive signal control circuit 46 determines the data for upshift and downshift of the drive pulse for the heat generating member 32 according to the resistance data and the liquid discharge characteristics stored in the memory 49, and sends such data to the AND gate 39 through the terminals 48*a*, 44*a*. On the other hand, the serially entered image data are stored in the shift register of the image data transfer circuit 42, then latched in the latch circuit by the latch signal and supplied to the AND gates 39 by the drive timing control circuit 38. Thus the pulse width of the heating pulse is determined according to the upshift and downshift data, and the heat generating member 32 is energized with such pulse width. As a result, heat generating member 32 is given a substantially constant energy.

Also at the image detecting operation, the image signal detected by the image sensor 43 and the sensor drive circuit 47 is stored in the memory 49.

In the present embodiment, as explained in the foregoing, the memory 49 is used in different manner at the recording operation and at the image detection, so that the two memories can be united into one memory and the apparatus can therefore be compactized.

The storage of the codes ranked according to the resistance data or resistance value and the liquid discharge characteristics measured in advance for each heat generating member as the head information in the memory 49, and the extraction of the image signal accumulated at the image detection, are executed through the terminal 48*e*.

Figure 36:
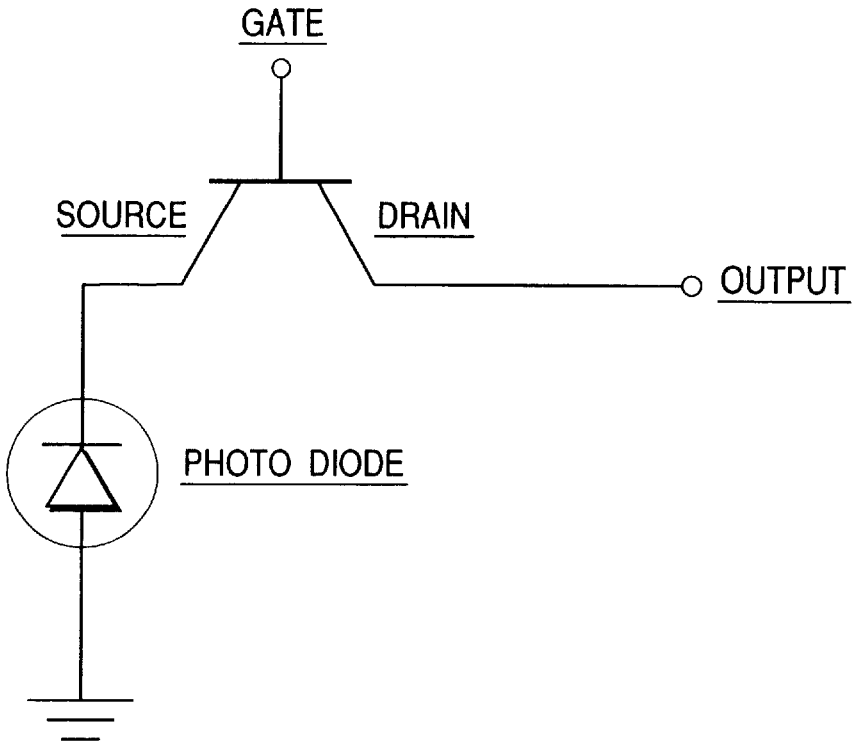
FIG. 36 is an equivalent circuit diagram of a MOSFET image sensor in which the image sensors are given two dimensional addresses and the addresses are scanned in succession by a digital shift register.
Figure 37:
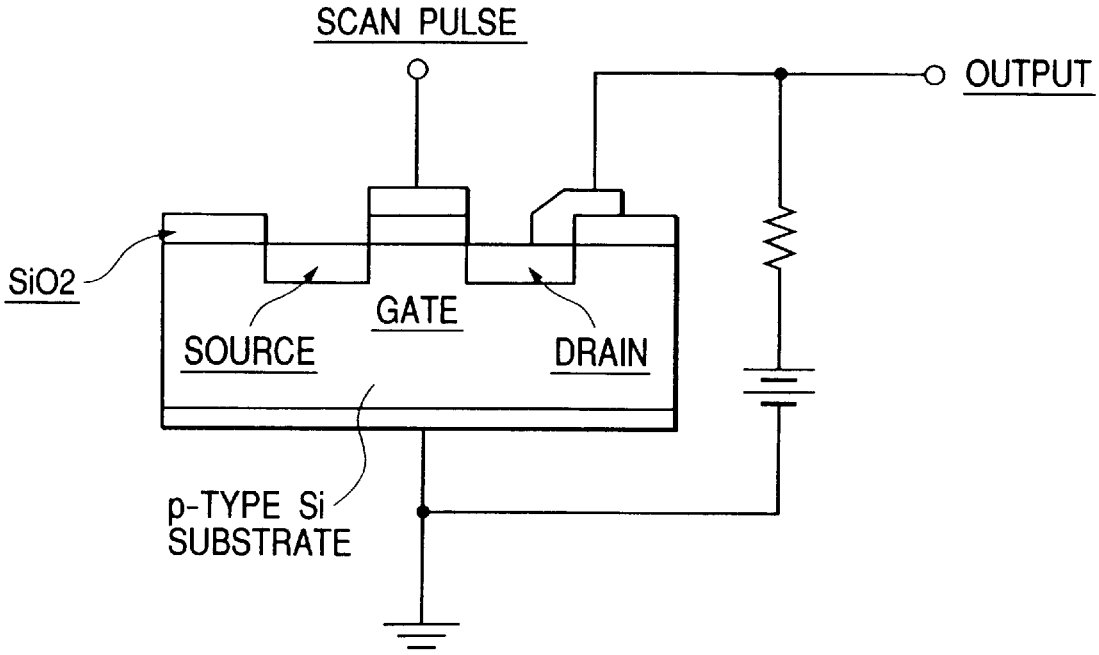
FIG. 37 is a view showing the configuration of a MOSFET image sensor in which the image sensors are given two dimensional addresses and the addresses are scanned in succession by a digital shift register.

FIGS. 36 and 37 are respectively an equivalent circuit diagram and a configuration view of a MOSFET image sensor, in which the image sensor is given two-dimensional addresses, and such addresses are scanned in succession with digital shift registers.

A PN junction in the source area functions as a photodiode or a photosensor unit. With a positive pulse voltage applied to the gate electrode, a charge is accumulated in the photosensor unit constituted by the PN junction. Such charge is dissipated by the carriers generated by the light irradiating the photosensor unit, so that the light amount falling on the photosensor unit can be detected by periodically applying a pulse signal to the gate and reading the change in the source potential.

Figure 38:
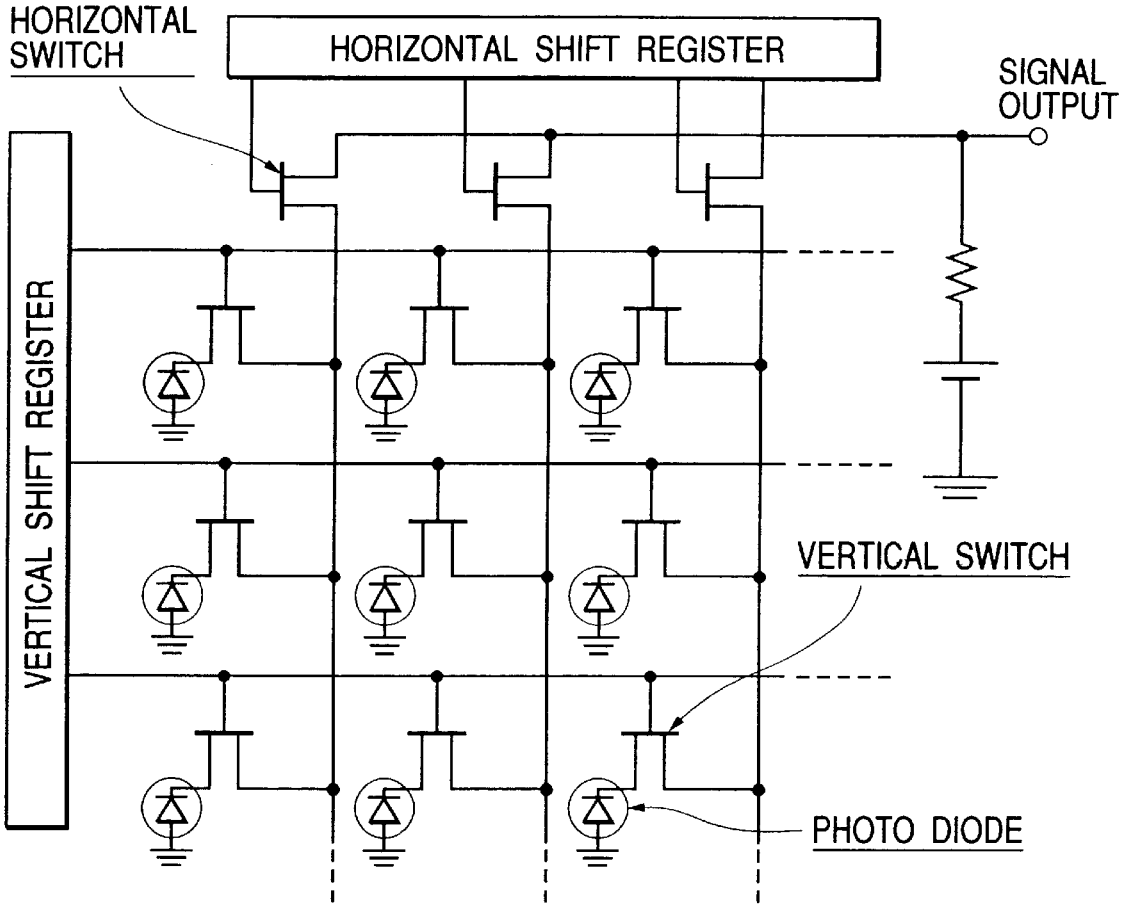
FIG. 38 is a view showing the configuration of an image sensor in which the MOSFET image sensors are arranged two dimensionally and combined with shift registers for controlling horizontal and vertical scannings.

FIG. 38 shows the configuration of an image sensor, formed by arranging such MOSFET image sensor two dimensionally and combining shift registers for controlling the horizontal and vertical scanning operations. In the illustrated circuit, the horizontal scanning is achieved by turning on/off the drain voltage of the MOSFET, and the vertical scanning is achieved by simultaneously turning on/off all the gates of the MOSFET's required for a horizontal scanning operation.

Figure 39:
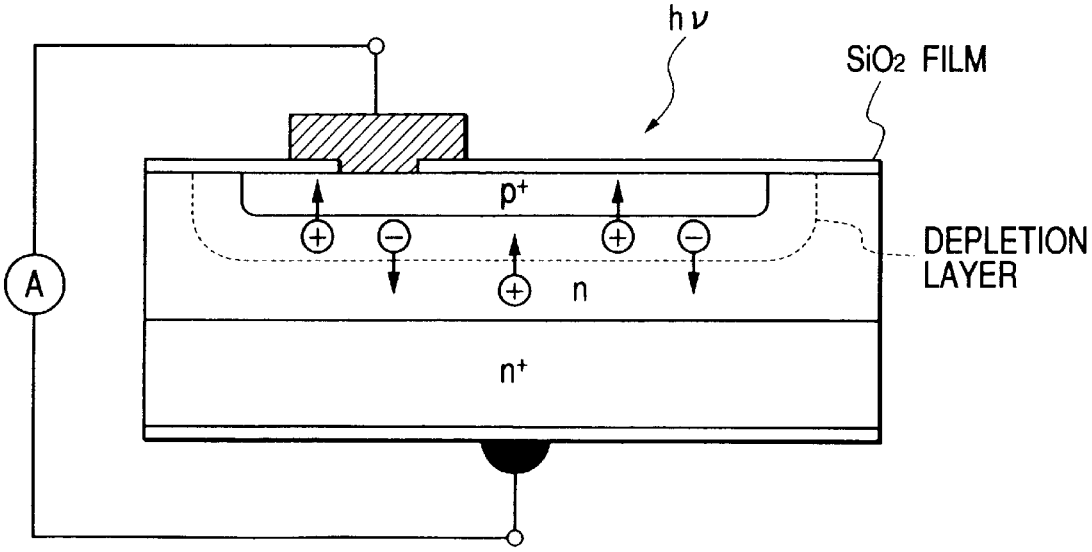
FIG. 39 is a cross-sectional view showing the configuration of a light amount sensor utilizing photovoltaic effect.

FIG. 39 is a cross-sectional view showing the configuration of a light amount sensor utilizing photovoltaic effect.

When light falls, through an $SiO_2$ film, on a sensor containing an internal electric field across a depletion layer, there are generated carriers and the electrons gather at the n side while the positive holes gather at the p side. These carriers can be collected by shortcircuiting the external terminals to obtain a photocurrent, of which intensity is approximately proportional to the amount of light falling on the pn junction.

As explained in the foregoing, the present embodiment incorporates an image sensor and a driving system therefor in the top plate of the liquid discharge head. In the following there will be explained the external appearance of the liquid discharge head and the mode of use thereof.

Figure 40:
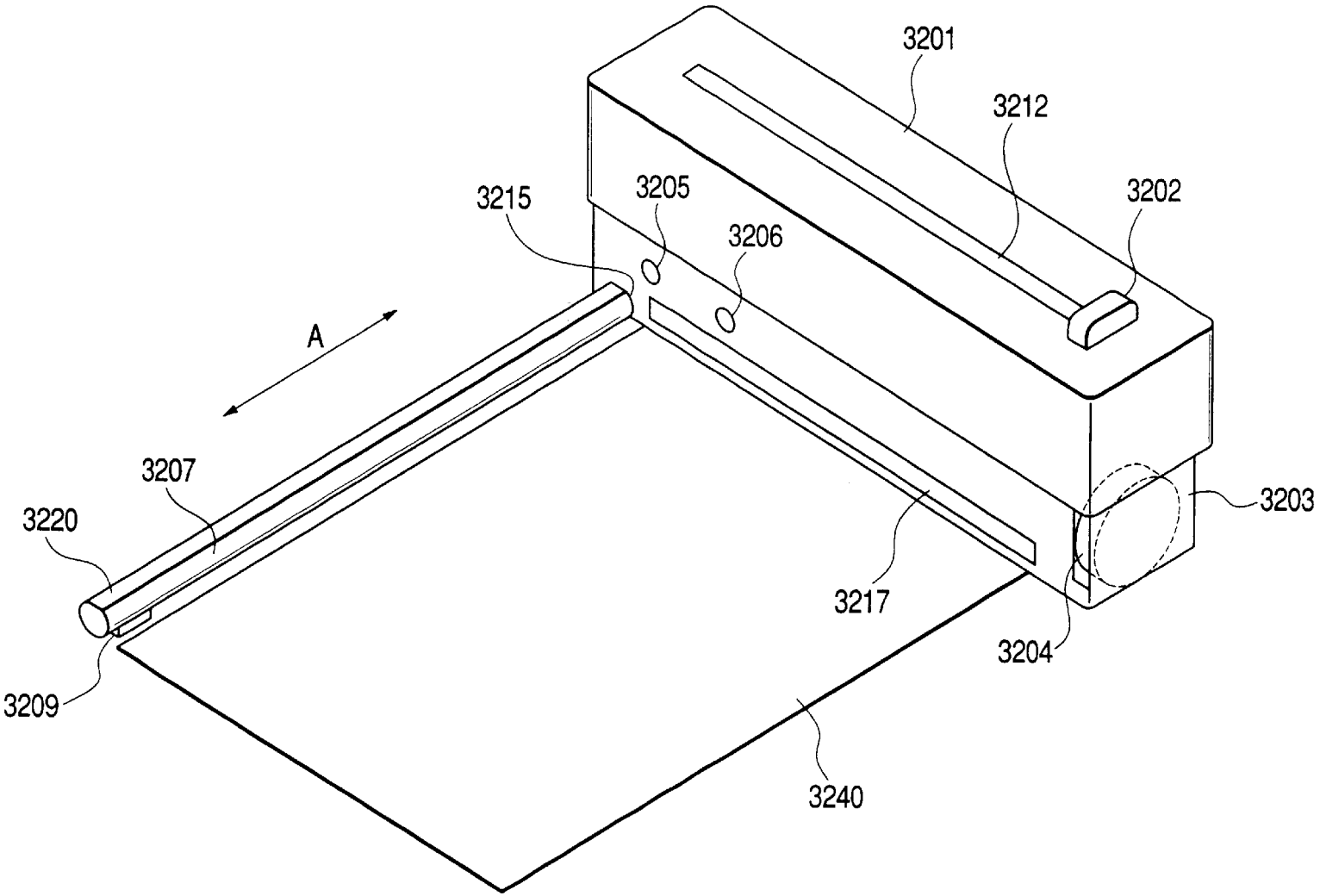
FIG. 40 is a perspective view of an embodiment of the portable recording apparatus of the present invention in a state in the course of a printing operation.
Figure 41:
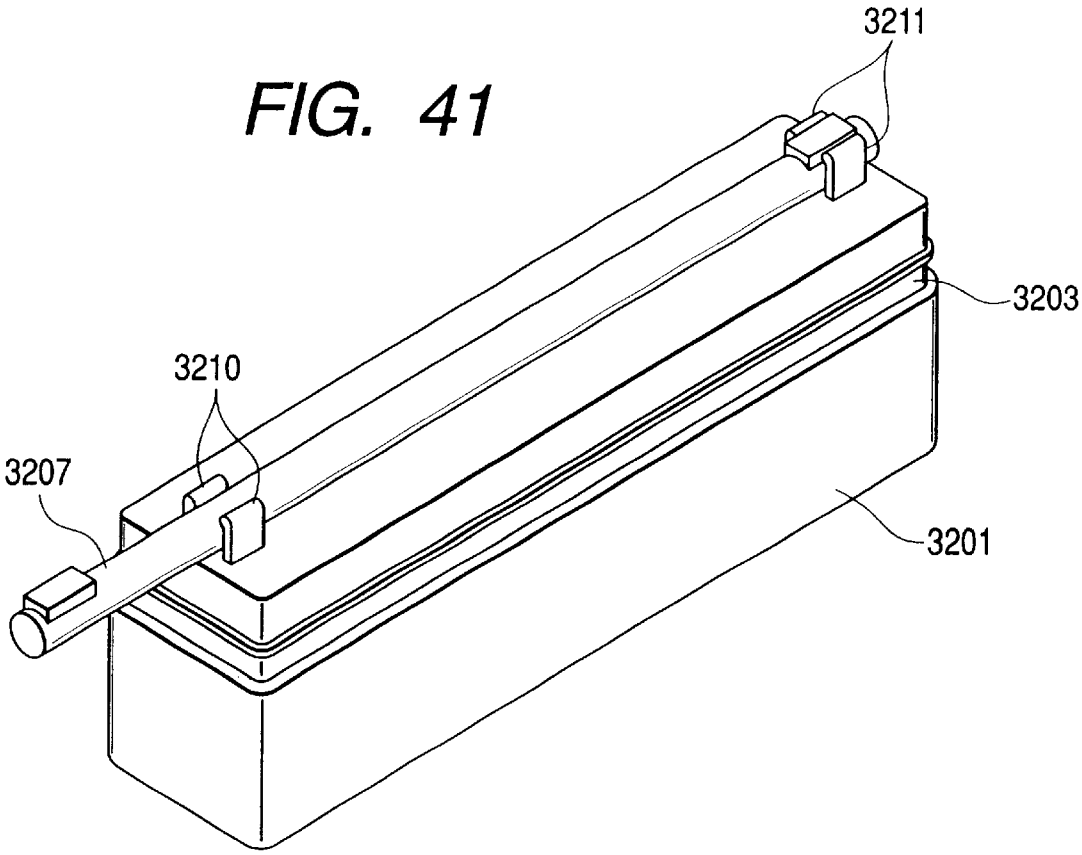
FIGS. 41 and 42 are perspective views of the recording apparatus shown in FIG. 40, in a state during transportation.
Figure 42:
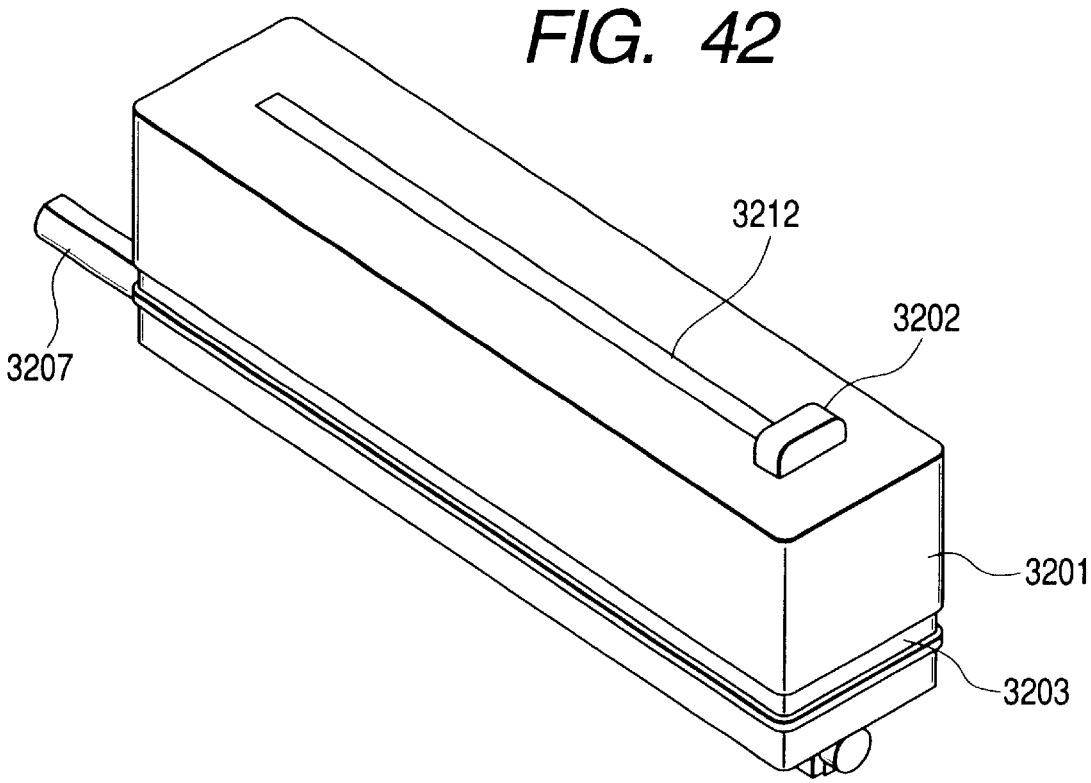

FIG. 40 is a perspective view of a portable recording apparatus embodying the present invention, in a state in the course of printing operation, and FIGS. 41 and 42 are perspective view of the recording apparatus shown in FIG. 40, in a carried state.

As shown in FIG. 40, the recording apparatus of the present embodiment is provided with a main body 3203, and a cap 3201 covering such main body. The main body 3203 is provided with a recording head for discharging ink thereby recording an image on a recording sheet, an ink tank containing ink to be supplied to the recording head, and a CCD sensor portion 3217 serving as an image sensor. The main body 3203 is also provided with a printed circuit board for controlling the discharge signal to the recording head of the configuration shown in FIG. 34 and controlling the signal exchange with the exterior, a drive system for driving the CCD sensor portion 3217, and a power source (not shown) for electric energy supply to the signal processing system, recording head and various circuits. The casing of the main body 3203 is composed of a plastic material such as ABS resin. The cover 3201 covers the recording head when it is not in printing, for example when the apparatus is carried, thereby preventing drying of the ink discharge apertures and dust deposition thereto. At the central portion of the cap 3201 there is longitudinally provided a groove 3212, and a lever 3202 for wiping the discharge apertures is provided to slide along the groove 3212 in the state shown in FIGS. 41 and 42. The recording apparatus of the present embodiment is further provided with a guide shaft 3207, serving as a guide for causing the scanning motion of the recording apparatus with respect to the recording sheet 3240. The guide shaft 3207 is composed of a substantially cylindrical rod member, and a notch is formed in a part of the periphery and along the entire longitudinal direction. At a side of the guide shaft 3207 opposite to the notch, rubber feet 3209 are provided in the vicinity of both ends of the guide shaft 3207. In the printing state, the guide shaft 3207 is slidably inserted in a guide hole 3215 provided in the main body 3203. The main body 3203 moves by the rotating operation of a roller 3204 to execute the recording operation or the image reading operation, and such movement is executed along the guide shaft 3207 inserted into the guide hole 3215. The guide shaft 3207 and the guide hole 3215 constitute guide means for causing a scanning motion of the main body 3203 in a predetermined direction with respect to the recording medium 3240. FIG. 40 shows a state in the recording operation. The main body 3203 is also provided with a second guide hole (not shown) perpendicular to the longitudinal direction of the main body 3203 and that of the guide shaft 3207 in the illustrated state, and, in the image reading operation by the CCD sensor portion 3217, the second guide hole and the guide shaft 3207 constitute the guide means.

A magnetic encoder 3220 is adhered to the notched portion of the guide shaft 3207, and is used by an internal sensor (not shown) to detect the moving state of the main body 3203 in the recording operation or in the image reading operation.

The recording apparatus is further provided with an LED 3205 indicating the state of the apparatus and a switch 3206 serving as input means of the apparatus. The LED 3205 and the switch 3206 are connected to the aforementioned printed circuit board. The recording apparatus is further provided with an interface for exchanging electrical signals with a personal computer or the like, and such interface is also connected to the printed circuit board. FIG. 40 shows a state of the printing operation by the recording apparatus of the present embodiment, on a recording sheet 3240 placed on a flat desk or the like. The main body 3203 is provided with a rotatable roller 3204, which is in contact, together with two rubber feed 3209 provided on the guide shaft 3207, with the desk surface on which the recording sheet 3240 is placed.

As shown in FIG. 41, the main body 3203 is integrally provided with fingers 3210, 3211, which are so constructed as to support the guide shaft 3207 at the carrying. At the printing, the guide shaft 3207 is detached from the fingers 3210, 3211 and the cap 3201 is placed on a side of the main body 3203 on which the fingers 3210, 3211 are provided.

In the recording apparatus of the above-described configuration, an image is recorded on the recording medium 1240 by rotating the roller 3204 in contact therewith to move the apparatus in a running direction A along the guide shaft 3207, and outputting the print timing signal in synchronization with the rotation of the roller 3204, and causing the recording head to execute the printing operation in synchronization with such print timing signal.

In the image reading operation, the guide shaft 3207 is inserted into the second guide hole and the roller 3204 is rotated in contact with the object for image reading, thereby moving the apparatus in the running direction A along the guide shaft 3207 and outputting a reading timing signal from the timing circuit 701 in synchronization of the rotation of the roller 3204, whereby the image reading is executed in synchronization with such timing signal.

What is claimed is:

1. A liquid discharge head, comprising first and second substrates which are to be mutually adjoined to form plural liquid paths respectively communicating with plural discharge apertures, wherein said first substrate is provided with energy conversion elements, for converting electrical energy into energy for discharging liquid in the liquid paths, respectively corresponding to the liquid paths; and said second substrate is provided with detection elements, for detecting a state of the liquid in said liquid paths, respectively corresponding to the liquid paths, and amplification means for respectively amplifying outputs of said detection elements, wherein said second substrate further includes selector switch means for executing drive and detection of said detection elements in a serial manner.

2. A liquid discharge head according to claim 1, wherein said amplification means is adapted to respectively receive the outputs of said detection elements with a high impedance and to execute output with a low impedance.

3. A liquid discharge head according to claim 1, wherein said second substrate further includes drive means for respectively driving said detection elements.

4. A liquid discharge head according to claim 1, wherein said second substrate further includes drive control means for respectively receiving results of detection of said detection elements through said amplification means, to control a drive condition of each of said energy conversion elements according to said results of detection.

5. A liquid discharge head according to claim 1, wherein second substrate further includes selector switch means for executing drive and detection of said detection elements in a serial manner.

6. A liquid discharge head according to claim 1, wherein said detection element is a sensor adapted to detect a change in resistance or temperature through the liquid.

7. A liquid discharge head according to claim 1, further comprising a plurality of electrodes provided in mutually opposed positions of said first and second substrates.

8. A liquid discharge head according to claim 1, further comprising an acoustic sensor for detecting the sound at the liquid discharge by the liquid discharge head, and a circuit for comparing the acoustic wave detected by said acoustic sensor with an acoustic wave memorized in advance, the acoustic sensor being provided on one of said first substrate and said second substrate.

9. A liquid discharge apparatus employing a liquid discharge head according to claim 8, wherein the result of comparison by said circuit is for changing the drive condition of the energy generation element of said liquid discharge head, executing a discharge recovery process of said liquid discharge head, or informing the user of replacement of said liquid discharge head.

10. A liquid discharge head according to claim 1, wherein said first and second substrates are respectively provided with electrical connecting portions for electrically connecting said detection elements with wirings provided on said first substrate, and the electrical connecting portion on said first substrate and the electrical connecting portion on said second substrate are adjoined by eutectic bonding.

11. A liquid discharge head according to claim 10, wherein said first and second substrates are respectively provided with engaging portions, for mutual engagement, different from said electrical connecting portions.

12. A liquid discharge head according to claim 1, further comprising an image sensor for converting an optical image into an electrical signal, wherein said energy conversion elements and a first control circuit for controlling said energy conversion elements are provided on said first substrate, and said image sensor and a second control circuit for controlling said image sensor are provided on said second substrate.

13. A liquid discharge head according to claim 12, wherein said first control circuit is composed of a drive timing control logic circuit for controlling the drive timing of the plural energy conversion elements and an image data transfer circuit for accumulating the data of the image to be formed, and said second control circuit is composed of a sensor drive circuit for driving said image sensor and forming an image signal from the output of said image sensor.

14. A liquid discharge head according to claim 13, wherein:

said second substrate includes a memory and a drive signal control circuit for determining the energy to be applied to the plural energy conversion elements;

said memory is adapted to memorize liquid discharge characteristics measured in advance for each of the energy conversion elements as head information and to store the image signal generated by the sensor drive circuit; and said drive signal control circuit is adapted to control the energy to be applied to the heat generating element according to the liquid discharge characteristics of each energy conversion element memorized in said memory.

15. A liquid discharge head, comprising first and second substrates which are to be mutually adjoined to form plural liquid paths respectively communicating with plural discharge apertures, wherein said first substrate is provided with energy conversion elements, for converting electrical energy into energy for discharging liquid in the liquid paths, respectively corresponding to the liquid paths, wherein said second substrate is provided with detection elements, for detecting a state of the liquid in said liquid paths, respectively corresponding to the liquid paths, and amplification means for respectively amplifying outputs of said detection elements, wherein either of said first and second substrates is provided with plural protruding electrical connecting portions for electrically connecting said detection elements with wirings provided on said first substrate, and the other of said first and second substrates is provided with plural recessed electrical connecting portions to respectively engage with said plural protruding electrical connecting portions and to be respectively connected electrically with said plural protruding electrical connecting portions when said first and second substrates are adjoined, and wherein a lateral wall portion of said recessed electrical connecting portion is composed of a part of a liquid path forming member constituting said liquid path, and said recessed electrical connecting portion is formed by eliminating a predetermined portion of said liquid path forming member, when a portion corresponding to said liquid path is eliminated from said liquid path forming member in order to form said liquid path.

16. A liquid discharge head according to claim 15, wherein said protruding electrical connecting portion and said recessed electrical connecting portion are adjoined by eutectic bonding.

17. A liquid discharge head according to claim 15, wherein said protruding electrical connecting portion is composed of a metal bump formed on an electrode provided in said either substrate, while said recessed electrical connecting portion is composed of a metal portion in at least a part of the portion in contact with said protruding electrical connecting portion, and said metal bump and said metal portion are adjoined by eutectic bonding.

18. A liquid discharge head according to claim 15, wherein said protruding electrical connecting portion and at least a part of said recessed electrical connecting portion contain a metal selected from a group consisting of gold, copper, platinum, tungsten, aluminum and ruthenium or an alloy containing a metal selected from a group consisting of gold, copper, platinum, tungsten, aluminum and ruthenium.

19. A liquid discharge head according to claim 15, wherein said first and second substrates are composed of silicon, and said elements or electrical circuits are formed on said first and second substrates by a semiconductor wafer process technology.

20. A head cartridge comprising a liquid discharge head according to any of claims 1–8 and 10–19, and a liquid container for containing liquid to be supplied to said liquid discharge head.

21. A liquid discharge apparatus comprising a liquid discharge head according to any of claims 1–8 and 10–19, and drive signal supply means for supplying a drive signal for causing said liquid discharge head to discharge liquid.

22. A liquid discharge apparatus according to claim 21, wherein an energy generating element on a first substrate constituting said liquid discharge head is driven under adjustment based on the result of detection obtained by a detection element of a second substrate constituting said liquid discharge head, thereby discharging liquid onto a recording medium to execute recording.

23. A liquid discharge apparatus comprising a liquid discharge head according to any of claims 1–8 and 10–19, and recording medium conveying means for conveying a recording medium for receiving liquid discharged from said liquid discharge head.

* * * * *